US010856607B2

(12) United States Patent
Hatfield et al.

(10) Patent No.: US 10,856,607 B2
(45) Date of Patent: Dec. 8, 2020

(54) ARTICLES OF FOOTWEAR INCLUDING A MULTI-PART SOLE STRUCTURE

(71) Applicant: NIKE, Inc., Beaverton, OR (US)

(72) Inventors: Tinker L. Hatfield, Portland, OR (US); Tiffany A. Beers, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 115 days.

(21) Appl. No.: 15/948,069

(22) Filed: Apr. 9, 2018

(65) Prior Publication Data

US 2018/0289105 A1 Oct. 11, 2018

Related U.S. Application Data

(60) Provisional application No. 62/484,362, filed on Apr. 11, 2017.

(51) Int. Cl.

| | |
|---|---|
| ***A43B 13/14*** | (2006.01) |
| ***A43B 13/12*** | (2006.01) |
| ***A43B 7/14*** | (2006.01) |
| ***A43B 13/42*** | (2006.01) |

(52) U.S. Cl.

CPC ..... *A43B 13/14* (2013.01); *A43B 7/1405* (2013.01); *A43B 13/125* (2013.01); *A43B 13/42* (2013.01)

(58) Field of Classification Search

CPC ..... A43B 13/125; A43B 13/14; A43B 13/42; A43B 13/143; A43B 13/16; A43B 13/188; A43B 13/186; A43B 13/20; A43B 7/1405; A43B 7/148

USPC ..... 36/31, 28

See application file for complete search history.

(56) References Cited

U.S. PATENT DOCUMENTS

| | | | | |
|---|---|---|---|---|
| 4,302,892 | A * | 12/1981 | Adamik | A43B 13/188 36/31 |
| 4,730,402 | A * | 3/1988 | Norton | A43B 13/187 36/114 |
| 4,759,136 | A * | 7/1988 | Stewart | A43B 7/14 36/114 |
| 4,852,274 | A * | 8/1989 | Wilson | A43B 13/20 36/29 |
| 5,396,675 | A * | 3/1995 | Vincent | A43B 13/12 12/142 P |

(Continued)

FOREIGN PATENT DOCUMENTS

| | | | |
|---|---|---|---|
| EP | 2230956 | A1 | 9/2010 |
| WO | 2005063071 | A2 | 7/2005 |
| WO | 2014151379 | A2 | 9/2014 |

OTHER PUBLICATIONS

Jul. 20, 2018—(WO) ISR & WO, App. No. PCT/US18/026662.

*Primary Examiner* — Heather Mangine
(74) *Attorney, Agent, or Firm* — Banner & Witcoff, Ltd.

(57) ABSTRACT

Sole structures and/or articles of footwear include: (a) a frame with a first sidewall that has an opening defined through it; and (b) an interior midsole component including a second sidewall that extends along the first sidewall of the frame. The interior midsole component includes an outwardly extending stem projecting sideways and into the opening. This stem: (a) may extend at least to a location at or adjacent an outer surface of the first sidewall, (b) may be complementary shaped with respect to an interior surface of the opening over at least 25% of an axial length of the opening, and/or (c) may extend beyond an outermost extent of the opening.

20 Claims, 31 Drawing Sheets

(56) References Cited

U.S. PATENT DOCUMENTS 5,575,088 A * 11/1996 Allen ..... A43B 1/0072 36/28
5,799,417 A * 9/1998 Burke ..... A43B 3/0047 36/105
D411,579 S * 6/1999 Dolinsky ..... D2/947
6,708,424 B1 * 3/2004 Ellis, III ..... A43B 5/00 36/114
7,347,011 B2 3/2008 Dua et al.
7,565,754 B1 * 7/2009 Acheson ..... A43B 13/026 36/144
7,779,557 B2 * 8/2010 Teteriatnikov ..... A43B 13/145 36/25 R
7,941,938 B2 5/2011 Yu et al.
8,429,835 B2 4/2013 Dojan et al.
2006/0277792 A1 * 12/2006 Schoenborn ..... A43B 13/143 36/28
2006/0283046 A1 * 12/2006 Mason ..... A43B 3/0042 36/28
2007/0033830 A1 * 2/2007 Chang ..... A43B 3/0052 36/28
2007/0107259 A1 * 5/2007 Kilgore ..... A43B 7/144 36/31
2007/0119075 A1 * 5/2007 Schindler ..... A43B 7/144 36/29
2007/0193065 A1 * 8/2007 Nishiwaki ..... A43B 13/184 36/27
2009/0019729 A1 * 1/2009 Nakano ..... A43B 7/14 36/91
2009/0126230 A1 * 5/2009 McDonald ..... A43B 1/0063 36/88
2009/0151093 A1 * 6/2009 Schindler ..... A43B 13/12 12/146 B
2011/0277355 A1 * 11/2011 Fahmi ..... A43B 3/0063 36/30 R
2012/0005920 A1 * 1/2012 Alvear ..... A43B 13/125 36/28
2012/0324758 A1 * 12/2012 Tang ..... A43B 13/12 36/28
2013/0091739 A1 * 4/2013 Yang ..... A43B 7/14 36/30 R
2013/0104423 A1 5/2013 Hatfield et al.
2013/0192087 A1 * 8/2013 Litchfield ..... A43B 13/203 36/29
2013/0291409 A1 * 11/2013 Reinhardt ..... A43B 1/0009 36/30 R
2014/0033574 A1 * 2/2014 Wan ..... A63B 21/00061 36/103
2014/0090189 A1 * 4/2014 Parker ..... A43B 13/04 12/146 B
2014/0202031 A1 * 7/2014 Seo ..... A43B 13/181 36/28
2014/0259789 A1 * 9/2014 Dojan ..... A43B 13/122 36/103
2014/0259801 A1 * 9/2014 Grondin ..... A43B 1/0027 36/30 R
2014/0325871 A1 * 11/2014 Price ..... A43B 13/125 36/28
2015/0223563 A1 * 8/2015 Liebeno ..... A43B 13/16 36/31
2015/0282561 A1 * 10/2015 Swager Van Dok ..... A43B 3/0057 36/31
2016/0021974 A1 * 1/2016 Schindler ..... A43B 13/146 36/103
2016/0037859 A1 * 2/2016 Smith ..... A43B 5/00 36/114
2016/0270475 A1 * 9/2016 Foxen ..... A43B 13/42
2018/0084864 A1 * 3/2018 Takada ..... A43B 13/38
2018/0116336 A1 * 5/2018 Dallas ..... A43B 13/186
2018/0271210 A1 * 9/2018 Tanaka ..... A43B 13/04

* cited by examiner

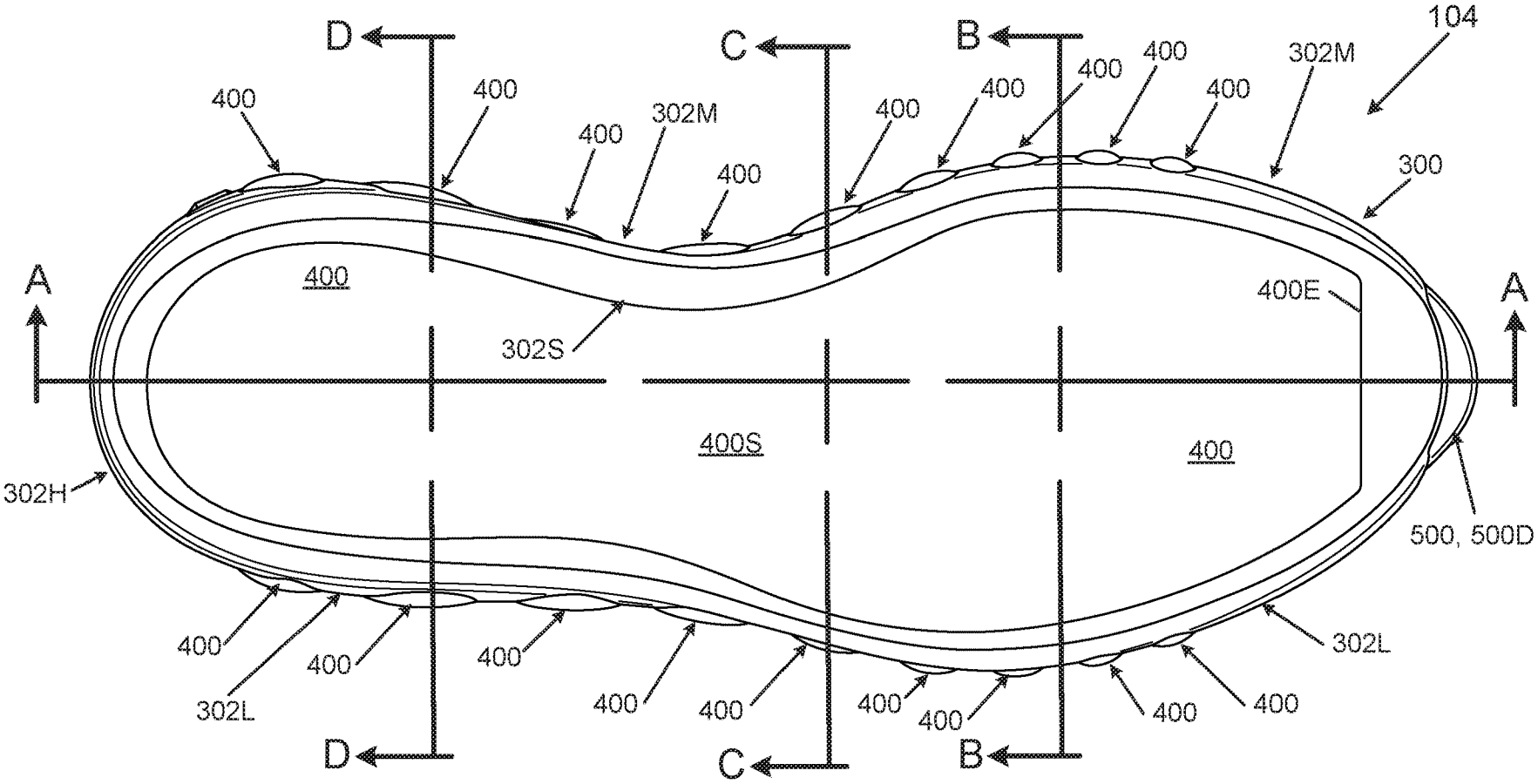
104
300
302M
400
400
400

SECTION A-A

SECTION B-B

SECTION D-D

SECTION C-C

ARTICLES OF FOOTWEAR INCLUDING A MULTI-PART SOLE STRUCTURE

RELATED APPLICATION DATA

This application claims priority to U.S. Provisional Patent Application Ser. No. 62/484,362 filed Apr. 11, 2017 and titled "Articles of Footwear Including a Multi-Part Sole Structure." U.S. Provisional Patent Application Ser. No. 62/484,362 is entirely incorporated herein by reference.

FIELD OF THE INVENTION

The present invention relates to the field of footwear and includes aspects of sole structures and foot supports for articles of footwear.

BACKGROUND

Conventional articles of athletic footwear include two primary elements, namely, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and generally is positioned between the foot and any contact surface. In addition to attenuating ground reaction forces and absorbing energy, the sole structure supports and protects the foot and may provide traction and help control potentially harmful foot motion, such as over pronation.

The upper forms a void on the interior of the footwear for receiving the foot. The void has the general shape of the foot, and access to the void is provided at an ankle opening. Accordingly, the upper may extend over the instep and toe areas of the foot, along the medial and lateral sides of the foot, and around the heel area of the foot. A lacing system often is incorporated into the upper to allow selective changes to the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture and provide a soft, comfortable feel. The midsole, which traditionally is attached to the upper along the entire length of the upper, forms the middle layer of the sole structure and serves a variety of purposes that include controlling foot motions and attenuating impact forces. The outsole forms the ground-contacting element of footwear and is usually fashioned from a durable, wear-resistant material that includes texturing or other features to improve traction.

Terminology/General Information

First, some general terminology and information is provided that will assist in understanding various portions of this specification and the invention(s) as described herein.

As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, running shoes, golf shoes, tennis shoes, baseball cleats, soccer or football cleats, ski boots, basketball shoes, cross training shoes, etc.), and the like.

The terms "forward" or "forward direction" as used herein, unless otherwise noted or clear from the context, mean at, toward, or in a direction toward a forward-most toe area of the footwear structure or component. The terms "rear," "rearward," or "rearward direction" as used herein, unless otherwise noted or clear from the context, mean at, toward, or in a direction toward a rear-most heel area of the footwear structure or component. The terms "lateral" or "lateral side" as used herein, unless otherwise noted or clear from the context, mean the outside or "little toe" side of the footwear structure or component. The terms "medial" or "medial side" as used herein, unless otherwise noted or clear from the context, mean the inside or "big toe" side of the footwear structure or component. The terms "longitudinal" or "longitudinal direction" as used herein, unless otherwise noted or clear from the context, mean in a front-to-back direction or axial direction of an object. For articles of footwear and/or components thereof, the terms "longitudinal" or "longitudinal direction" may refer to a "heel-to-toe" direction of the articles of footwear and/or components thereof. The terms "transverse" or "transverse direction" as used herein, unless otherwise noted or clear from the context, mean in a side-to-side direction or across an object. For articles of footwear and/or components thereof, the terms "transverse" or "transverse direction" may refer to a "lateral side-to-medial side" direction of the articles of footwear and/or components thereof.

In the following description of various example structures in accordance with the invention, reference is made to the accompanying drawings, which form a part hereof, and in which are shown by way of illustration various example foot support structures, components thereof, and articles of footwear in accordance with aspects and examples of the invention. It is to be understood that other specific arrangements of parts and structures may be utilized, and structural and functional modifications may be made without departing from the scope of the present invention. Also, while the terms "top," "bottom," "front," "back," "rear," "side," "underside," "overhead," "over," "under," "vertical," "horizontal," and the like may be used in this specification to describe various example features and elements of the invention, these terms are used herein as a matter of convenience, e.g., based on the example orientations shown in the figures and/or the orientations in typical use (e.g., orientation when incorporated into an article of footwear supported on the bottom of its sole structure on a horizontal support surface).

BRIEF DESCRIPTION OF THE DRAWINGS

The following Detailed Description will be better understood when read in conjunction with the accompanying drawings in which like reference numerals refer to the same or similar elements in all of the various views in which that reference number appears.

FIGS. 2A-2J provide various views of sole structures in accordance with at least some examples of this invention;

Figure 1A:
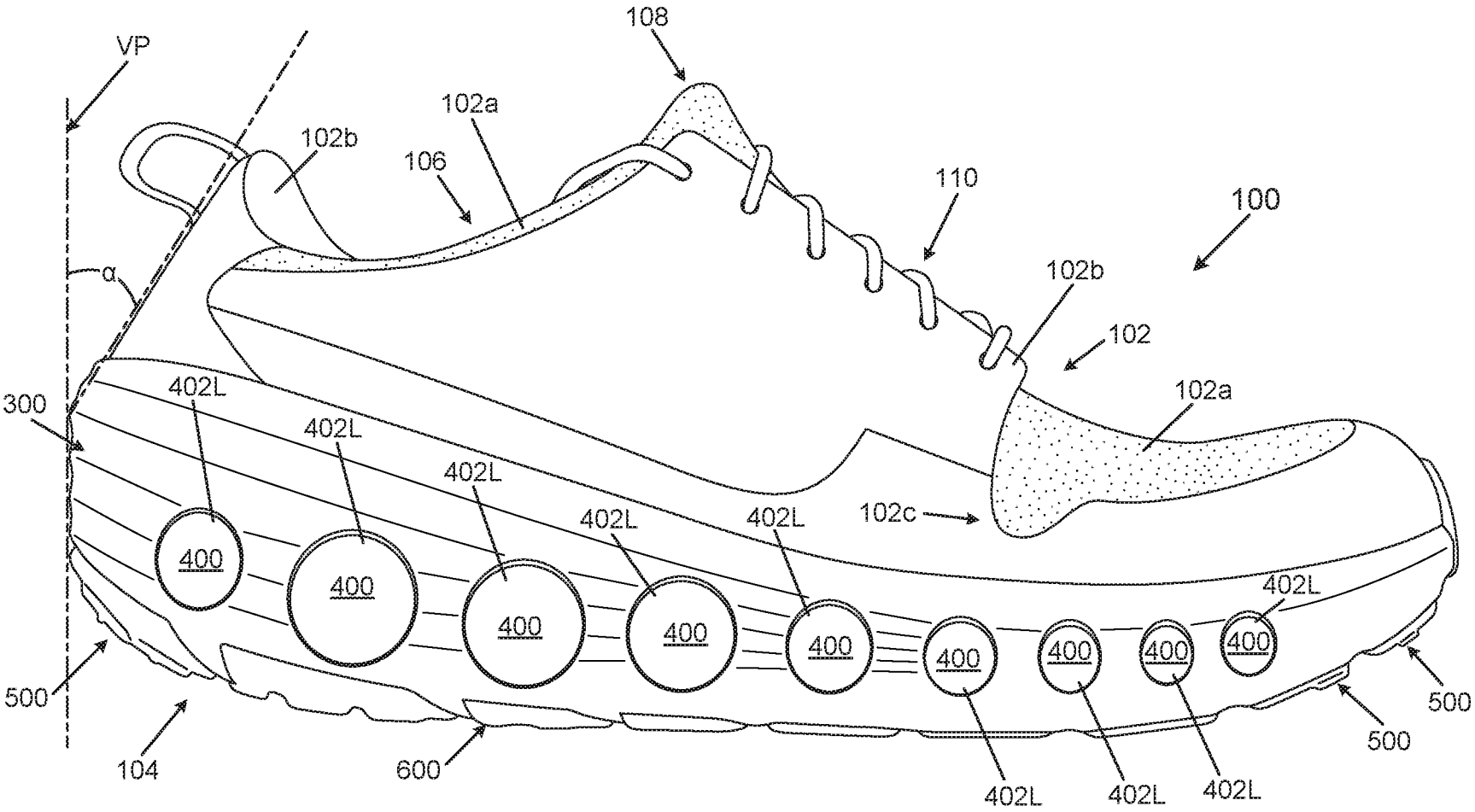
FIGS. 1A-1G provide various views of articles of footwear in accordance with at least some examples of this invention.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. General Description of Aspects of this Invention

Aspects of this invention relate to sole structures and/or articles of footwear that provide structures to promote weight transfer during a step cycle and/or a comfortable feel/ride for the wearer. Such sole structures/articles of footwear may include one or more of: (1) a gradual, continuous, rearward curvature (e.g., radiused curved) from a central heel area to a rear vertical tangent and/or rear end of the sole structure to promote forward roll of the foot from the heel to the toe during a step cycle; (2) a gradual, continuous, forward curvature (e.g., radiused curved) from a midfoot/forefoot location to a forward end and/or vertical tangent of the sole structure to promote forward roll of the foot from the heel to the toe during a step cycle; (3) a deep heel cup formed in a midsole component at a rear heel area (e.g., the high heel sidewalls with respect to a ground surface and/or a heel plantar support surface; (4) a forward extension (e.g., rake) of the rear heel area of the upper component; (5) elasticity/stretchability of the upper in the heel containing region (e.g., to securely hold to the wearer's heel); (6) relatively high "heel-to-toe offset" features; (7) a bowed sole structure from medial side to lateral side; and/or (8) relatively thick heel and/or midfoot regions of the midsole core component.

Some aspects of this invention relate to sole structures and/or articles of footwear that include: (a) a frame including a first sidewall having an outer surface and an inner surface opposite the outer surface, wherein a first opening is defined through the first sidewall extending from the outer surface to the inner surface; and (b) an interior midsole component (e.g., including a foam material, a fluid-filled bladder member, etc.) including a plantar support surface and a second sidewall that extends downwardly from the plantar support surface and along the inner surface of the first sidewall, wherein the interior midsole component further includes a first outwardly extending stem projecting sideways away from a base surface of the second sidewall. This first outwardly extending stem extends into the first opening beyond the inner surface of the first sidewall toward the outer surface of the first sidewall and has at least one feature selected from the group consisting of: (a) the first outwardly extending stem extends into the first opening beyond the inner surface of the first sidewall at least to a location at or adjacent the outer surface of the first sidewall; (b) the first outwardly extending stem has an exterior surface that is complementary shaped with respect to an interior surface of the first opening over at least 25% of an axial length of the first opening; or (c) a free end of the first outwardly extending stem extends outward beyond an outermost extent of the first opening. The frame may include any desired number of such openings in its sidewall(s), and the interior midsole component may include any desired number of such outwardly extending stems to extend into such openings, e.g., including one or more openings in one or more of a medial heel region, a lateral heel region, a medial midfoot region, a lateral midfoot region, a medial forefoot region, a lateral forefoot region, a forward toe region, a heel region, etc. When multiple openings are present, one or more may be provided on the lateral side, one or more may be provided on the medial side, one or more may be provided in the heel region, and/or one or more may be provided in the toe region. The openings also may take on a wide variety of shapes, sizes, cross sectional areas, spacings, relative locations, etc.

In some examples of this invention, the frame (or at least a first sidewall of the frame) may be formed of a first polymer foam material (e.g., having an outer surface formed of the first polymer foam material and an inner surface formed of the first polymer foam material opposite the outer surface). The interior midsole component may be formed of a second polymer foam material that may be the same as or different from the first polymer foam material. When made from a different polymer foam material, the first polymer foam material of the frame may have a higher density than that of the second polymer foam material of the interior midsole component.

Sole structures in accordance with at least some examples and aspects of this invention may include: (a) a medial sidewall region located on a medial side of the sole structure, wherein the medial sidewall region includes a medial outer surface and a medial inner surface, and wherein a first medial opening is defined through the medial sidewall region extending from the medial outer surface to the medial inner surface; (b) a lateral sidewall region located on a lateral side of the sole structure, wherein the lateral sidewall region includes a lateral outer surface and a lateral inner surface, and wherein a first lateral opening is defined through the lateral sidewall region extending from the lateral outer surface to the lateral inner surface; (c) a medial interior midsole sidewall that includes an outwardly extending medial stem projecting sideways away from a base surface of the medial interior midsole sidewall, wherein the outwardly extending medial stem extends into the first medial opening beyond the medial inner surface of the medial sidewall region and has at least one feature selected from the group consisting of:

(1) the outwardly extending medial stem extends into the first medial opening beyond the medial inner surface of the medial sidewall region at least to a location at or adjacent the medial outer surface of the medial sidewall region;

(2) the outwardly extending medial stem has an exterior surface that is complementary shaped with respect to an interior surface of the first medial opening over at least 25% of an axial length of the first medial opening; or (3) a free end of the outwardly extending medial stem extends outward beyond an outermost extent of the first medial opening; and (d) a lateral interior midsole sidewall that includes an outwardly extending lateral stem projecting sideways away from a base surface of the lateral interior midsole sidewall, wherein the outwardly extending lateral stem extends into the first lateral opening beyond the lateral inner surface of the lateral sidewall region and has at least one feature selected from the group consisting of:

(1) the outwardly extending lateral stem extends into the lateral opening beyond the lateral inner surface of the lateral sidewall region at least to a location at or adjacent the lateral outer surface of the lateral sidewall region;

(2) the outwardly extending lateral stem has an exterior surface that is complementary shaped with respect to an interior surface of the first lateral opening over at least 25% of an axial length of the first lateral opening; or (3) a free end of the outwardly extending lateral stem extends outward beyond an outermost extent of the first lateral opening.

If desired, the medial sidewall region and the lateral sidewall region may be integrally formed as parts of a unitary, one-piece frame and/or a base support surface may connect the medial sidewall region and the lateral sidewall region. Alternatively, if desired, the medial sidewall region may be formed as a portion of a first frame component and the lateral sidewall region may be formed as a portion of a second frame component that is a separate part from the first frame component.

Additionally or alternatively, if desired, the medial interior midsole sidewall and the lateral interior midsole sidewall may be integrally formed as parts of a unitary, one-piece midsole component construction (optionally made of a foam material). A plantar support surface may connect the medial interior midsole sidewall and the lateral interior midsole sidewall. Alternatively, if desired, the medial interior midsole sidewall may be formed as a portion of a first interior midsole component and the lateral interior midsole sidewall may be formed as a portion of a second interior midsole component that is a separate part from the first interior midsole component.

In some examples of this invention, the medial sidewall region of the frame may include from 1 to 15 openings, the lateral sidewall region of the frame may include from 1 to 15 openings, the medial interior midsole sidewall may include from 1 to 15 outwardly extending stems to engage the medial openings, and the lateral interior midsole sidewall may include from 1 to 15 outwardly extending stems to engage the lateral openings. In some examples, from 2 to 12 openings and corresponding stems may be provided on either or both sides, or from 3 to 10 openings and corresponding stems may be provided on either or both sides. The illustrated sole structures of FIGS. 1A-4J include 9 openings and stems on each side and the illustrated sole structure of FIGS. 9A-9K includes 7 openings and stems on each side, although other arrangements and options are possible.

Additional aspects of this invention relate to articles of footwear, comprising: an upper; and a sole structure engaged with the upper, wherein the sole structure may have any of the features and/or combination of features described above and/or described in more detail below. In some such footwear structures, a rear heel region of the upper may extend forward from a rearmost heel region of the frame toward a forefoot region of the article of footwear, and a rearmost heel surface of the rear heel region of the upper may has a concave curvature moving in a direction from the frame toward a top edge of the rear heel region of the upper (although a flat structure or a convex curvature could be provided in some examples, if desired). In some example upper structures, with the article of footwear supported on its sole structure on a horizontal support surface, the rear heel region of the upper may extend forward (optionally with a concave curvature) from the rearmost heel region of the frame toward the forefoot region of the article of footwear at an angle of at least 20° from a vertical plane (and in some examples of this invention, at least 10°, at least 15°, or even at least 25°).

II. Detailed Description of Specific Examples of this Invention

Figure 1B:
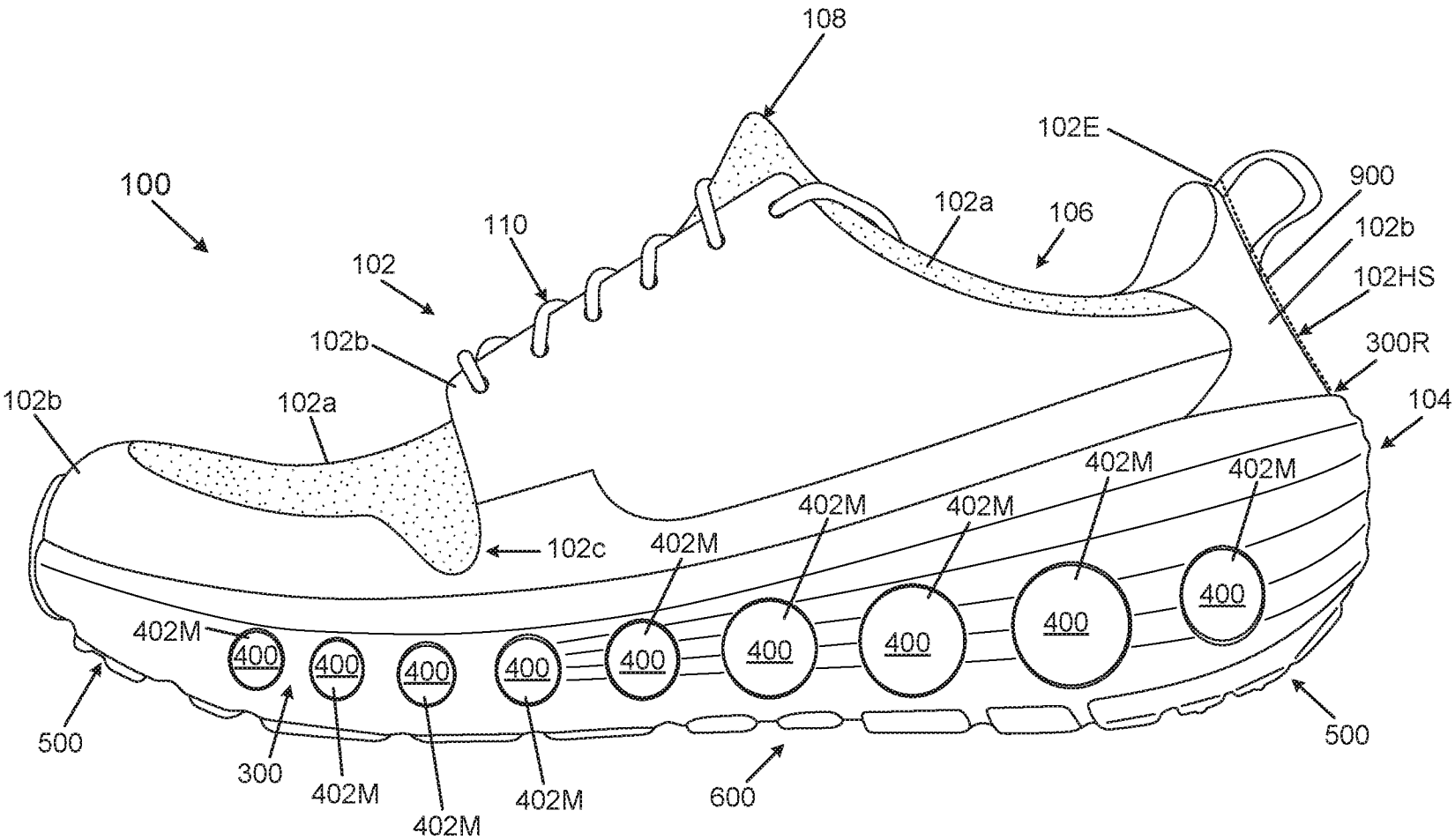
Figure 1D:
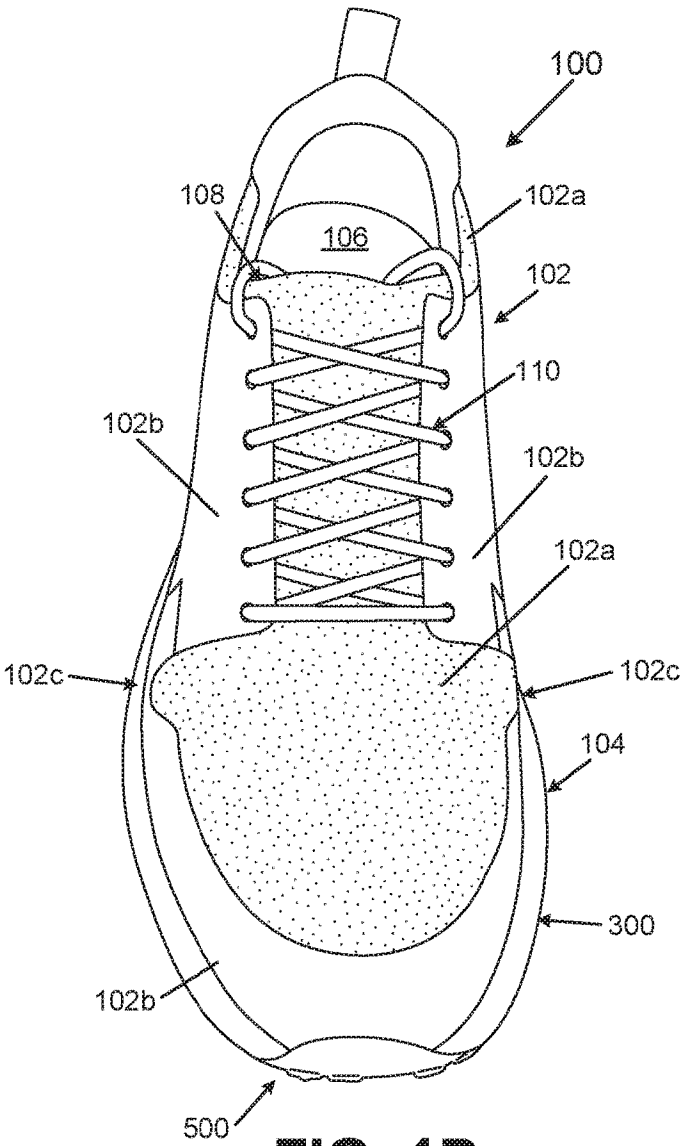
Figure 1C:
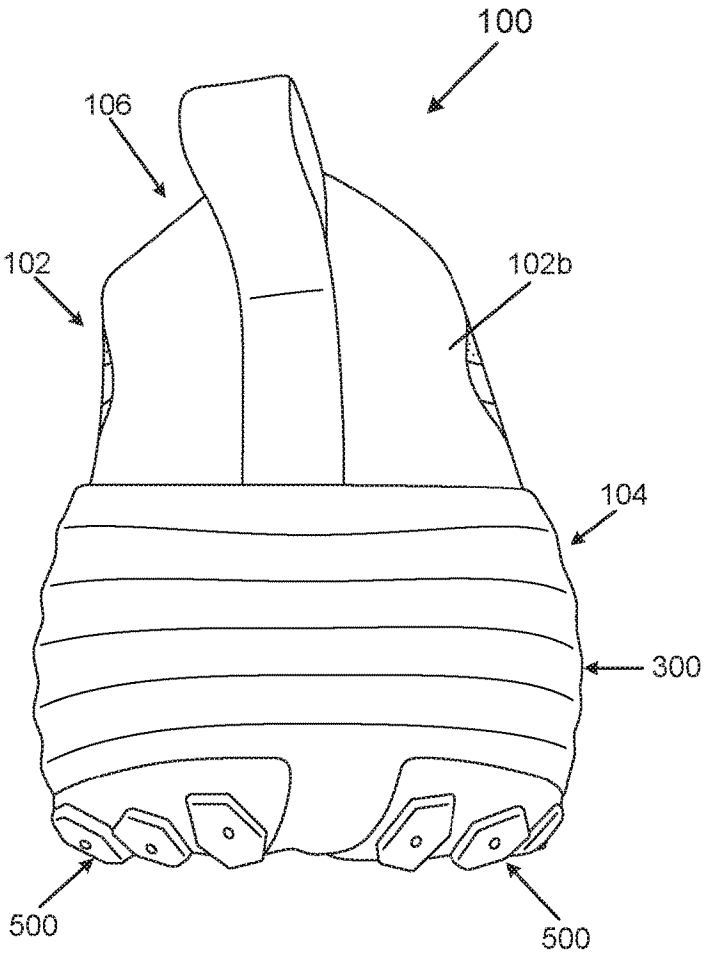
Figure 1E:
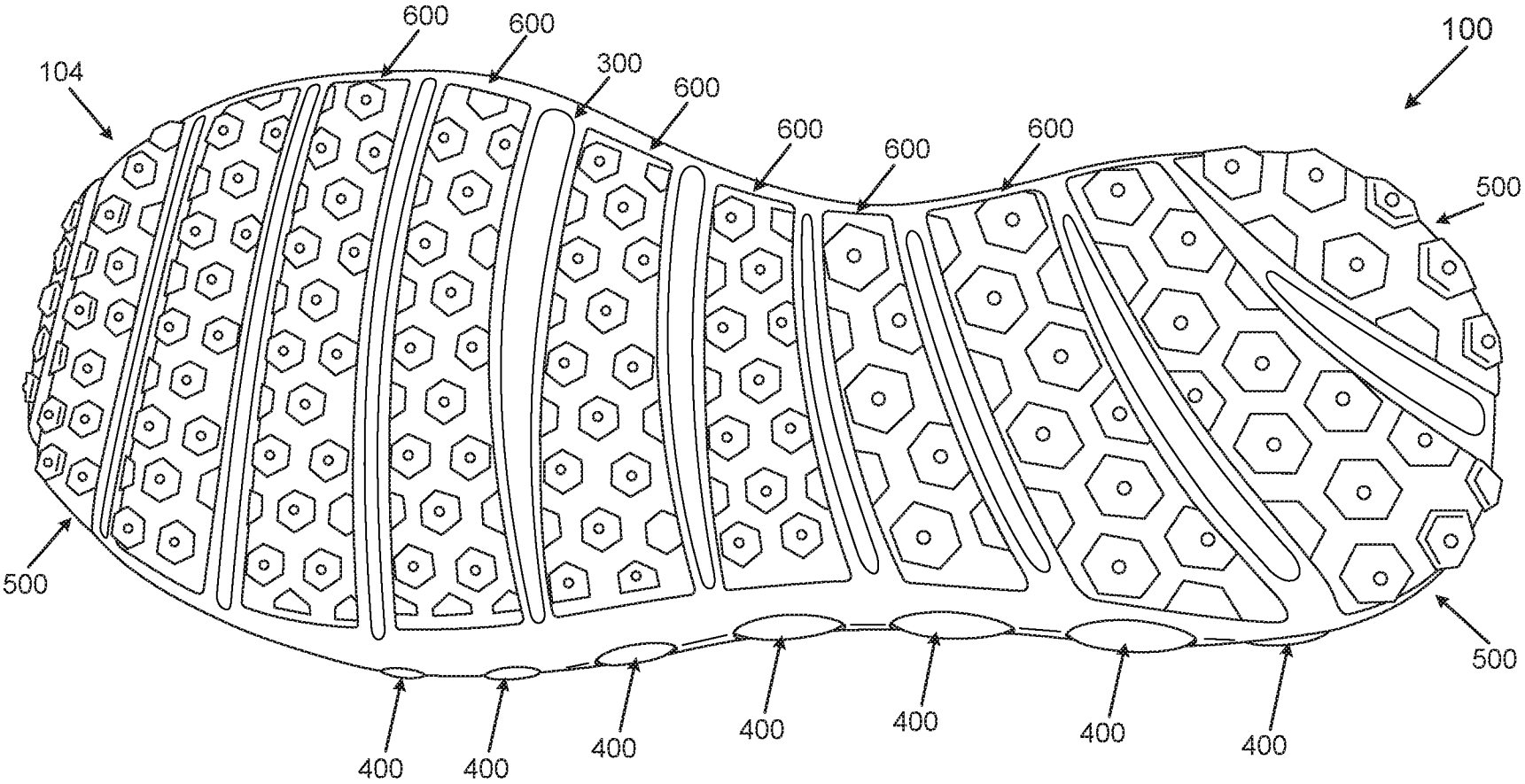
Figure 1F:
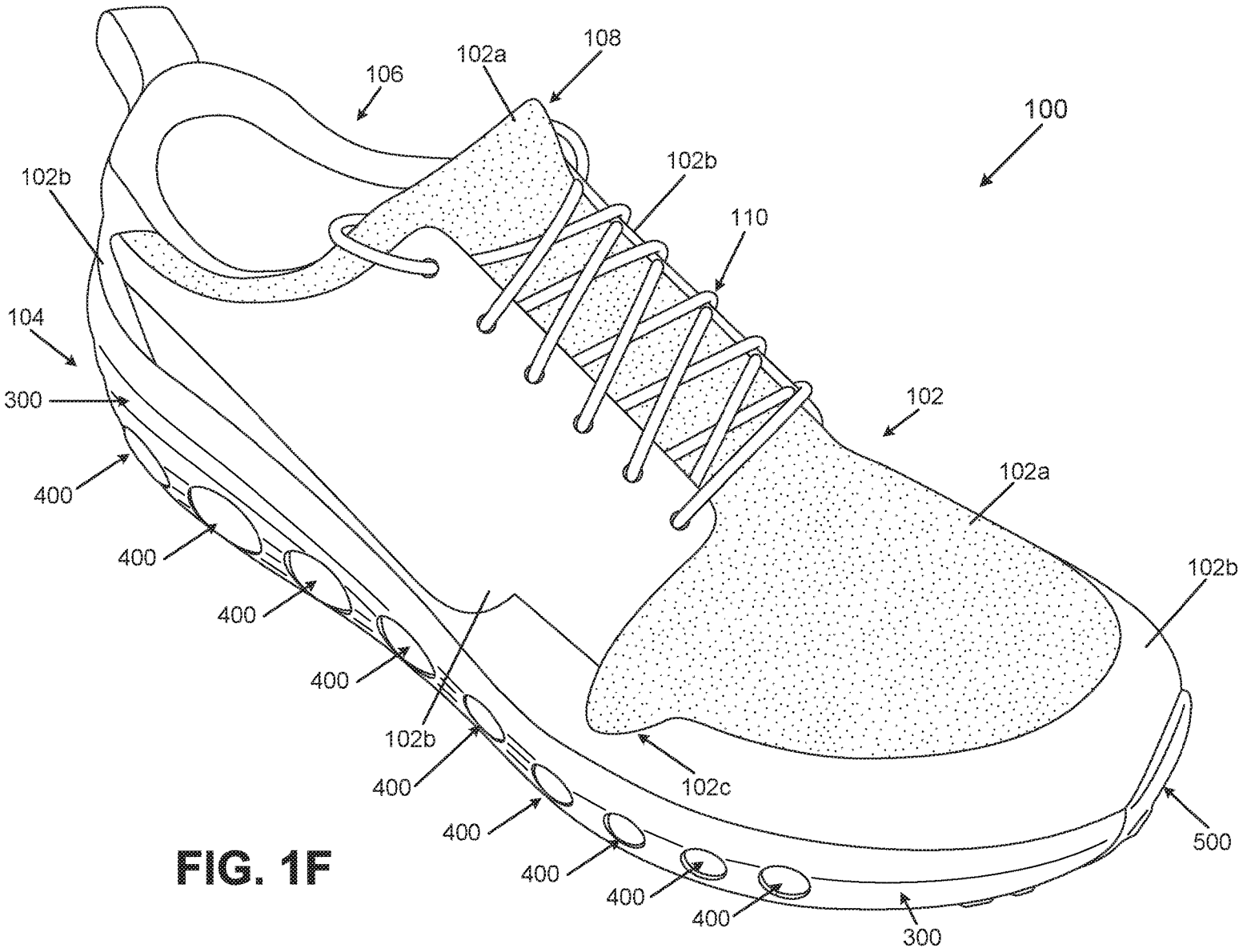
Figure 1G:
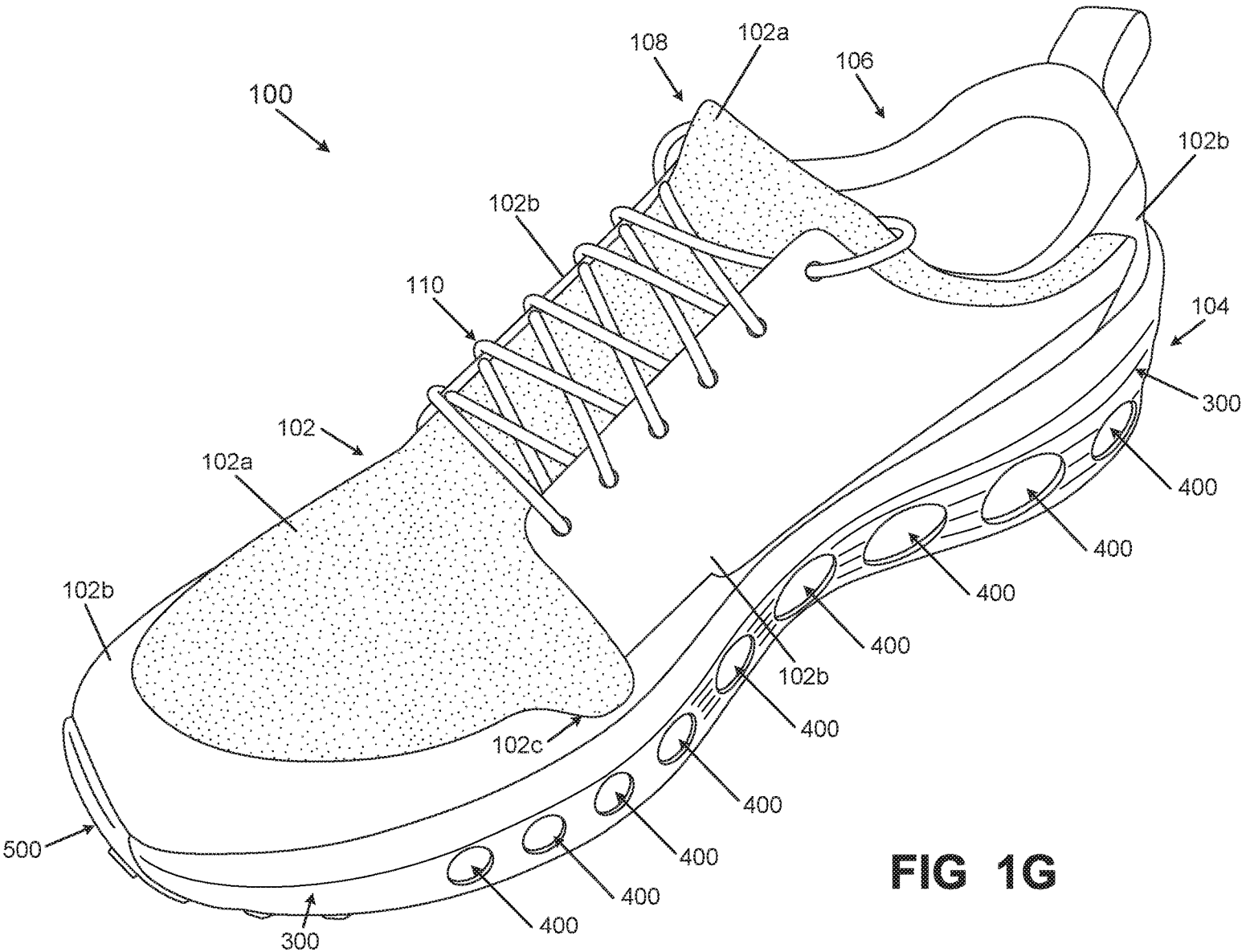

FIGS. 1A through 1G provide various views of an example article of footwear 100 in accordance with at least some examples of this invention. More specifically, FIG. 1A provides a lateral side view; FIG. 1B provides a medial side view; FIG. 1C provides a rear/heel view; FIG. 1D provides a top view; FIG. 1E provides a bottom view; FIG. 1F provides a top/lateral side perspective view; and FIG. 1G provides a top/medial side perspective view. The article of footwear 100 includes an upper 102 and a sole structure 104 engaged with the upper 102. The upper 102 and sole structure 104 may be engaged together in any desired manner, including in manners conventionally known and used in the footwear arts (such as by one or more of adhesives or cements, stitching or sewing, mechanical connectors, etc.).

The upper 102 of this example includes a foot-receiving opening 106 that provides access to an interior chamber into which the wearer's foot is inserted. The upper 102 further may include a tongue member 108 located across the foot instep area and positioned to moderate the feel of the closure system 110 on the wearer's foot (the closure system 110 in this illustrated example constitutes a lace type closure system). As shown in the specific examples of FIGS. 1A-1G, however, rather than including a separate tongue component, this example upper 102 is formed as a unitary construction with an instep covering component or portion **102*a* of the upper 102 and the portions of the upper 102 forming the medial side area and the lateral side area of the upper 102. In this manner, as shown in the figures, the upper 102 has somewhat of a sock-like foot-receiving opening 106** and/or a sock-like overall appearance.

The upper 102 may be made from any desired materials and/or in any desired constructions and/or manners without departing from this invention. As some more specific examples, at least a portion of the upper 102 (and optionally a majority, substantially all, or even all of the upper 102) may be formed as a woven textile component and/or as a knitted textile component. The textile components for upper 102, including portion **102*a***, may have structures and/or constructions like those used in footwear products commercially available from NIKE, Inc. of Beaverton, Oreg.

Additionally or alternatively, if desired, the upper 102 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers and articles of footwear in accordance with this invention may include foot securing and engaging structures of the types used in footwear products commercially available from NIKE, Inc. of Beaverton, Oreg. These types of wrap-around and/or adaptive or dynamic fit structures may at least partially wrap around and securely hold the wearer's foot.

As yet another option or alternative, if desired, uppers 102 and articles of footwear 100 in accordance with at least some examples of this invention may include fused layers of upper materials, e.g., uppers of the types that include upper materials bonded by hot melt or other adhesive materials, such as in footwear products commercially available from NIKE, Inc. of Beaverton, Oreg. As still additional examples, uppers of the types described in U.S. Pat. Nos. 7,347,011 and/or 8,429,835 may be used without departing from this invention (each of U.S. Pat. Nos. 7,347,011 and 8,429,835 is entirely incorporated herein by reference).

In this illustrated example, the upper 102 includes a base member 102*a* (e.g., made from a woven or knit textile material, optionally as a "sock-like" construction) that is partially covered with an outer shell member 102*b*, which in this illustrated example forms an exterior component for engaging the closure system 110 (e.g., includes lace eyelets). Components 102*a* and 102*b* may be fixed together, if desired, by one or more of fusing techniques (e.g., hot melt adhesives), sewing, mechanical connectors, etc. The base member 102*a* of this example extends continuously to cover the instep area of the wearer's foot, provides the tongue member 108, and extends around at least a majority of the wearer's foot at the foot-receiving opening 106. The outer shell member 102*b* may be made from a more durable and/or less stretchable material than the base member 102*a*, e.g., to provide durability, wear resistance, and support, such as a textile material, a polymer material (e.g., a TPU, etc.), a leather material (e.g., synthetic or natural leather), etc. The outer shell member 102*b* may be made from one or more parts, and in this illustrated example extends to cover a forward toe area, the midfoot sides (at both the lateral and medial sides of the upper 102) and the rear heel area. At the rear heel area, the outer shell member 102*b* may have a relatively elastic, flexible, or conformable configuration, e.g., to help keep the wearer's heel in the heel region of the shoe 100. As shown in FIGS. 1A, 1B, and 1D, the forefoot area of the outer shell member 102*b* includes notches 102*c* generally at the forefoot flex joint areas of the upper 102 (e.g., at the metatarsal phalangeal joint areas), to help provide/improve/increase flexibility of the forefoot area of the upper 102.

Additionally, as shown in FIGS. 1A and 1B, in this illustrated example upper 102, the outer shell member 102*b* at the rear heel area extends (or rakes) forward and away from a rearmost heel point of the sole structure 104 (and toward the toe region of the footwear 100). This feature helps the upper 102 fit snuggly around the wearer's ankle and helps lock the foot into the deep cup (e.g., akin to a heel counter) formed by the rear heel region wall of the sole member 104 (and specifically, the rear heel wall 302H of the frame 300, as will be described in more detail below). In this illustrated example, as shown in FIG. 1A, with the article of footwear 100 supported on a horizontal support surface in an unloaded condition, at the rear heel region, the outer shell member 102*b* extends forward at an angle $\alpha$ within a range of at least 20° from a vertical plane VP, and in some examples at an angle of at least 25°, at least 30°, at least 35°, at least 40°, or even at least 45°. Additionally or alternatively, as shown in FIG. 1B, a rear heel region of the upper 102 (e.g., component 102*b*) may extend forward from a rearmost heel region 300R of the frame 300 toward a forefoot region of the article of footwear 100. As some more specific examples, a rearmost heel surface 102HS of the rear heel region of the upper 102 may have a flat surface or a concave curvature moving in a direction from the frame 300 (e.g., its rearmost heel region 300R) toward a top edge 102E of the rear heel region of the upper 102. The potential shape of this concave curvature of surface 102HS is highlighted by broken line 900 in FIG. 1B. This concave curvature, when present, can help hold the upper 102 with the wearer's foot. In other upper structures, however, a more convex shaped rearmost heel surface 102HS could be used, if desired. The upper 102 (e.g., the outer shell member 102*b*) may be made from a stretchable material in order to comfortably receive the wearer's heel and help position and hold the heel in the heel cup of the sole member 104.

Figure 2B:
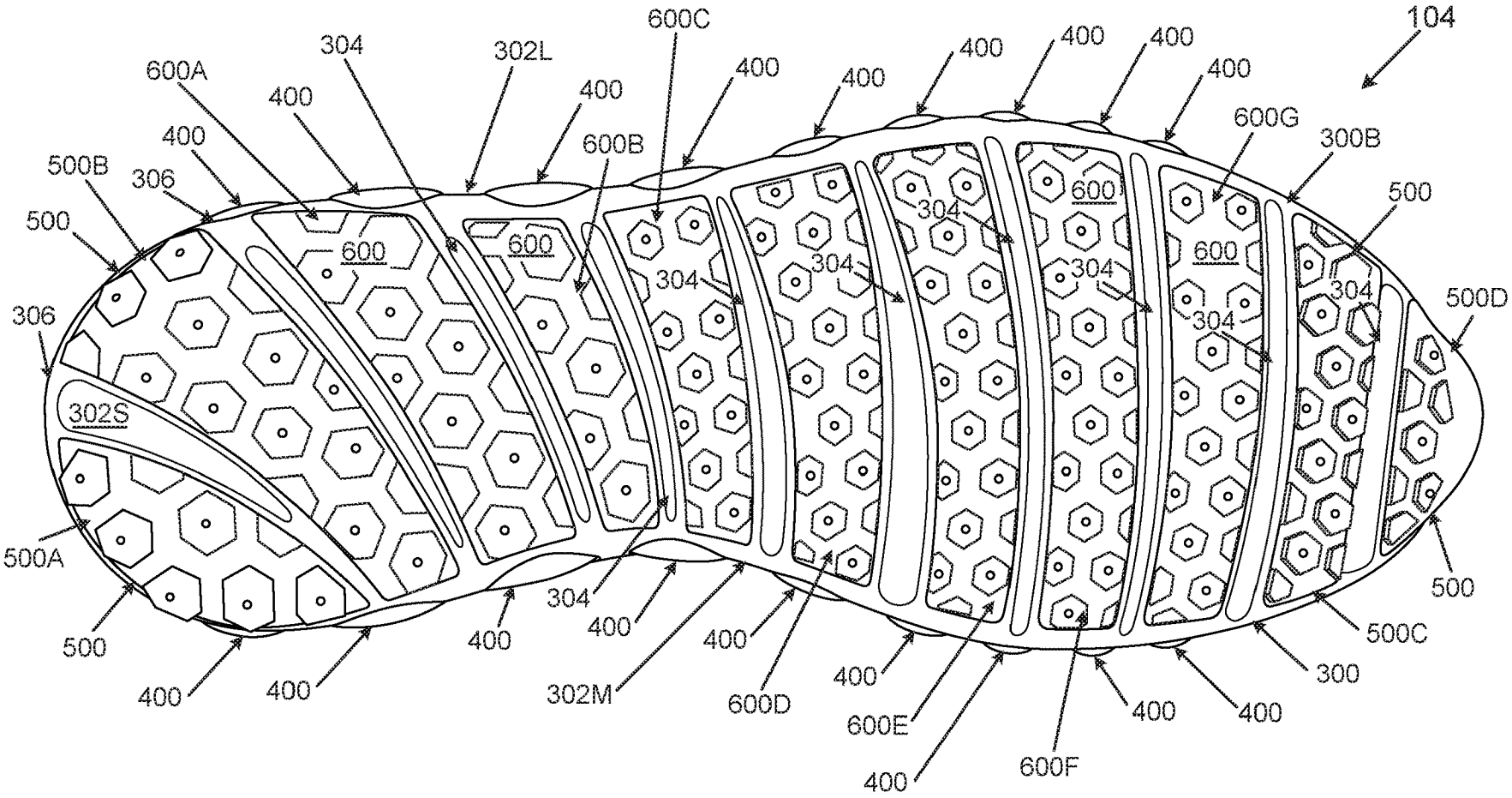
Figure 2C:
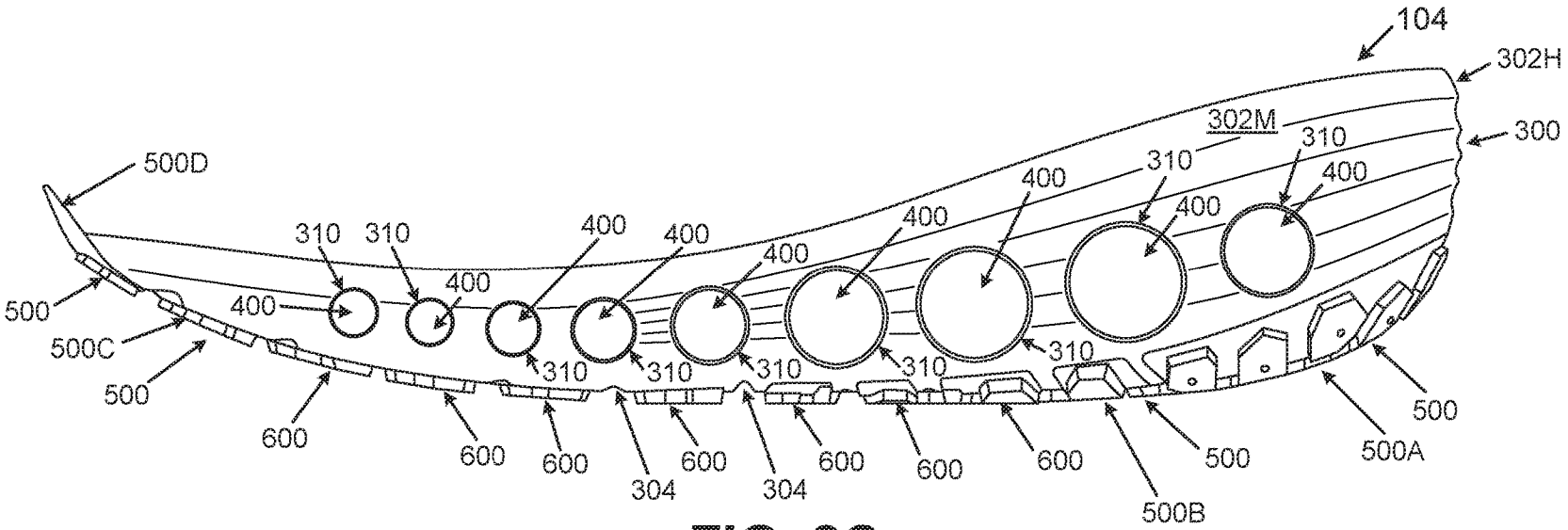
Figure 2D:
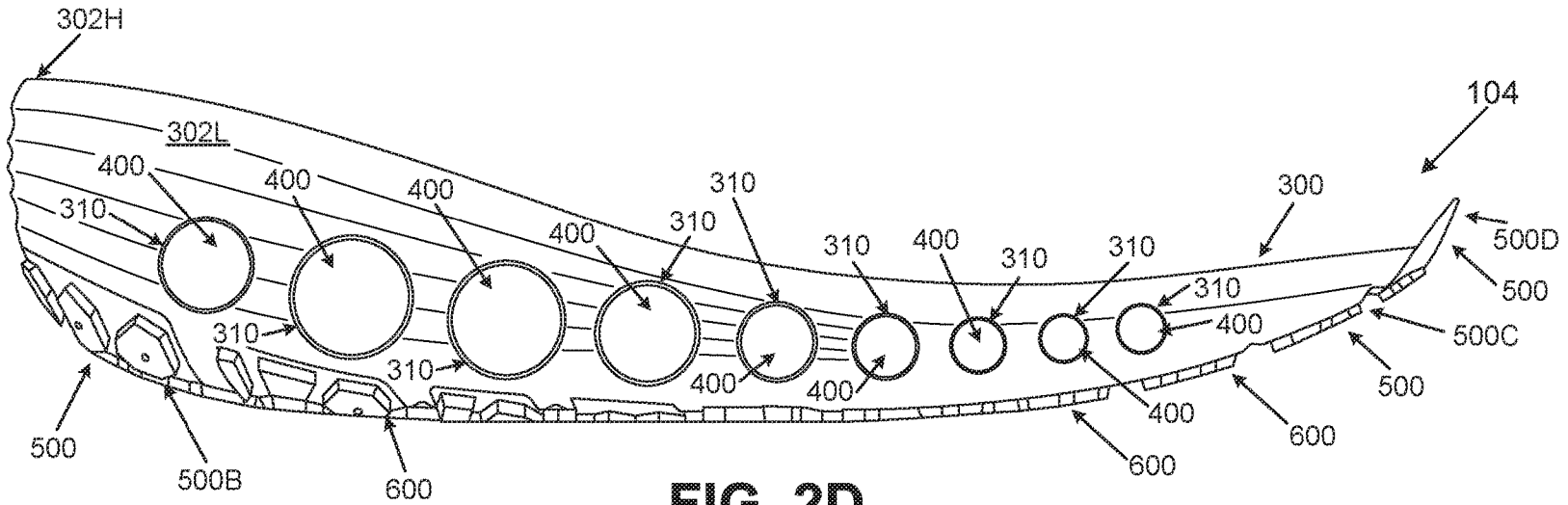
Figure 2F:
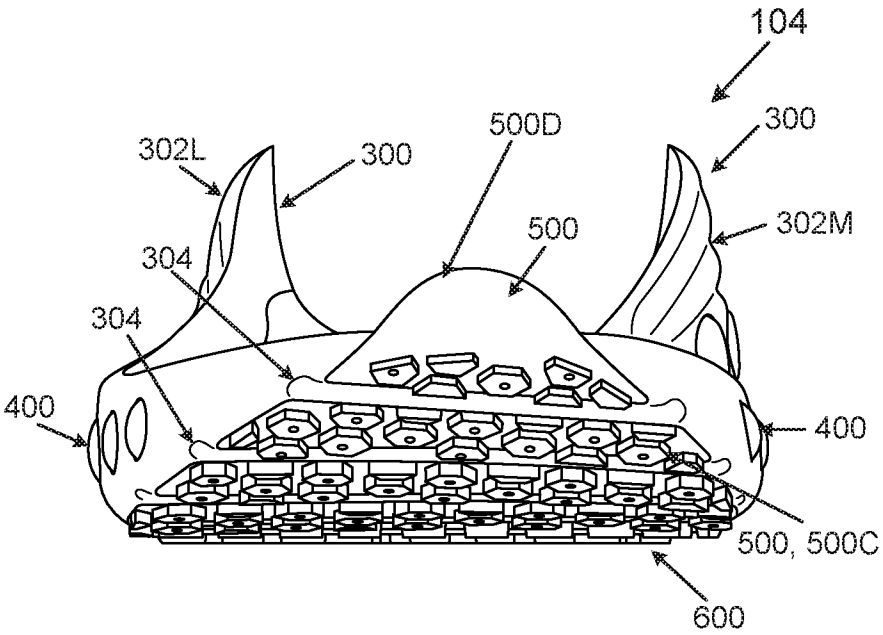
Figure 2E:
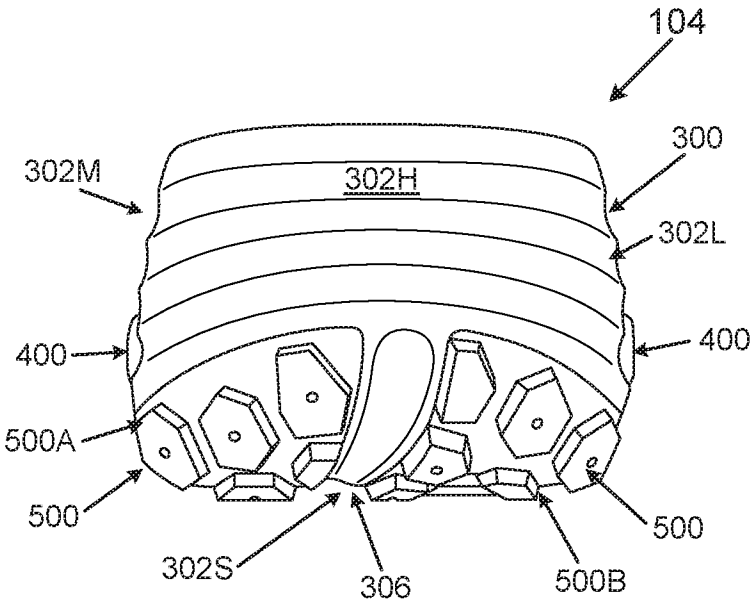
Figure 2G:
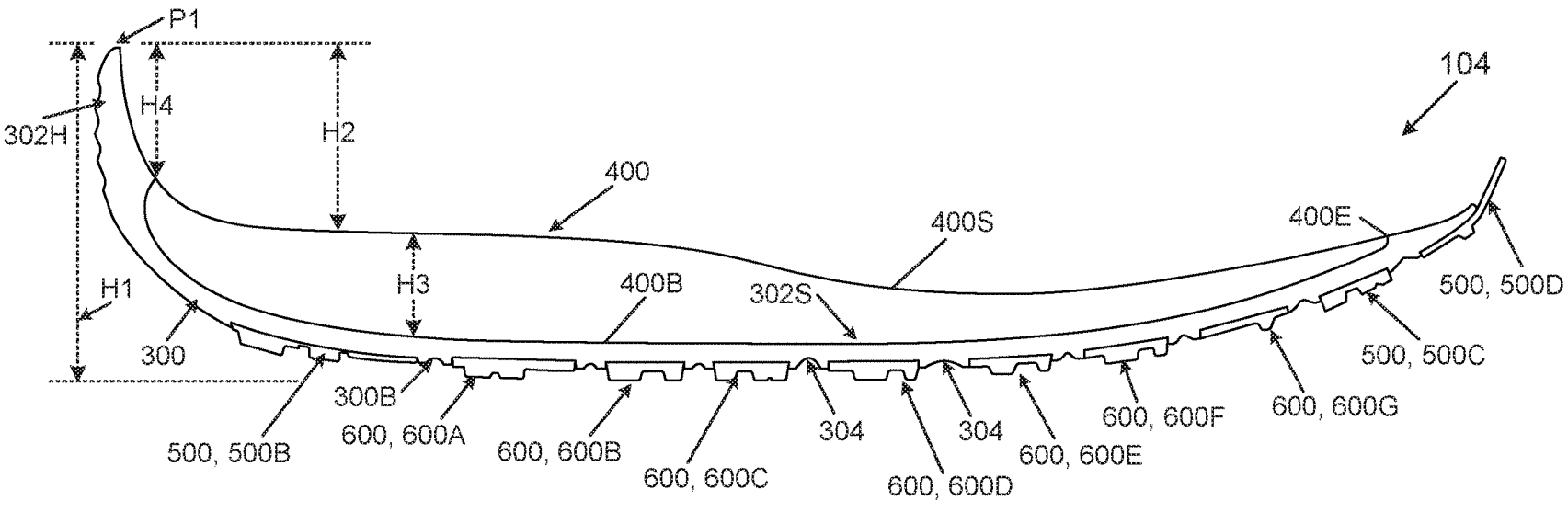
Figure 2H:
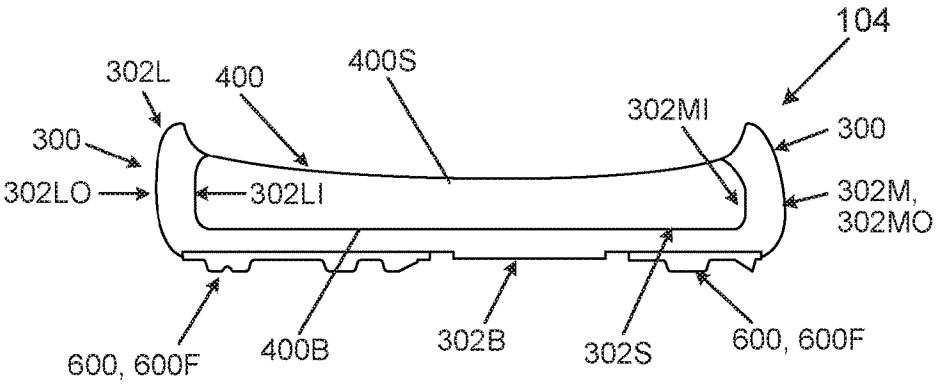
Figure 2J:
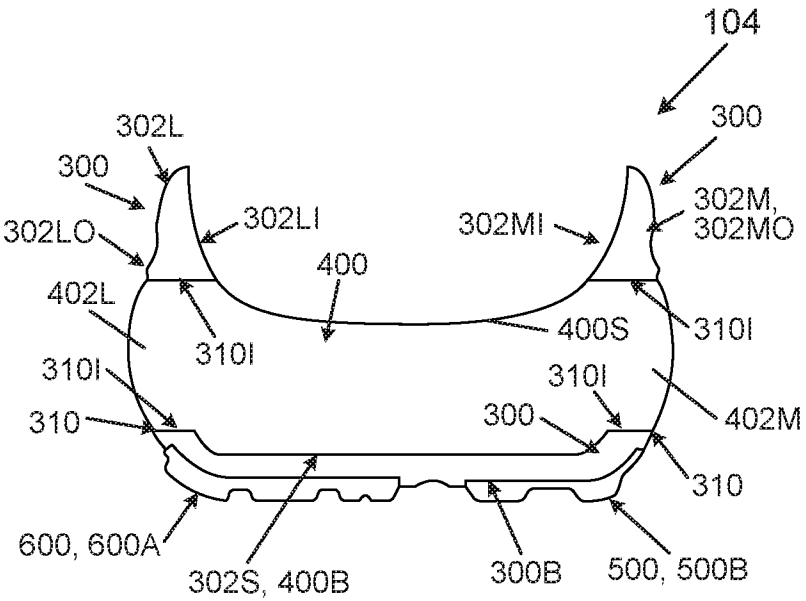
Figure 2I:
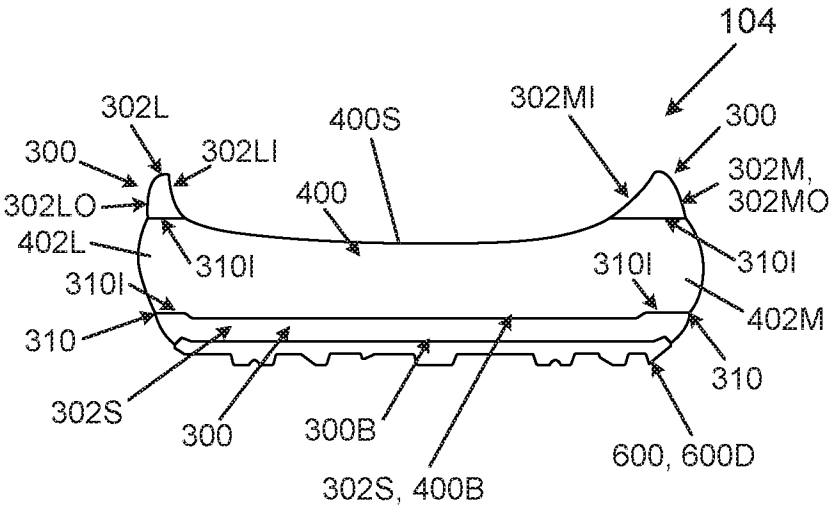
Figure 3A:
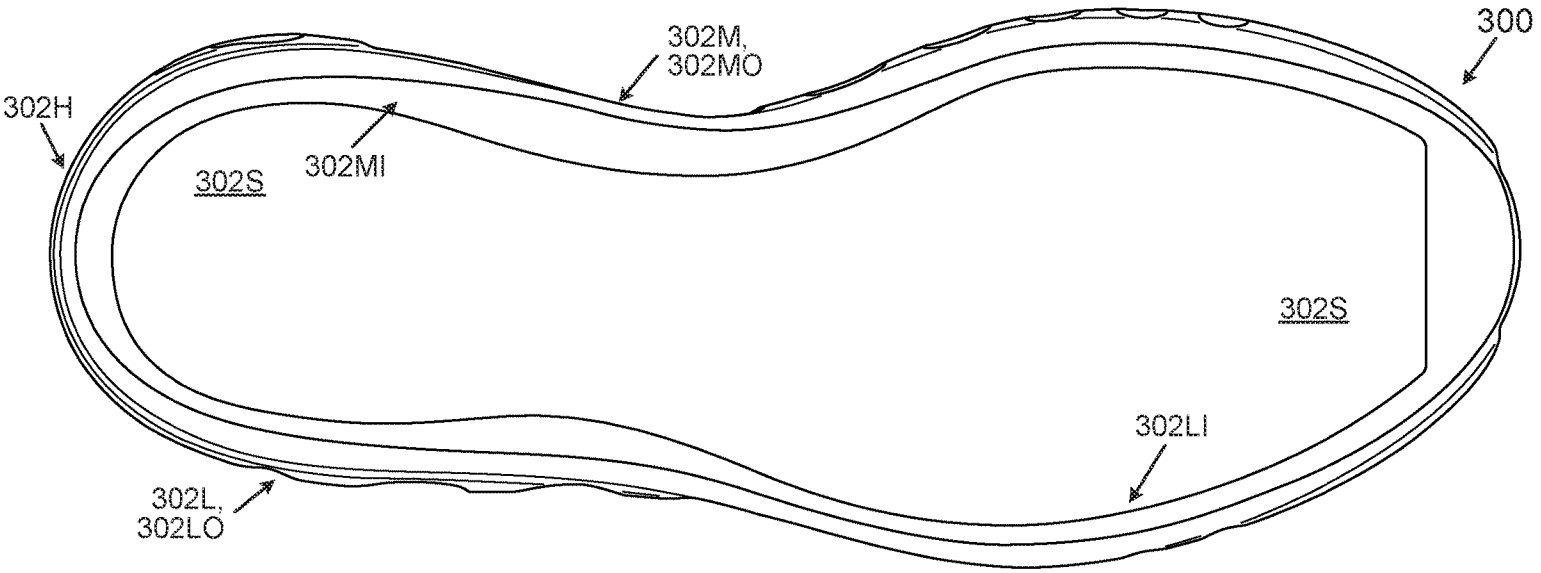
FIGS. 3A-3D provide various views of example frames (or cages) for sole structures in accordance with at least some examples of this invention.
Figure 3B:
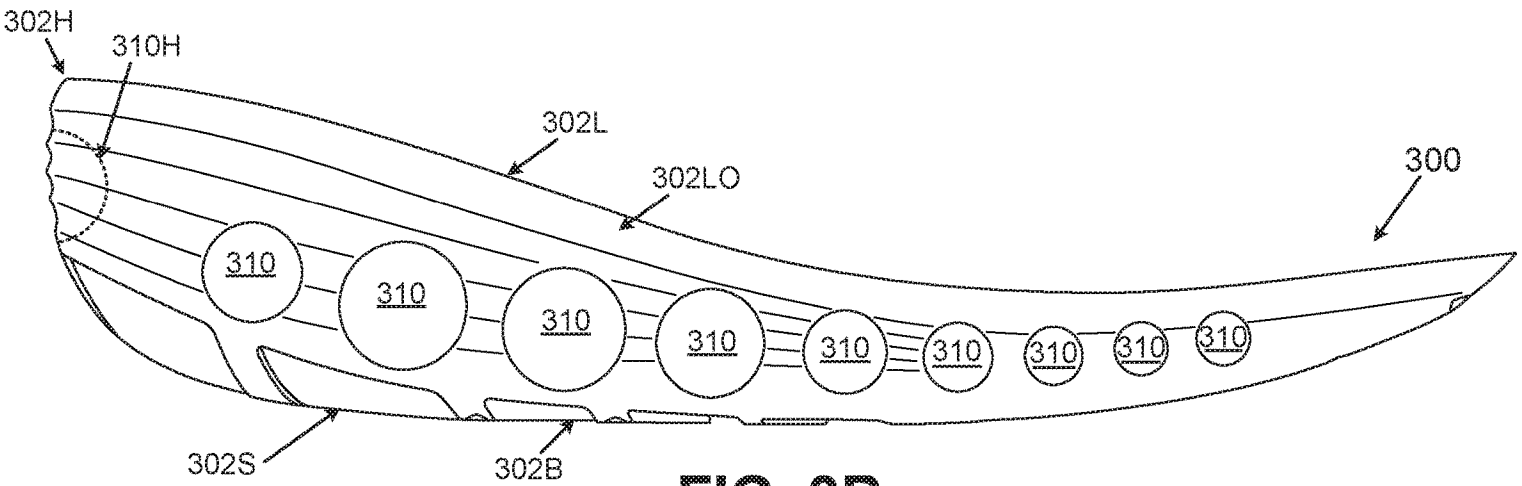
Figure 3C:
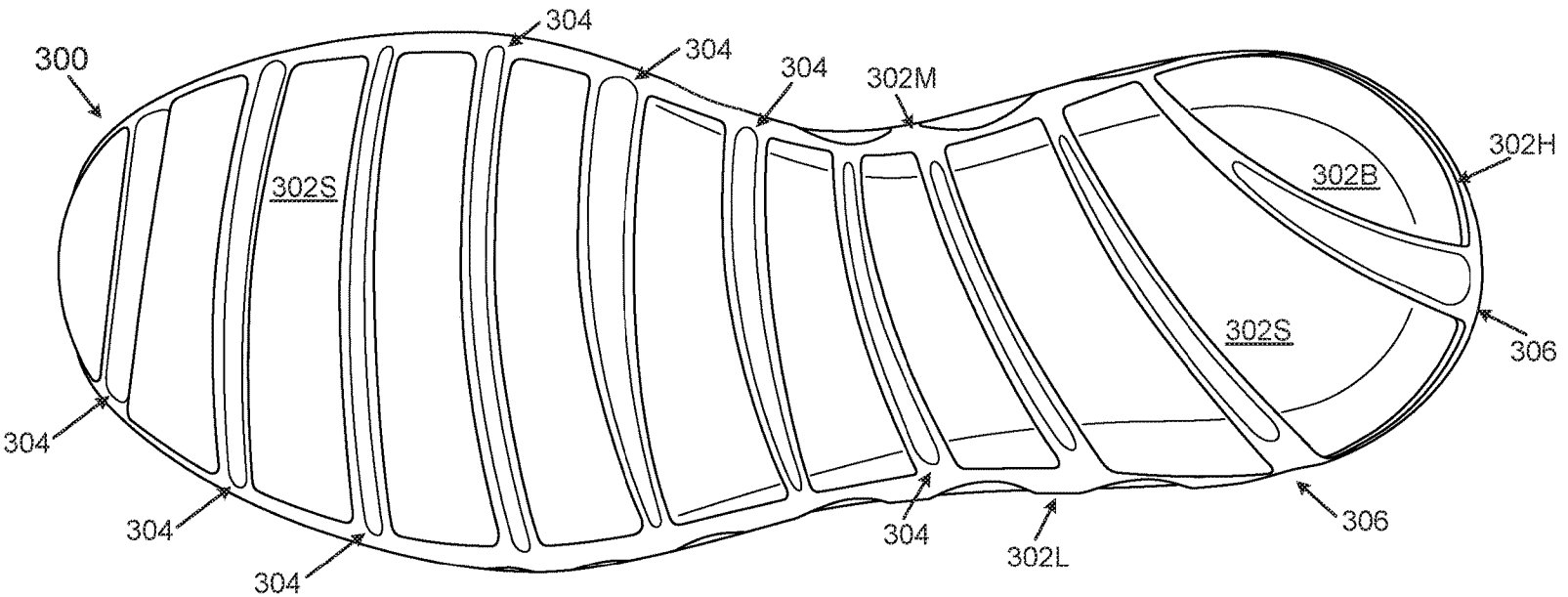
Figure 3D:
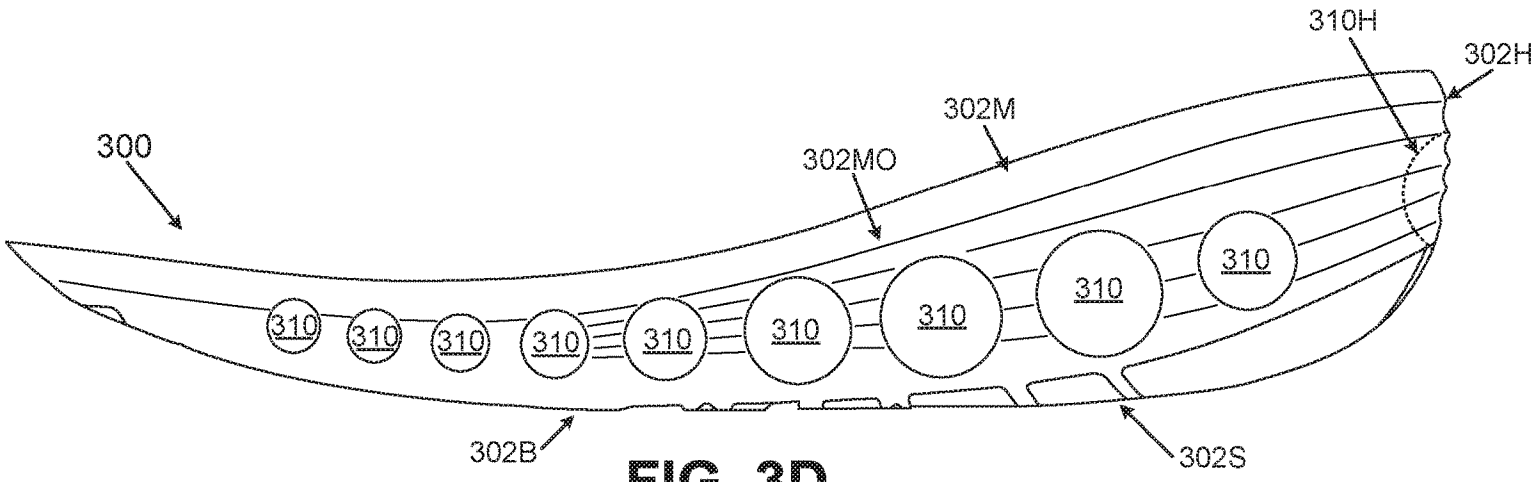

The sole structure 104 of this illustrated example, as well as sole structures in accordance with at least some aspects of this invention, now will be described in more detail in conjunction with FIGS. 1A-2J. In these figures, FIG. 2A includes a top view of an example sole structure 104 in accordance with at least some examples of this invention; FIG. 2B includes a bottom view; FIG. 2C includes a medial side view; FIG. 2D includes a lateral side view; FIG. 2E includes a rear/heel view; FIG. 2F includes a front/toe view; FIG. 2G provides a longitudinal vertical cross sectional view along line A-A in FIG. 2A; FIG. 2H provides a transverse vertical cross sectional view along line B-B in FIG. 2A; FIG. 2I provides a transverse vertical cross sectional view along line C-C in FIG. 2A; and FIG. 2J provides a transverse vertical cross sectional view along line D-D in FIG. 2A.

While other configurations, parts, and/or combinations of parts are possible, in this illustrated example, the sole structure 104 comprises four main components (although some components may have multiple independent parts). One component of the sole structure 104 is an outer frame 300, which also is individually illustrated in FIGS. 3A-3D. The frame 300 may at least in part form a receptacle that houses (and protects) an inner midsole core component 400, which also is individually illustrated in FIGS. 4A-4D. The sole structure 104 further includes: (a) a set of "high wear" outsole component parts 500 for high wear areas (e.g., at the medial heel and forefoot areas, as also shown in FIGS. 5A-5D) and (b) a set of other lightweight, but wear resistant, outsole component parts 600 for lower wear areas (e.g., through the midfoot and surrounding areas of the sole member 104, as also shown in FIGS. 6A-6D). Features of the sole member 104 component parts 300, 400, 500, and 600 will be described in more detail below.

FIGS. 2A-2J and 3A-3D illustrate various features of a midsole frame 300 in accordance with at least some examples of this invention. This frame 300 also may be conceptually considered as a cage or carrier, e.g., for holding another component, such as core component 400. In this illustrated example sole structure 104, the frame 300 forms a base of the footwear 100 midsole structure, and it may be formed from a polymer foam material, such as a relatively dense and/or durable ethylvinylacetate foam, e.g., of the types conventionally known and used in the footwear arts (such as injection Phylon, a combination of Phylon and rubber, PHYLITE® (outsole and midsole components from NIKE, Inc. of Beaverton, Oreg.), etc.). This frame 300 also may be formed by conventional techniques as are known and used in the art, such as compression molding, injection molding, etc.

This frame 300, as also shown in FIGS. 3A-3D, includes a medial sidewall 302M located on a medial side of the sole structure 104 and a lateral sidewall 302L located on a lateral side of the sole structure 104. In this illustrated example, the medial side wall 302M and the lateral sidewall 302L extend an entire length of the sole structure 104, from a rearmost heel location to a forwardmost toe location. Alternatively, if desired, the medial side wall 302M and/or the lateral sidewall 302L may extend less than an entire length of the sole structure 104 (e.g., and may be provided in one or more of: a forefoot area, a midfoot area, a heel area, etc.) and/or may be discontinuous (e.g., having one or more gaps along length). In this illustrated example, the frame 300 further includes a rear heel wall 302H that extends around a rear heel area of the sole structure 104 and connects the medial side wall 302M and the lateral side wall 302L.

The frame 300 of this example further includes a bottom base support surface 302S that interconnects the medial side wall 302M and the lateral side wall 302L across the bottom. In this illustrated example, the bottom base support surface 302S extends completely from the rearmost heel area to the forward most toe area of the sole structure 104 and also completely from the lateral side edge and lateral sidewall 302L to the medial side edge and medial sidewall 302M of the sole structure 104 to provide a complete support for the plantar surface of a wearer's foot. A smaller bottom base support surface 302S could be provided, however, without departing from this invention, including one that extends less than an entire length of the sole structure 104 (e.g., and which could be provided in one or more of: a forefoot area, a midfoot area, a heel area, etc.) and/or one that is discontinuous and/or provided as multiple separate component parts (e.g., having one or more gaps or junctions along its length and/or width). As another option, if desired, the bottom base support surface 302S may be omitted and the frame 300 may be made as one or more sidewalls 302L and/or 302M.

As best shown in FIGS. 2B, 2C, 2E, 2F, 2G, and 3C, the exterior 302B of the bottom base support surface 302S of this example includes flex grooves defined therein to promote desired flex of the base support surface 302S. While the flex grooves may be provided in any desired arrangements and/or orientations, in this illustrated example, generally transverse flex grooves 304 are provided at least in the forefoot and/or midfoot regions to promote flexion during a step cycle (when the wearer's weight transitions from the heel to the forefoot). The rearmost flex grooves 306 extend somewhat more in a rear lateral-to-forward medial direction to promote flex of the base support surface 302S on a heel strike of a step cycle (when the weight transitions from the lateral side-to-medial side of the heel/foot). The medial sidewall 302M, lateral sidewall 302L, rear heel wall 302H, and bottom base support surface 302S form an interior receptacle for receiving a midsole core component 400, as will be described in more detail below. As shown in FIGS. 2G and 2J, the rear heel wall 302H and rear heel sides of the frame 300 extend substantially upward, creating a deep "heel cup" for receiving the core component 400 and/or engaging a wearer's heel (and optionally providing support akin to a heel counter type structure). If desired, at its highest rear heel point P1, the rear heel wall 302H may extend upward from a horizontal support surface by a distance (dimension H1 in FIG. 2G) of at least 1.25 inch, and in some examples, at least 1.5 inch, at least 1.75 inch, or even at least 2 inches. Additionally or alternatively, if desired, the dimension H2 from a central heel support surface of support surface 400S of midsole core component 400 to the highest rear heel point P1, as shown in FIG. 2G, may be at least 0.75 inch, and in some examples, at least 1 inch, at least 1.25 inch, at least 1.5 inch, or even at least 1.75 inch. As another option or alternative, if desired, the dimension H4 from a rearmost point of the midsole core component 400 to the top rim of the rear heel wall 302H at its highest location P1, as shown in FIG. 2G, may be at least 0.5 inch, and in some examples, at least 0.75 inch, at least 1 inch, or even at least 1.25 inch. These dimensional features provide the deep "heel cup" described above for securely holding the wearer's foot. These deep heel cup features also may allow this example footwear 100/sole structure 104 to avoid use of a conventional plastic heel counter type structure as a separate part, as is known and used in the art.

As further shown in several figures, the medial sidewall 302M and the lateral sidewall 302L of this illustrated example sole structure 104 include several openings 310 defined through them. These openings 310 improve flexibility of the sole structure 104 and frame 300 to promote desired flexion of the sole structure 104, particularly when the wearer's weight transitions from the heel to the forefoot during a step cycle. The sidewall openings 310 and the flex grooves 304/306 may be sized and positioned relative to one another so as to cooperate and/or to promote the desired level of flexion of the sole structure 104. While nine openings 310 are shown on each of the medial sidewall 302M and the lateral sidewall 302L in this illustrated example, other numbers and/or arrangements of openings 310 are possible, including one or more of the following: more openings, fewer openings, more openings on one side as compared to the other side, no openings on one side or the other side, heel region based openings, toe region based openings, vertically stacked openings, vertically staggered openings, openings at different longitudinal spacings, etc. A potential location of a heel region based opening 310H is shown in broken lines in FIGS. 3B and 3D. Also, while the openings 310 are shown as circular and having a circular vertical cross sectional shape (and an overall cylindrical shape), different shapes may be provided without departing from this invention, including square, rectangular, triangular, other polygonal shapes, oval, elliptical, star shaped, U-shaped, irregularly shaped, etc. The same or different shapes and/or the same or different combinations of shapes may be provided on the lateral sidewall 302L as compared to the medial sidewall 302M and/or a single sidewall may include two or more different shapes.

In the illustrated example, the openings 310 all are shown as having a circular vertical cross sectional shape, although the openings 310 differ in size moving in the heel-to-toe direction. More specifically, in this illustrated example, the openings 310 get progressively larger in vertical cross sectional area (e.g., diameter in this illustrated example) moving in a direction from the toe to the heel except the rearmost opening 310 (excluding opening 310H) is somewhat smaller than the penultimate opening in the heel direction. The somewhat smaller rearmost opening 310 may help keep the heel area somewhat more structured and supportive (and less flexible) to engage the wearer's foot. The sizes of the openings 310 can be controlled to provide the desired levels of support/flexion.

As some more specific examples, the largest opening(s) 310 on one sidewall may have a vertical cross sectional area that is at least 6 times, and in some examples, at least 8 times, at least 10 times, or even at least 12 times greater than the vertical cross sectional area of the smallest opening(s) 310 on that same sidewall. From a more absolute dimensional point of view, the sidewall openings 310 may range in vertical cross sectional area, for example, from about 12 $mm^2$ for the smallest opening(s) 310 to about 720 $mm^2$ for the largest opening(s) 310. The smallest opening 310 on one sidewall 302M/302L may have a vertical cross sectional area within a range of 12 $mm^2$ to 40 $mm^2$ and/or the largest opening 310 on a sidewall 302M/302 (e.g., that same sidewall 302M/302L) may have a vertical cross sectional area in a range from 400 $mm^2$ to 720 $mm^2$. Additionally or alternatively, the size(s) of the opening(s) 310 may correspond to a thickness of the overall midsole at the location of the respective opening 310 (e.g., including the thickness of core component 400 described in more detail below).

FIGS. 2I-2J also show that in this example the openings 310 extend through the sidewalls 302M and 302L in a manner so as to produce: (a) a cylindrical interior surface 3101 in the openings 310 from the medial sidewall outer surface 302MO to the medial sidewall inner surface 302MI and (b) a cylindrical interior surface 3101 in the openings 310 from the lateral sidewall outer surface 302LO to the lateral sidewall inner surface 302LI. The cylindrical interior surface 3101 need not have a circular vertical cross sectional shape, but rather may have any desired vertical cross sectional shape, including, for example, square, rectangular, triangular, other polygonal shapes, oval, elliptical, star shaped, U-shaped, irregularly shaped, etc., as identified above. Thus, in these example structures, the vertical cross sectional area of the openings 310 does not change (or does not significantly change) over their axial length from their outer surface to their inner surface. In other examples, the cross sectional area may change over the axial length of the opening 310 from the inside surface 302MI/302LI to the outside surface 302MO/302LO thereof, e.g., increasing in area moving from inside to out, decreasing in area moving from inside to out, increasing and decreasing moving from inside to out, etc. Other shapes and/or arrangements are possible without departing from this invention, including a truncated conical or frustoconical shaped interior surface(s) 3101, tapered interior surface(s) 3101, etc. The terms "vertical cross sectional area" and "vertical cross sectional shape" of the opening(s) 310 as used herein in this context, mean the area(s) or shape(s) in vertical section with the frame 300, sole 104, and/or article of footwear supported on a horizontal base surface in an unloaded condition and with the vertical cross sectional plane extending across an axial direction of the respective opening 310.

As some additional examples, the largest opening(s) 310 on one sidewall may have a cross sectional area that is at least 6 times, and in some examples, at least 8 times, at least 10 times, or even at least 12 times greater than the cross sectional area of the smallest opening(s) 310 on that same sidewall. From a more absolute dimensional point of view, the sidewall openings 310 may range in cross sectional area, for example, from about 12 $mm^2$ for the smallest opening(s) 310 to about 720 $mm^2$ for the largest opening(s) 310. The smallest opening 310 on one sidewall 302M/302L may have a cross sectional area within a range of 12 $mm^2$ to 40 $mm^2$ and/or the largest opening 310 on a sidewall 302M/302 (e.g., that same sidewall 302M/302L) may have a cross sectional area in a range from 400 $mm^2$ to 720 $mm^2$. Additionally or alternatively, the size(s) of the opening(s) 310 may correspond to a thickness of the overall midsole at the location of the respective opening 310 (e.g., including the thickness of core component 400 described in more detail below). The term "cross sectional area" as used in this context means a cross sectional area oriented in a plane perpendicular to an axial direction of the respective opening 310.

As noted above, the frame 300 (including its medial sidewall 302M, lateral sidewall 302L, rear heel wall 302H, and bottom base support surface 302S) forms an interior receptacle for receiving a midsole core component 400 (e.g., akin to a cupsole configuration). This example midsole core component 400 is shown in FIGS. 2A-2J and FIGS. 4A-4D. The midsole core component 400 of this example includes an upper plantar support surface 400S, which in this example extends to support substantially all of a wearer's foot (all except the very forward toe area, which is truncated off at edge 400E as the overall sole structure 104 becomes thinner at that forward toe area). The plantar support surface 400S may be contoured, e.g., to comfortably support and/or help position a plantar surface of a wearer's foot.

The midsole core component 400 of this illustrated example is made from a polymer foam material, which may be a foam material that is softer (and optionally less durable and/or less dense) than the foam material (or other material) making up the frame 300. As some more specific examples, the midsole core component 400 may constitute a foam material (such as ethylvinylacetate ("EVA") foam, polyurethane foam, Phylon foam, and the like). The midsole core component 400 may be at least partially made from a foam material having a density of less than 0.25 $g/cm^3$ (and in some examples, a density of less than 0.2 $g/cm^3$, within the range of 0.075 to 0.2 $g/cm^3$, and even within the range of 0.1 to 0.18 $g/cm^3$). If desired, the foam material of core component 400 may include one or more openings defined therein and/or another impact-force attenuating component included with it, such as a fluid-filled bladder, a mechanical shock absorbing member, etc. In certain embodiments of this invention, the entire midsole core component 400 will constitute this lightweight foam material (e.g., with a density feature as described above) and will extend to support the complete foot of the wearer (e.g., the complete plantar surface, except potentially the extreme forward toe area, as mentioned above).

As some even more specific examples, at least some (and optionally all) of the midsole core component 400 may be made from a foam material as described, for example, in U.S. Pat. No. 7,941,938, which patent is entirely incorporated herein by reference, and optionally the frame 300 may be made from a material like those for carrier components described in U.S. Pat. No. 7,941,938. The midsole core component 400 may have a resiliency of greater than 40%, greater than 45%, at least 50%, and in one aspect from 50-70%. Compression set may be 60% or less, 50% or less, 45% or less, and in some instances, within the range of 20 to 60%. The hardness (Durometer Asker C) of the foam material for the core component 400 may be, for example, 25 to 50, 25 to 45, 25 to 35, or 35 to 45, e.g., depending on the intended use of the footwear. The tensile strength of the foam material for the core component 400 may be at least 15 $kg/cm^2$, and typically 15 to 40 $kg/cm^2$. The elongation % may be 150 to 500, typically above 250. The tear strength may be 6-15 kg/cm, typically above 7. In at least some example constructions according to the invention, the foam material of at least some portion of the core component 400 may have lower energy loss and may be more lightweight than traditional EVA foams. The energy loss may be less than 30%, and optionally within the range of about 20% to about 30%. As additional examples, if desired, at least some portion of the midsole core component 400 may be made from foam materials used in footwear products available from NIKE, Inc. of Beaverton, Oreg.

While the above paragraphs describe potential properties and features of foam materials for midsole core components 400 in accordance with some examples of this invention, those skilled in the art will recognize that the midsole core component 400 may have other desired properties, features, and/or combinations of features without departing from this invention. Other lightweight and/or low density foams also may be used. As another example, a polyurethane based foam may be used to provide improved resiliency/energy return/bounce back under foot. Because of the frame 300 described in detail above, the lightweight midsole core component 400 (e.g., made of foam or a fluid-filled bladder) need not necessarily have sufficient hardness, durability, and/or abrasion resistance to directly contact the ground in use (at least not at some higher impact ground contact locations). As shown in FIG. 2G, in at least some examples of this invention, the midsole core component 400 may have a heel region thickness H3 of at least 0.4 inch, and in some examples, at least 0.5 inch, at least 0.6 inch, or even at least 0.75 inch.

As evident from FIGS. 4A-4D, this example midsole core component 400 includes a series of outwardly extending medial stems 402M that project sideways away from a base surface 402MB of a medial interior midsole sidewall 400M of the core component 400 (which may be made of a foam material). Similarly, this example midsole core component 400 includes a series of outwardly extending lateral stems 402L that project sideways away from a base surface 402LB of a lateral interior midsole sidewall 400L of the core component 400 (which may be made from a foam material). These medial stems 402M and lateral stems 402L are configured to fit into the openings 310 provided in the medial sidewall 302M and lateral sidewall 302L, respectively, of the frame 300, e.g., as shown in FIGS. 2A-2J. As the medial stem(s) 402M and lateral stem(s) 402L are designed to be received in the opening(s) 310 and optionally complementarily fit (e.g., tightly fit) into their respective openings 310, the medial stems 402M and the lateral stems 402L may have any of the variations in sizes, numbering, relative sizes, ranges of sizes, combination of sizes, positions, orientations, shapes, cross-sectional shapes, cross-sectional areas, and the like as described above for the openings 310.

As some specific examples, the largest stem(s) 402L, 402M on one side may have a cross sectional area that is at least 6 times, and in some examples, at least 8 times, at least 10 times, or even at least 12 times greater than the cross sectional area of the smallest stem(s) 402L, 402M on that same side. From a more absolute dimensional point of view, the stems 402L, 402M may range in cross sectional area, for example, from about 12 $mm^2$ for the smallest stem(s) 402L, 402M to about 720 $mm^2$ for the largest stem(s) 402L, 402M. The smallest stem 402L, 402M on one side may have a cross sectional area within a range of 12 $mm^2$ to 40 $mm^2$ and/or the largest stem 402L, 402M on a side (e.g., that same sidewall 302M/302L) may have a cross sectional area in a range from 400 $mm^2$ to 720 $mm^2$. Additionally or alternatively, the size(s) of the stem(s) 402L, 402M may correspond to a thickness of the overall midsole at the location of the respective stem(s) 402L, 402M. The term "cross sectional area" as used in this context means a cross sectional area oriented in a plane perpendicular to an axial direction of the respective stem 402L, 402M.

Figure 4A:
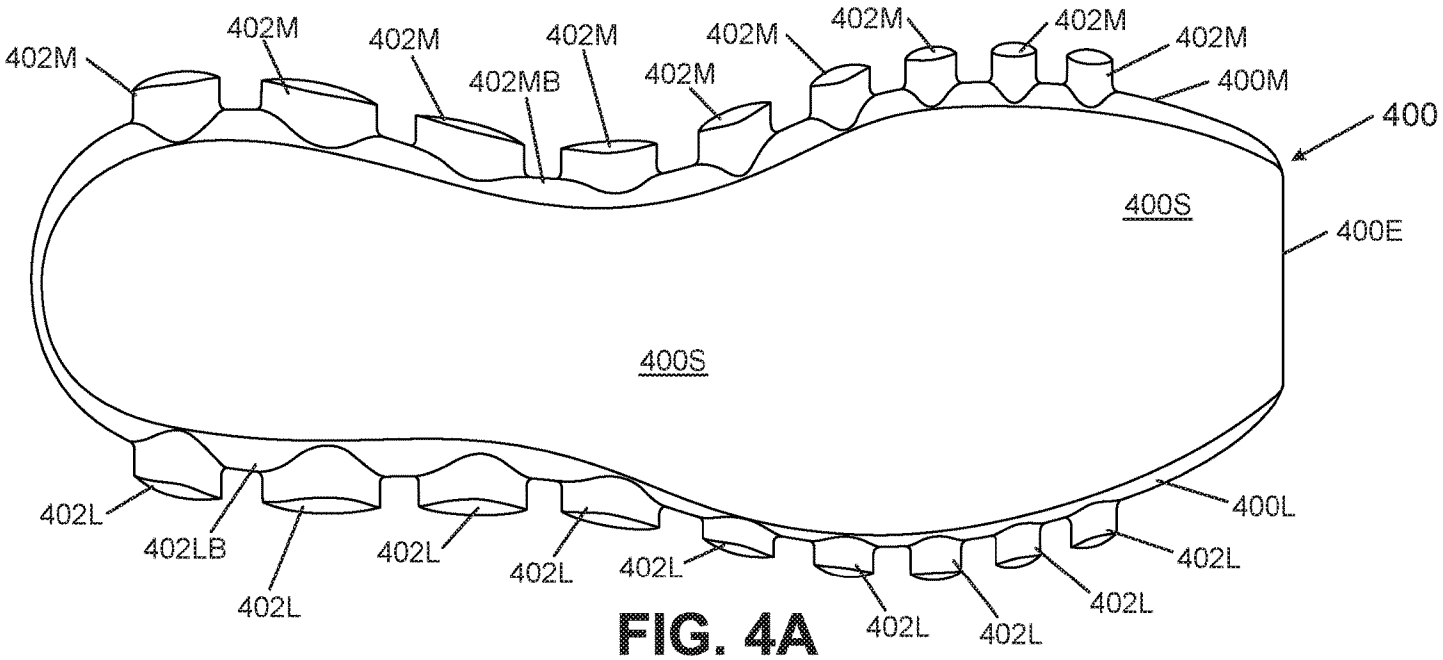
FIGS. 4A-4D provide various views of example midsole core components for sole structures in accordance with at least some examples of this invention.
Figure 4B:
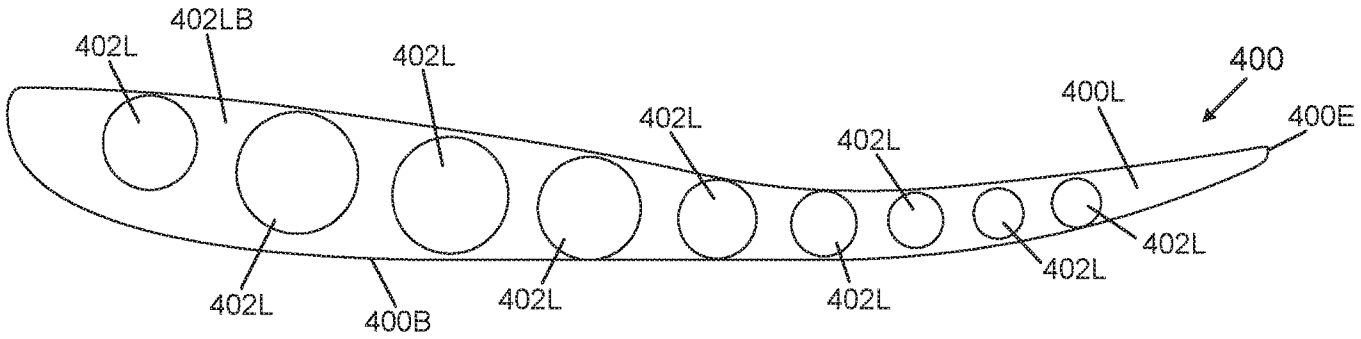
Figure 4C:
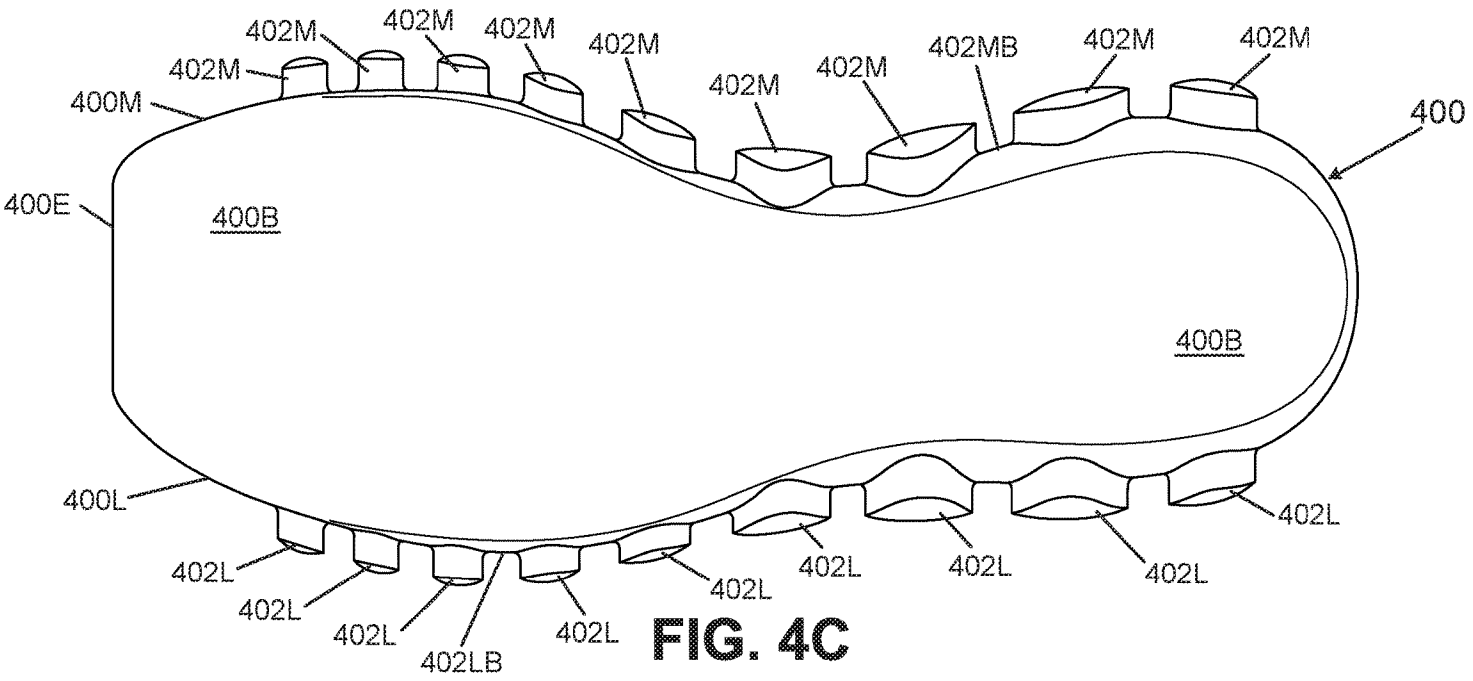
Figure 4D:
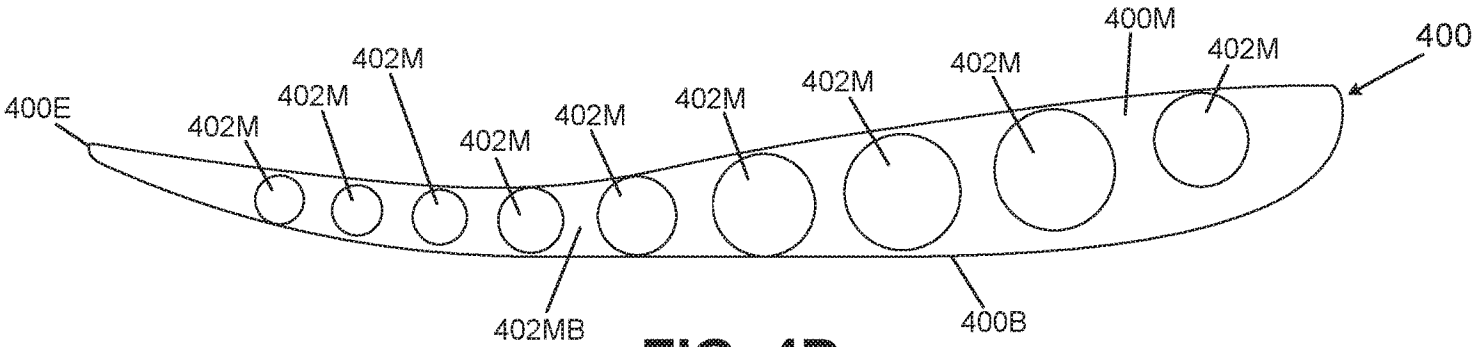
Figure 4E:
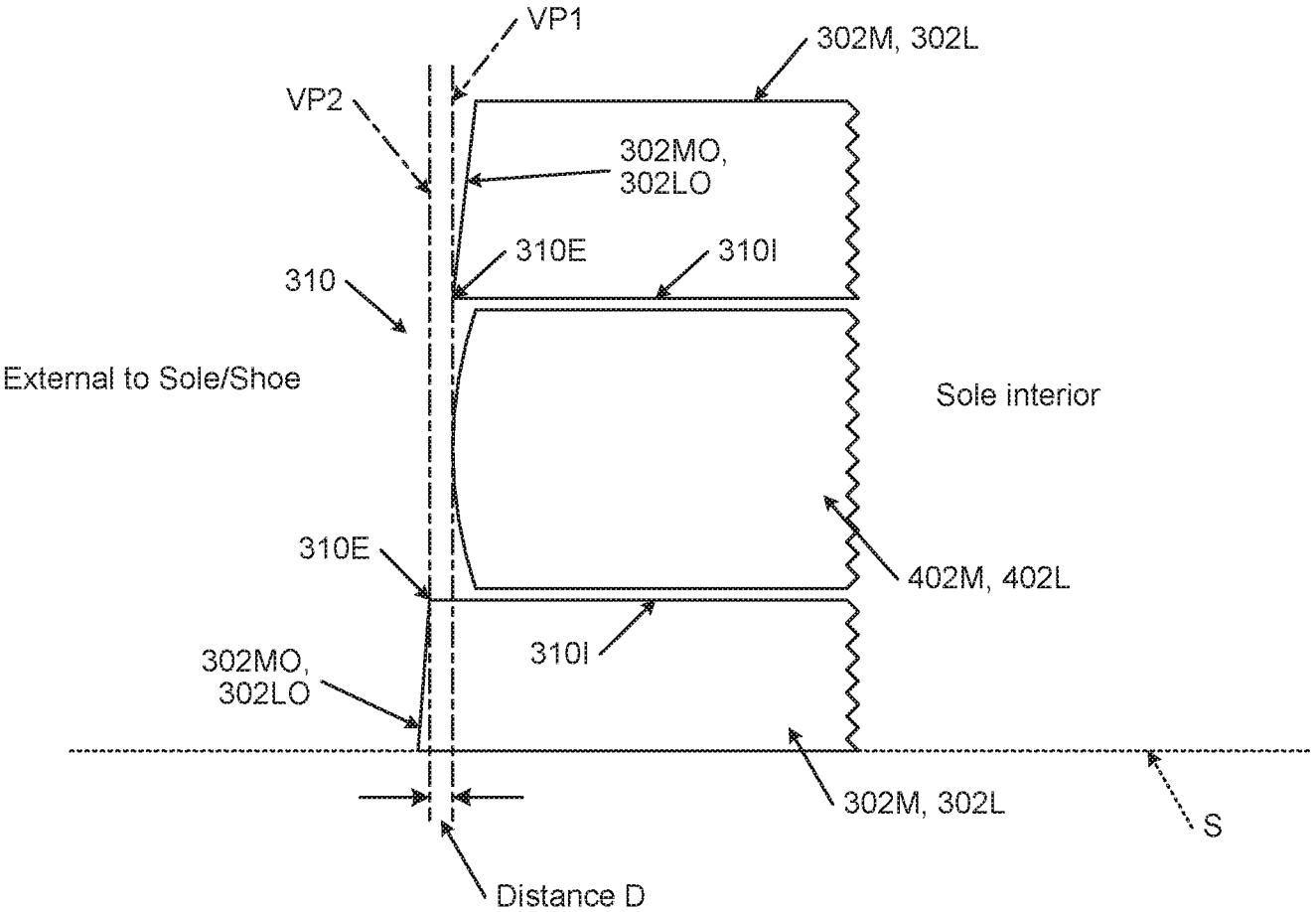
FIGS. 4E-4J provide various views illustrating different potential features and/or alternative features of sole structures in accordance with at least some examples of this invention.

As shown in the figures, the outwardly extending medial stem(s) 402M extend into the opening(s) 310 provided on the medial sidewall 302M of the frame 300 and/or the outwardly extending lateral stem(s) 402L extend into the opening(s) 310 provided on the lateral sidewall 302L of the frame 300. One or more of the medial stems 402M may extend beyond the medial inner surface 302MI of the medial sidewall 302M and optionally at least to a location at or adjacent the medial outer surface 302MO of the medial sidewall 302M, e.g., as shown in FIGS. 2I and 2J. Similarly, one or more of the lateral stems 402L may extend beyond the lateral inner surface 302LI of the lateral sidewall 302L and optionally at least to a location at or adjacent the lateral outer surface 302LO of the lateral sidewall 302L, e.g., as shown in FIGS. 2I and 2J. Referring to FIG. 4E (a vertical and transverse cross sectional view through a stem 402L/402M and opening 310), the terminology extending "to a location at or adjacent" the outer surface (302MO, 302LO) of a sidewall (302M, 302L) as used herein in this context means that, with the sole structure 104 oriented on a horizontal support surface S in an upright manner and in an unloaded condition (i.e., with no external load applied to the sole member 104 other than potentially the weight of the footwear components with which it is engaged, e.g., as shown in FIGS. 2C, 2D, and 2G-2J), a vertical plane (VP1) contacting an outermost extent of the free end of the stem 402M/402L will be located within a distance D of 5 mm from a vertical plane (VP2) contacting an outermost extent of the respective window 310 edge 310E (e.g., where the opening 310 interior surface 3101 meets the outer wall 302MO/302LO) into which that stem 402M/402L is received. The free end of the stem 402L/402M may be located within the distance D and located inside the outermost extent of the window 310 edge 310E or outside the outermost extent of the window 310 edge 310E. For window 310 edges 310E having a rounded opening edge, the outermost extent of the rounded edge 310E is located where the tangent to the rounded edge curve becomes more vertical than horizontal. In some examples of this invention, the outermost extent of the free end of the stem 402M/402L will be located at a distance D of 3 mm or less or even 2 mm or less from the outermost extent of the window 310 edge 310E.

Figure 4F:
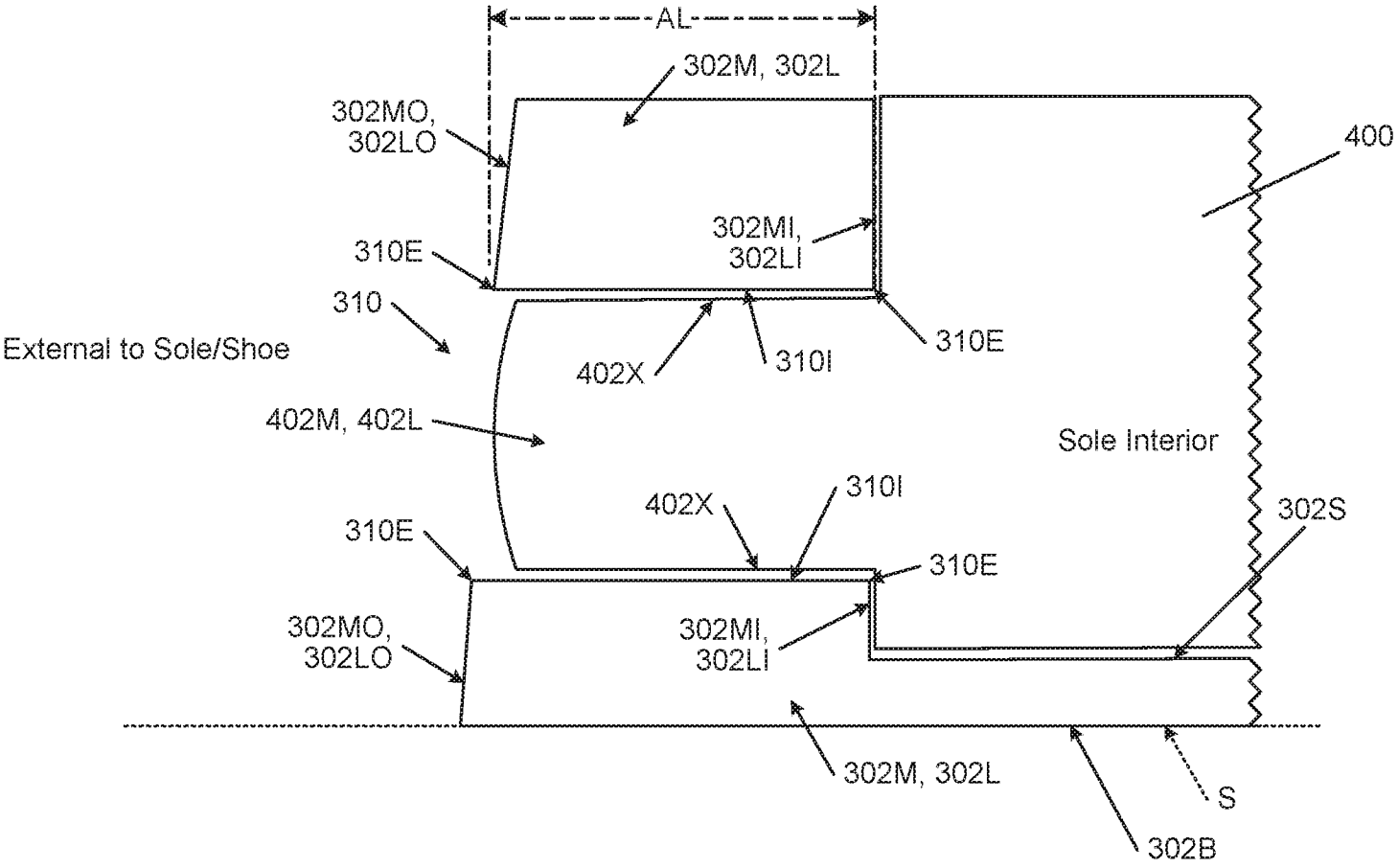

Additionally or alternatively, stem(s) 402M/402L may have an exterior surface 402X that is "complementary" shaped with respect to the interior surface(s) 3101 of the respective opening(s) 310 in which they are received. The term "complementary" shaped as used herein in this context means that with the sole structure 104 oriented on a horizontal support surface S in an upright manner and in an unloaded condition (i.e., with no external load applied to the sole member 104 other than potentially the weight of the footwear components with which it is engaged, e.g., as shown in FIGS. 2C, 2D, and 2G-2J), the exterior surface 402X of the stem 402M/402L directly contacts and/or lies within 3 mm of the interior surface 3101 of the opening 310 over at least 25% of an axial length AL of the opening 310, e.g., as shown in FIG. 4F (a transverse and vertical cross sectional view through a stem 402L/402M and its opening 310). The axial length AL is defined as the shortest dimension of the opening 310 (through the opening 310) from the carrier interior wall 302MI/302LI to its exterior wall 302MO/302LO for that opening 310. In some examples of this invention, the exterior surface 402X of the stem 402M/402L will directly contact and/or lie within 2 mm or even within 1 mm of the interior surface 3101 of the opening 310 over at least 25% of an axial length AL of the opening 310. Additionally or alternatively, in some examples of this invention, the exterior surface 402X of the stem 402M/402L will directly contact and/or lie within 3 mm of the interior surface 3101 of the opening 310 over at least 50%, at least 75%, at least 90%, or even at least 95% of an axial length AL of the opening 310. In some examples, the stem 402M/402L will snuggly fit in its respective opening 310 over at least 50%, at least 75%, at least 90%, or even at least 95% of an axial length AL of the opening 310.

Figure 4G:
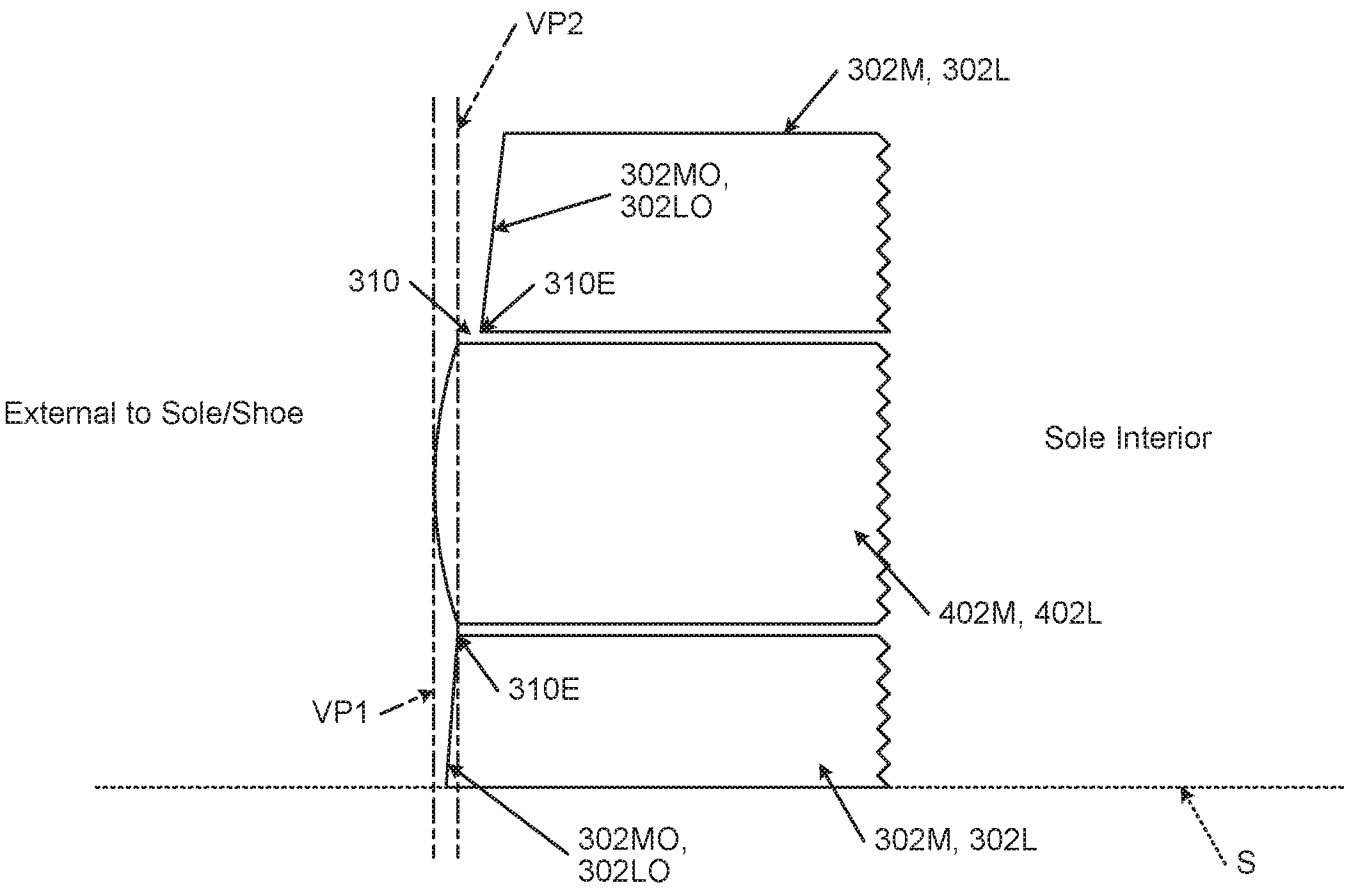

In some examples of this invention, the free end(s) of the medial stem(s) 402M and/or the lateral stem(s) 402L may include at least a portion that extends outward beyond the outermost extent (e.g., outermost edges) of the respective opening(s) 310 in which they are received (by any desired distance), e.g., as shown in FIGS. 1A-2J. This may be determined, for example, as shown in FIG. 4G (a transverse and vertical cross sectional view through a stem 402L/402M and opening 310), with the sole structure 104 oriented on a horizontal support surface S in an upright manner and in an unloaded condition (i.e., with no external load applied to the sole member 104 other than potentially the weight of the footwear components with which it is engaged, e.g., as shown in FIGS. 2C, 2D, and 2G-2J), when a vertical plane (VP1) contacting an outermost extent of the free end of the stem 402M/402L is located outside of a location of a vertical plane (VP2) contacting an outermost extent of the respective window 310 edge 310E (at the outer wall 302MO/302LO) into which that stem 402M/402L is received. For window 310 edges 310E having a rounded opening edge, the outermost extent of the rounded edge 310E is located where the tangent to the rounded edge curve becomes more vertical than horizontal. The outermost extent of the free end of the stem 402M/402L may extend outward outside of the window 310 edge 310E any desired distance, e.g., at least 1 mm, at least 2 mm, in the range of 1 mm and 25 mm, in the range of 1 mm to 15 mm, etc. In other example structures, the outermost extent of the free end of the stem 402L/402M may be located at or inside the window 310 edge 310E, e.g., within a distance of 5 mm or less (and in some examples, within a distance of 3 mm or less, 2 mm or less, or even 1 mm or less) from the window 310 edge 310E.

The midsole core component 400 may be engaged with the frame 300 in any desired manner without departing from this invention. For example, if the midsole core component 400 is made as a single piece, it may be sufficiently flexible (e.g., made from flexible foam material) such that it can be folded longitudinally, placed down into the receptacle formed by the interior wall surfaces 302MI/302LI of the frame 300, and then released so that the core component 400 flattens out and the stems 402M/402L on each side extend outward into their respective openings 310, e.g., into the configurations and orientations shown in FIGS. 2A-2J. The bottom major surface 400B of the core component 400 and/or the top interior surface (base support surface) 302S of the frame 300 may include a cement or adhesive to allow these component parts to be fixed together. If desired, one or more of the stems 402L/402M may be fixed to the interior sidewalls 3101 of their respective openings 310 (e.g., by cements, fusing techniques, or in other manners). Alternatively, if desired, the exterior surface(s) 402X of one or more of the stems 402M/402L and the interior surfaces 3101 of one or more of their respective openings 310 may lack any cements or adhesives (or may not otherwise be fixedly engaged together) so that the exterior surface(s) of the stem(s) 402M/402L may move somewhat with respect to the interior surface(s) 3101 of their respective openings 310.

If desired, in at least some examples of this invention, when the sole structure 104 is compressed under a wearer's foot (e.g., when landing a step or jump), this may cause one or more of the stems 402M/402L at least in the weight bearing area(s) of the sole structure 104, to extend outward somewhat with respect to their openings 310 when nothing has fixed the stem(s) 402M/402L with respect to their openings 310, e.g., due to the Poisson effect. This outward extension of the stem(s) 402M/402L with respect to their openings 310 can provide an interesting visual/dynamic effect. Even in examples of this invention in which the stem(s) 402L/402M are fixed over some portion of their axial length(s) to the interior surface(s) 3101 of their respective opening(s) 310, this outward "bulging" effect still may be observed when sufficient force is applied, e.g., due to outward expansion/extension of the free end surface of the stem(s) 402L/402M under the applied force due to the Poisson effect.

Figure 4H:
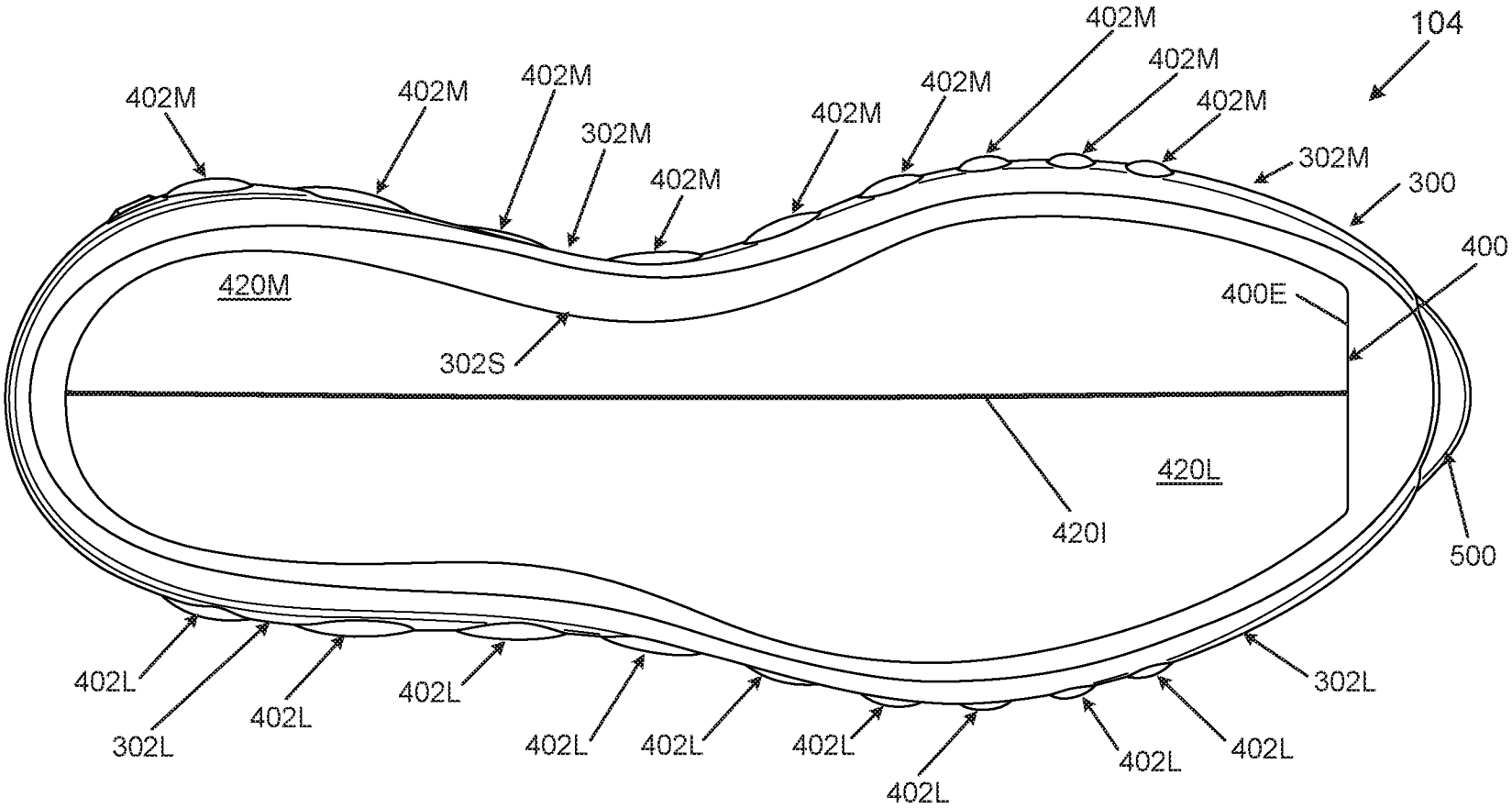
Figure 4I:
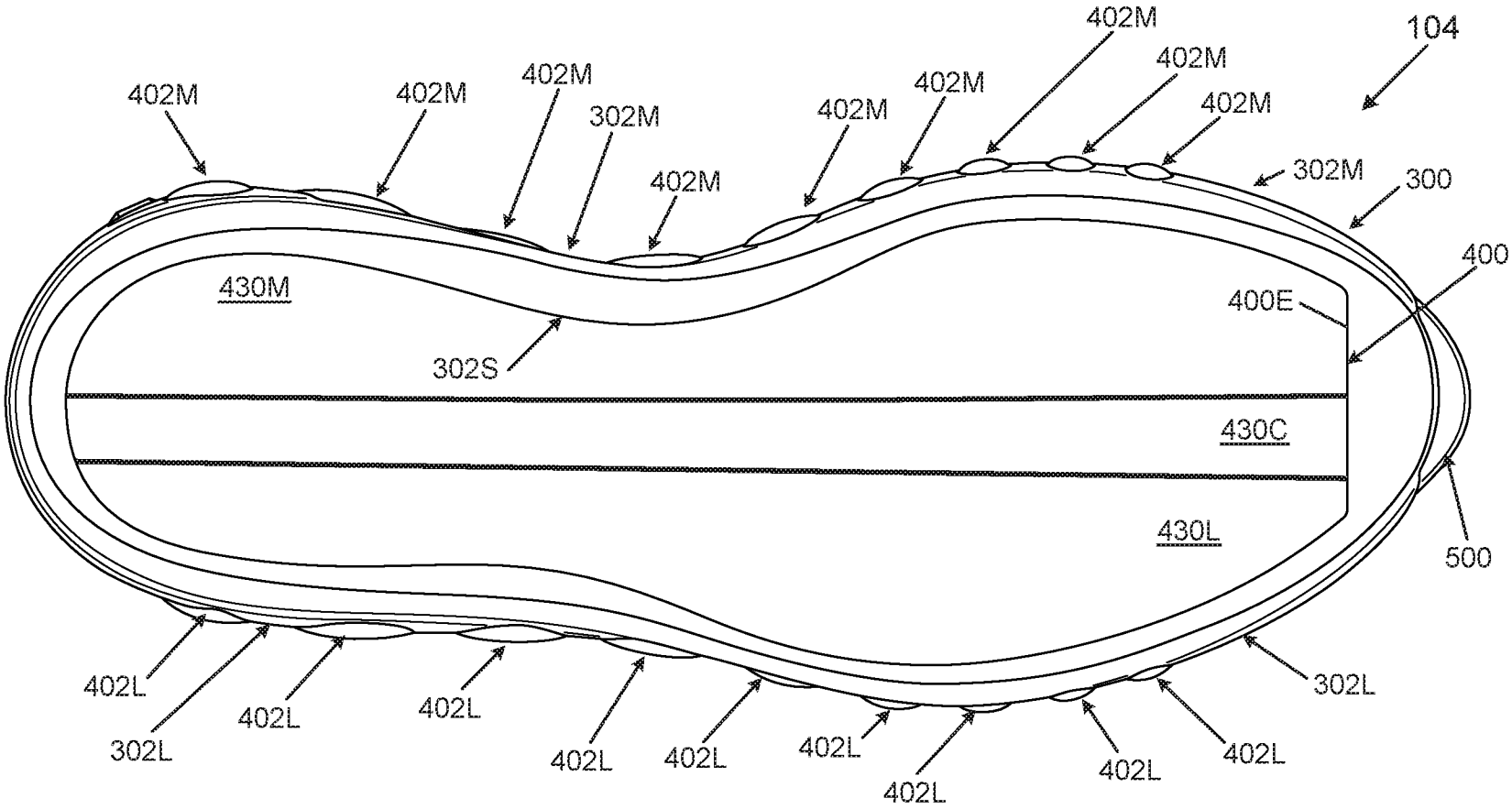

Rather than a one-piece midsole core component 400, if desired, the midsole core component 400 could constitute multiple parts. For example, as shown in FIG. 4H, the midsole core component 400 may be made from a medial side part 420M and a lateral side part 420L that meet at interface 4201. The interface 4201 may be located down a longitudinal centerline of the core component 400 and/or the medial side part 420M and the lateral side part 420L may be asymmetric in size and/or shape as compared to one another. This multi-part construction may ease assembly of the overall sole component 104, as the stems from one side (e.g., 402M) can be inserted into their respective openings 310 with one half of the core component (e.g., 420M) while most of the frame 300 receptacle remains open, and then the stems from the other side (e.g., 402L) can be inserted into their respective openings 310 with the other half of the core component (e.g., 420L). As another option, as shown in FIG. 4I, the midsole core component 400 could be made of three longitudinally arranged parts, namely: a medial side part 430M, a lateral side part 430L, and a central part 430C. This multi-part construction also could ease the assembly process (e.g., ease insertion of the core components 400 into the frame 300, particularly when contact cement is used to secure these parts together). In this arrangement, the side parts 430M and 430L could be engaged by inserting their stems 402M/402L into their respective openings 310 while a relatively large area of the frame 300 receptacle remains open and then the central part 430C could be secured in place once the side parts 430M and 430L are in place. Other sizes and/or divisions of the midsole core component 400 could be used, if desired, including: separating the midsole core component 400 into more parts; separating the midsole core component 400 into two or more of: a forefoot part, a heel part, a midfoot part, a forward half, a rearward half, etc.; providing a midsole core component 400 with stem(s) 402L/402M only in a portion of the foot support (e.g., only in a heel portion of the sole structure 104, only in a forefoot portion of the sole structure 104, only in a midfoot portion of the sole structure, etc.); and the like. FIGS. 9A-9K, described in more detail below, provide another example of a sole structure 104 with a multi-part core component 400.

While the above described examples of this invention included a foam type midsole core component 400, if desired, this foam core component 400 could be replaced in whole or in part with a fluid-filled bladder component, e.g., of the types that are conventionally known and used in the footwear arts. When formed as a fluid-filled bladder component, the fluid-filled bladder component may be sized and shaped in the same manner as the foam component described above. When one or more stems 402M/402L are made as fluid-filled bladder components (optionally in fluid communication with a larger, plantar support fluid-filled bladder portion), this may enhance the outward "bulging" effect observed when areas of the sole structure 104 receive an impact force or weight (particularly if the stems 402M/402L are not fixedly engaged with the interior surfaces 3101 of their respective openings 310 over at least some portion of the axial lengths).

Figure 4J:
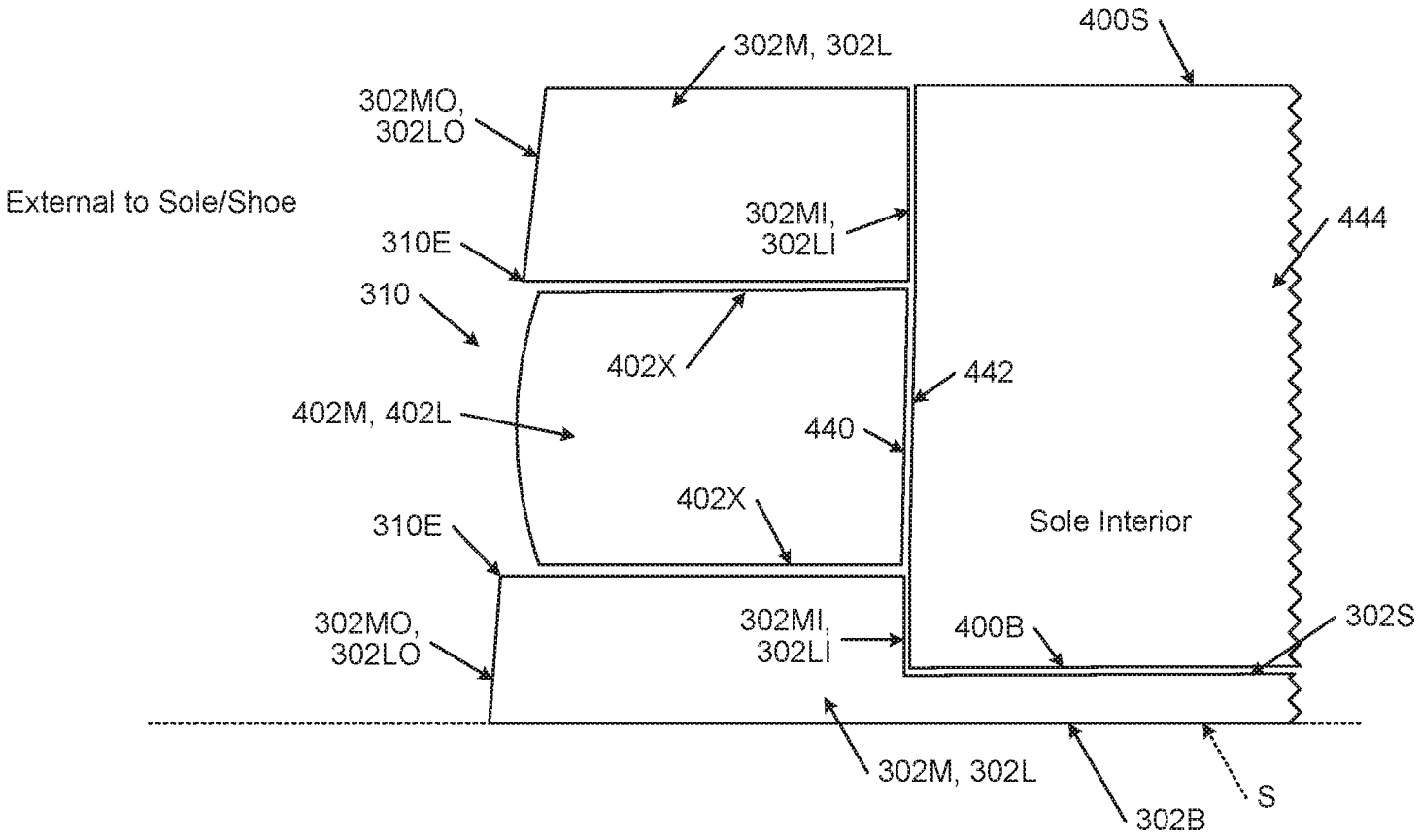
Figure 5D:
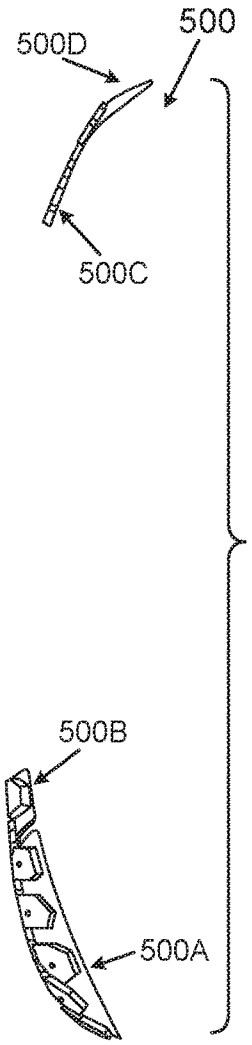
FIGS. 5A-6D provide various views of outsole components of sole structures in accordance with at least some examples of this invention.
Figure 5C:
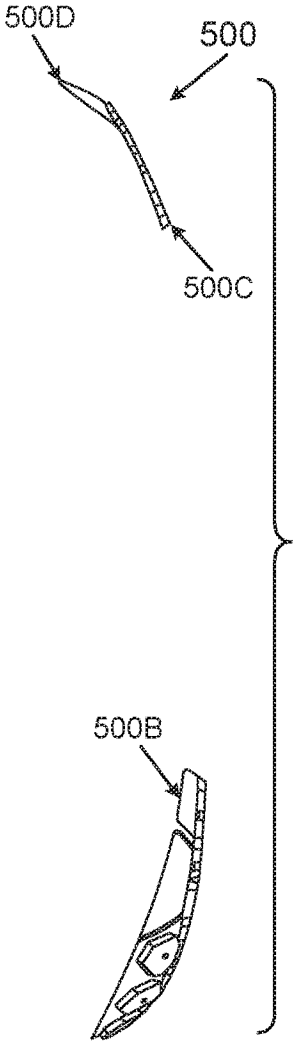
Figure 5B:
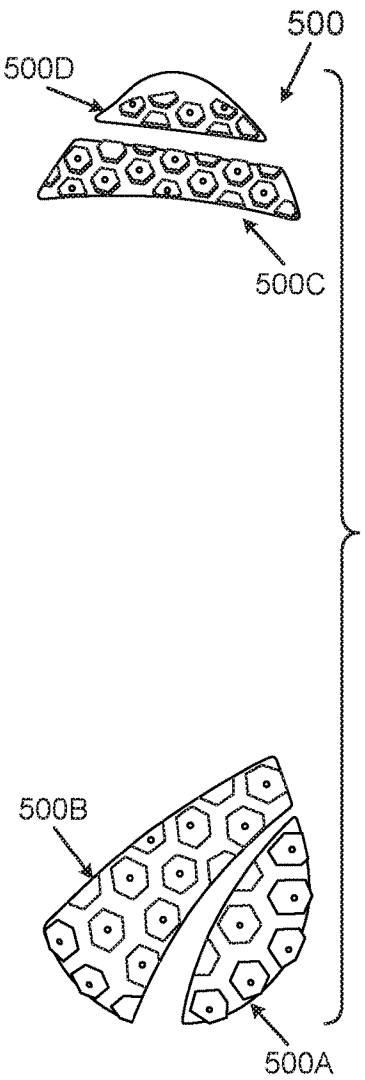
Figure 5A:
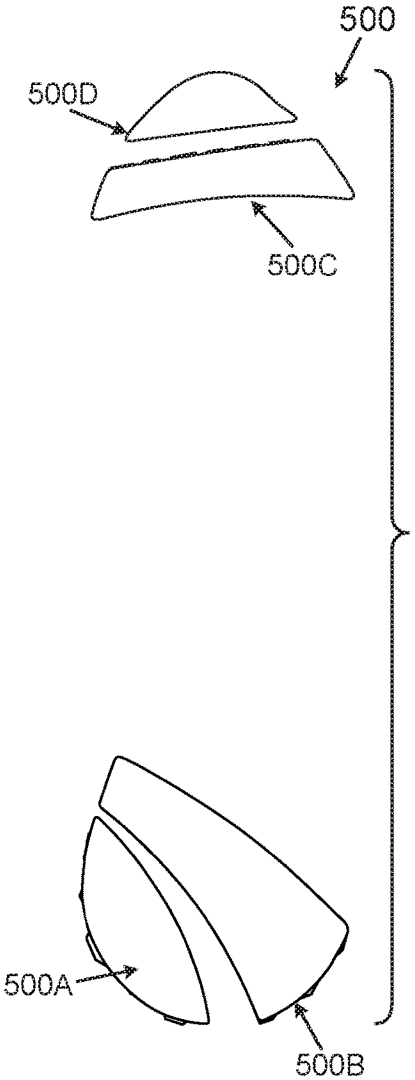
Figure 6D:
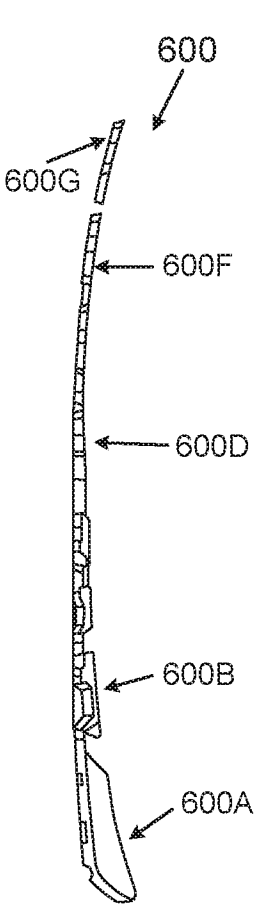
Figure 6C:
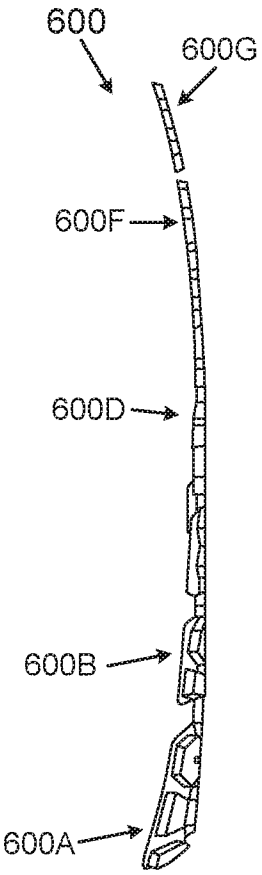
Figure 6B:
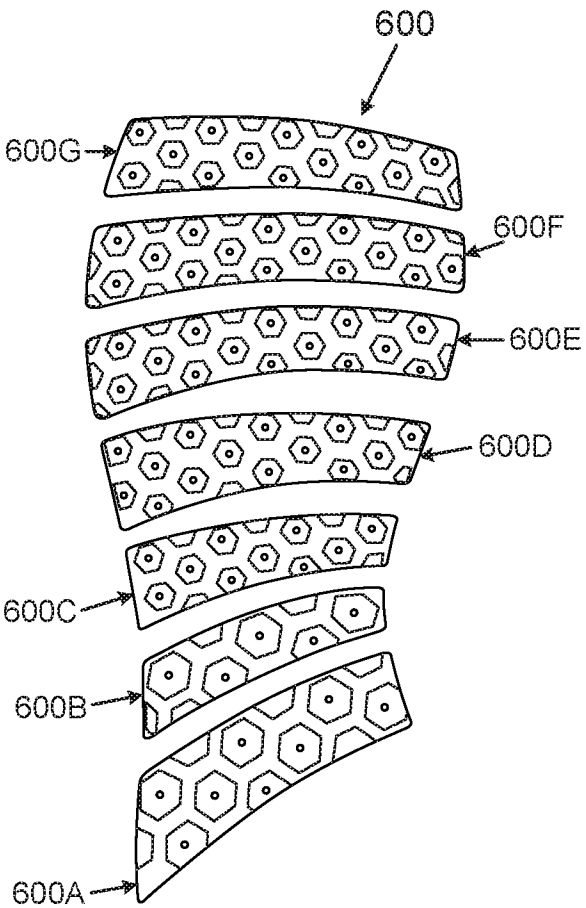
Figure 6A:
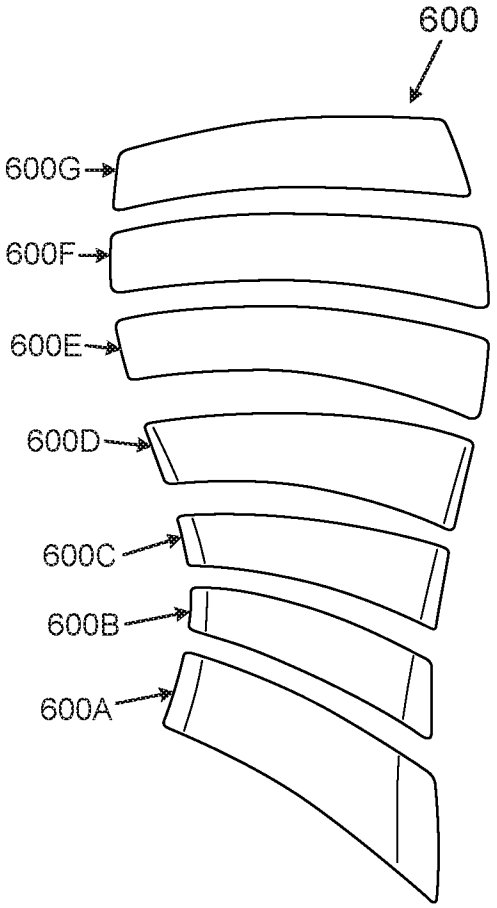

In the example structures described above, the stems 402M/402L are integrally formed with and constitute continuous parts (integral, one-piece constructions) with the main base of the midsole core component 400 (e.g., a continuous structure with the midsole component including the plantar support surface 400S). Other options are possible. For example, as shown in FIG. 4J, one or more of the stems 402M/402L may be formed as separate "plug" type members having an interior surface 440 that abuts against a sidewall 442 of a foam or fluid-filled bladder base member 444 (including plantar support surface 400S) at or within an the interior location of opening 310. In this manner, the sole structure 104 could be assembled by: (a) inserting a "stemless" foam or fluid-filled bladder base member 444 into the frame 300 interior receptacle and (b) inserting the stems 402M/402L into their respective openings 310 from an exterior side thereof (e.g., through the exterior outer walls 302MO/302LO of frame 300 at the openings 310). Alternatively, the stems 402M/402L could be inserted into their respective openings 310 from the inside of the frame 300 (through interior walls 302LI/302MI) and then the "stemless" base member 444 could be inserted into the receptacle formed by the frame 300.

FIGS. 5A through 5D show various views (top view, bottom view, lateral side view, and medial side view, respectively) of more durable outsole components 500 in this example of the invention with their relative locations in the overall sole structure 104 shown. While other arrangements, numbers, and/or orientations of these types of outsole components 500 are possible, in this illustrated example, outsole components 500 include four separate components, namely: a medial heel component 500A, a medial/mid heel component 500B, and two forward toe components 500C and 500D. The individual outsole components 500 are separated from one another at locations corresponding to the flex grooves 304 and/or 306 in the frame 300 to help promote and/or maintain high flexibility of the overall sole structure 104, particularly in the heel-to-toe direction and/or in a direction corresponding to the center of forces applied to a sole structure 104 during a step cycle (e.g., rolling from lateral side-to-medial side and from heel-to-toe). The outsole components 500 in this illustrated example are attached to the bottom base surface 302B of the frame 300, e.g., in recesses formed in the frame 300 (e.g., during its production by molding) to accept the individual outsole components 500. This attachment may be made via adhesives or cements (or in any other desired manner).

FIGS. 6A through 6D show various views (top view, bottom view, lateral side view, and medial side view, respectively) of another set of outsole components 600 in this example of the invention with their relative locations in the overall sole structure 104 shown. These outsole components 600 may be made of a somewhat lighter, softer, more flexible material as compared to the material(s) of outsole components 500. While other arrangements, numbers, and/or orientations of these types of outsole components 600 are possible, in this illustrated example, outsole components 600 include seven separate components extending generally transverse across the sole structure 104 (from the medial side edge to the lateral side edge of sole structure 104), namely outsole components 600A (rearmost), 600B, 600C, 600D, 600E, 600F, and 600G (forwardmost). The individual outsole components 600A-600G are separated from one another at locations corresponding to the flex grooves 304 and/or 306 in the frame 300 to help promote and/or maintain high flexibility of the overall sole structure 104, particularly in the heel-to-toe direction and/or in a direction corresponding to the center of forces applied to a sole structure 104 during a step cycle (e.g., rolling from lateral side-to-medial side and from heel-to-toe). As shown, for example, in FIG. 2B, the bottom surface 302S of the frame member 300 is exposed at the bottom of the sole structure 104 at locations between adjacent outsole components 500, 600, and the flex grooves 304, 306 also are exposed at the bottom of this example sole structure 104. The outsole components 600 in this illustrated example are attached to the bottom base surface 302B of the frame 300, e.g., in recesses formed in the frame 300 (e.g., during its production by molding) to accept the individual outsole components 600. This attachment may be made via adhesives or cements (or in any other desired manner).

The outsole components 500, 600 may be made from any desired materials without departing from this invention, including outsole materials as are conventionally known and used in the footwear arts. Also, more or fewer different types of outsole components may be used in a single footwear sole structure 104, including only one type of outsole component (rather than the two types shown in FIGS. 5A-6D), three or more different types, etc. As other possible options or alternatives, if desired, any two or more of the individual outsole components 500A-500D and/or 600A-600G may be formed as a single part, e.g., optionally with flexion grooves or other flex features provided to help maintain the flexible nature of the overall sole structure 104. Additionally or alternatively, outsole components also may be split in the longitudinal direction of the sole structure 104, e.g., into medial side parts and lateral side parts, to promote and/or maintain flexibility of the sole structure 104 in the longitudinal (lateral side-to-medial side) direction. Longitudinal grooves in the bottom base support surface 302B of the frame 300 also may be provided to promote this type of longitudinal flexion, if necessary or desired.

Figure 7:
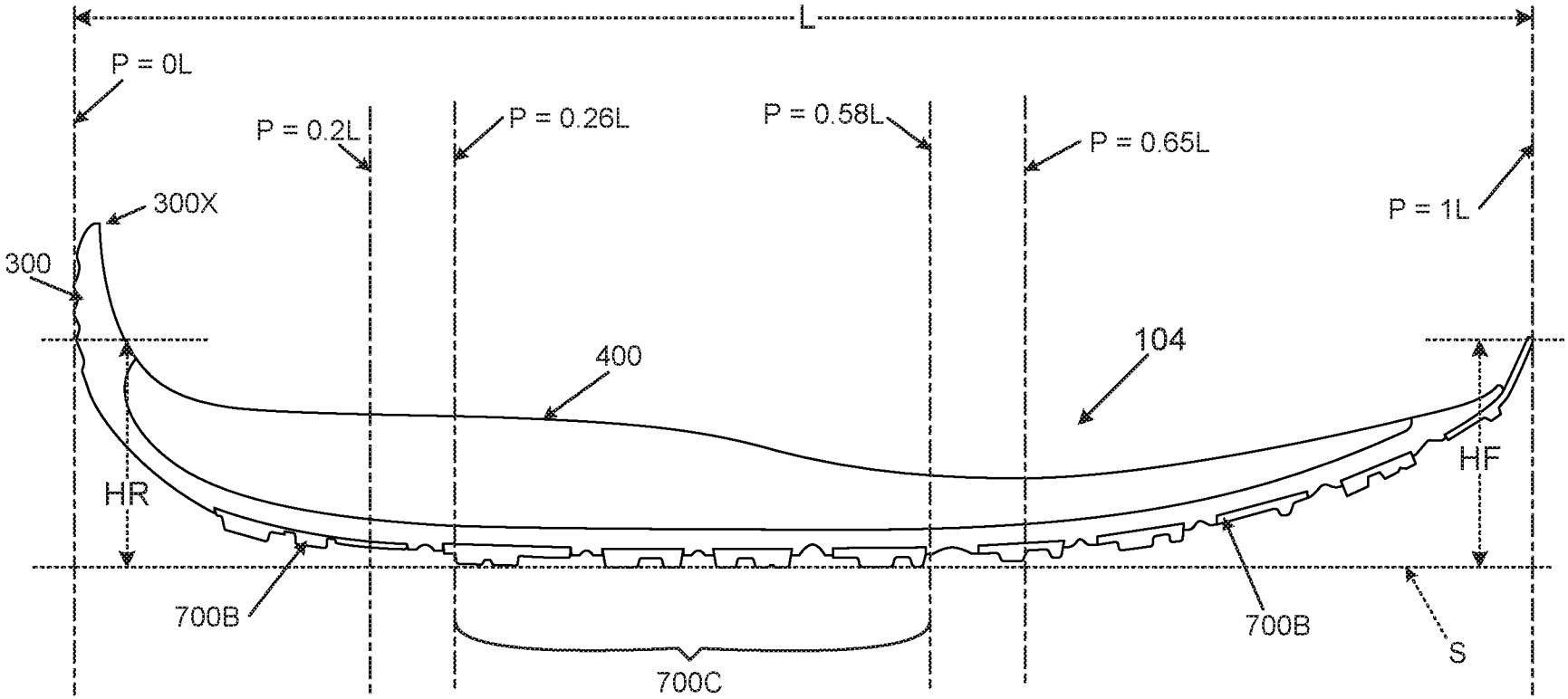
FIG. 7 illustrates different potential features and/or alternative features of sole structures in accordance with at least some examples of this invention.

Additional potential features of articles of footwear and/or sole structures in accordance with at least some examples of this invention are illustrated in FIG. 7. FIG. 7 shows a longitudinal vertical cross sectional view of a sole structure 104 supported on a horizontal support surface S in an unloaded condition. The sole structure 104 has a longitudinal length L from a rearmost heel point to a forwardmost toe point. Vertical planes are shown in FIG. 7 oriented perpendicular to the horizontal support surface S and between a first vertical plane located at the rearmost heel location (P=0 L) and a second vertical plane located at the forwardmost toe location (P=1 L). The locations of other vertical planes in FIG. 7 are identified by their relative location along the longitudinal length L using the rearmost heel location (P=0 L) as the origin for measurement. The sole structure 104 of this illustrated example has an upwardly extending heel region and an upwardly extending forefoot region (e.g., having its exterior bottom surface 700B extending upward from a horizontal base surface S on which the sole structure 104 is supported). In at least some examples of this invention (e.g., as shown in FIG. 7), when moving rearward, the exterior bottom surface 700B of the heel region will begin curving upward toward the rear heel region at a location forward of a vertical plane located at 0.2 L, and even forward of a vertical plane located at 0.25 L (and at a vertical plane located at about 0.26 L in this specific illustrated example). As further shown in FIG. 7, the top portion of the rear heel region of frame 300 may begin to curve forward, back toward the toe end (e.g., shown at frame edge 300X).

Additionally or alternatively, in at least some examples of this invention (e.g., as shown in FIG. 7), when moving forward, the exterior bottom surface 700B of the forefoot region will begin curving upward toward the forward toe region at a location rearward of a vertical plane located at 0.65 L, and even rearward of a vertical plane located at 0.6 L (and at a vertical plane located at about 0.58 L in this specific illustrated example). Thus, in these examples, less than 45% of the longitudinal length (e.g., from P=0.2 L to P=0.65 L) of the exterior bottom surface 700B of the sole structure 104 provides horizontal contact/support in a stationary position on a horizontal base surface S, and the exterior bottom surface 700B of the sole structure 104 curves upward toward the heel (to provide a "heel rocker" type structure) and upward toward the toe (to provide a "forefoot rocker" type structure) from opposite ends of this central longitudinal base area 700C. This central longitudinal base area 700C may cover less than 40% or even less than 35% of the overall longitudinal length L of the sole structure 104 in some examples (with about 32% (from P=0.26 L to P=0.58 L) present in this specific illustrated example).

At the rear heel region, the exterior surface 700B of the sole structure 104 may curve upwardly and rearwardly to a height HR (from the horizontal base support surface S) at which the exterior surface 700B of the sole structure 104 contacts the rearmost vertical plane (at P=0 L). This height HR may have a dimension corresponding at least to a dimension of 0.1 L, and in some examples, at least 0.12 L or even at least 0.14 L. Additionally or alternatively, at the forward toe region, the exterior surface 700B of the sole structure 104 may curve upwardly and forwardly to a height HF (from the horizontal base support surface S) at which the exterior surface of the sole structure 104 contacts the forwardmost vertical plane (at P=1 L). This height HF may have a dimension corresponding at least to a dimension of 0.1 L, and in some examples, at least 0.12 L or even at least 0.14 L. The upwardly curved heel and toe regions of the exterior surface 700B of the sole member 104 support and/or promote rolling of the foot from the heel to the toe during a step cycle.

FIG. 7 further illustrates that this example sole structure 104 has a "heel lift" or "heel/forefoot offset," e.g., greater thickness of the midsole/sole structure at the heel as compared to at the forefoot. The heel lift of this example sole member 104 may be at least 10 mm, and in some examples, at least 12 mm, or even at least 14 mm. In this specifically illustrated example, the sole and/or the midsole thickness may be about 28 mm in the heel and about 14 mm in the forefoot. This heel lift also helps promote and support rolling of the foot from the heel to the toe (heel-to-toe transition) during a step cycle.

Figure 8A:
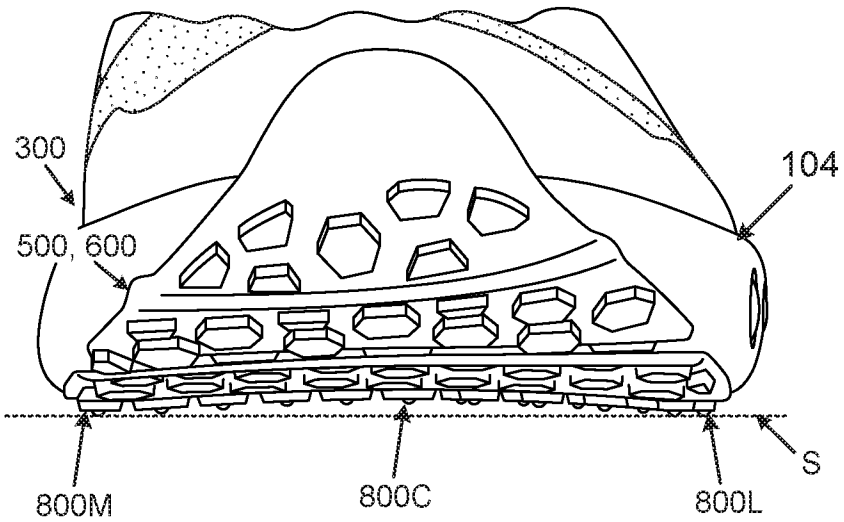
FIGS. 8A-8D illustrate additional potential features and/or alternative features of sole structures in accordance with at least some examples of this invention.

FIGS. 8A-8D illustrate potential shaping features of a sole structure 104 (e.g., outsole components 500 and/or 600, and/or frames 300) in accordance with at least some examples of this invention. In the example sole structures described above, e.g., shown in FIGS. 2H-2J, the bottom surface of the sole structure 104 defines a generally horizontal contact surface in the transverse (medial side-to-lateral side) direction. Other options are possible. For example, FIG. 8A shows a sole structure 104 for an example article of footwear in which at least some portion of the outsole component(s) 500 and/or 600, and/or the frame 300 bows upward from one side to the other side. This can be seen, for example, by the space between the indicated horizontal support surface S and the bottom of outsole components 600 in the central area of the sole 104 in FIG. 8A (note that support surface S contacts the outsole component(s) 600 at the side edges 800M and 800L of the sole structure 104 but does not contact the outsole component(s) 600 in the central area 800C).

Figure 8B:
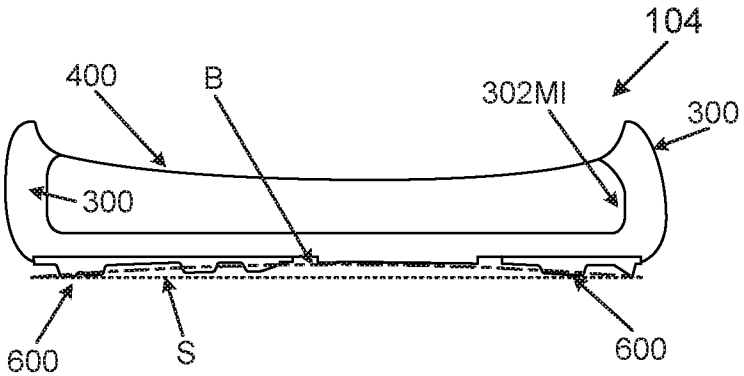
Figure 8C:
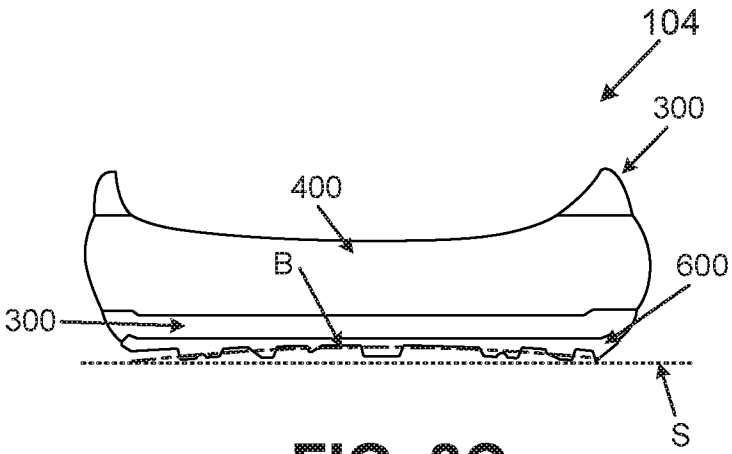
Figure 8D:
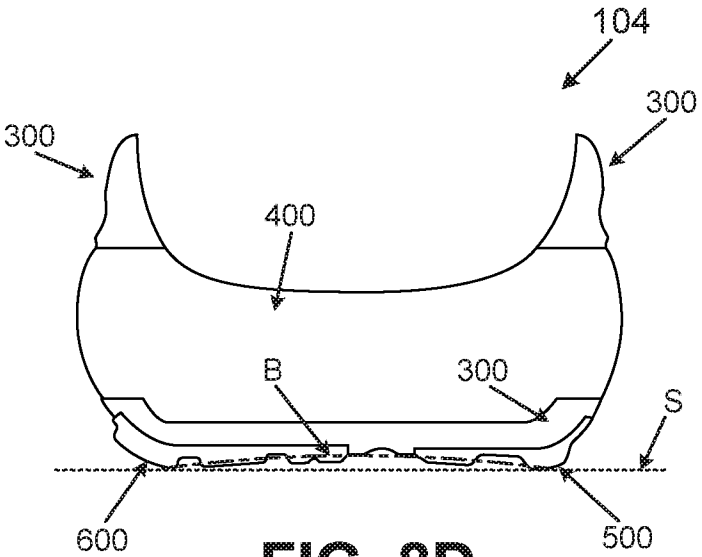

To further illustrate this potential feature, FIGS. 8B-8D are based on FIGS. 2H-2J, respectively, which show a forefoot cross section, a midfoot cross section, and a heel cross section, respectively of a sole structure 104. A horizontal base surface S is shown in these figures as a broken line. As is evident from FIGS. 2H-2J, the bottommost surfaces of the sole member 104 (e.g., outsole components 500/600) contact this horizontal base surface S at various locations across the sole structure 104 (from the lateral side to the medial side). For the example sole structure 104 of FIG. 8A, however, the bottom surface(s) of the outsole component(s) 500, 600 and/or the frame 300 follow the upwardly bowed curvature from the medial side to the lateral side, and may have the general curved configuration in one or more of the forefoot, midfoot, and/or heel regions, e.g., as shown by a dot-dash line B in FIGS. 8B-8D (and as generally shown in FIG. 8A).

Figure 9A:
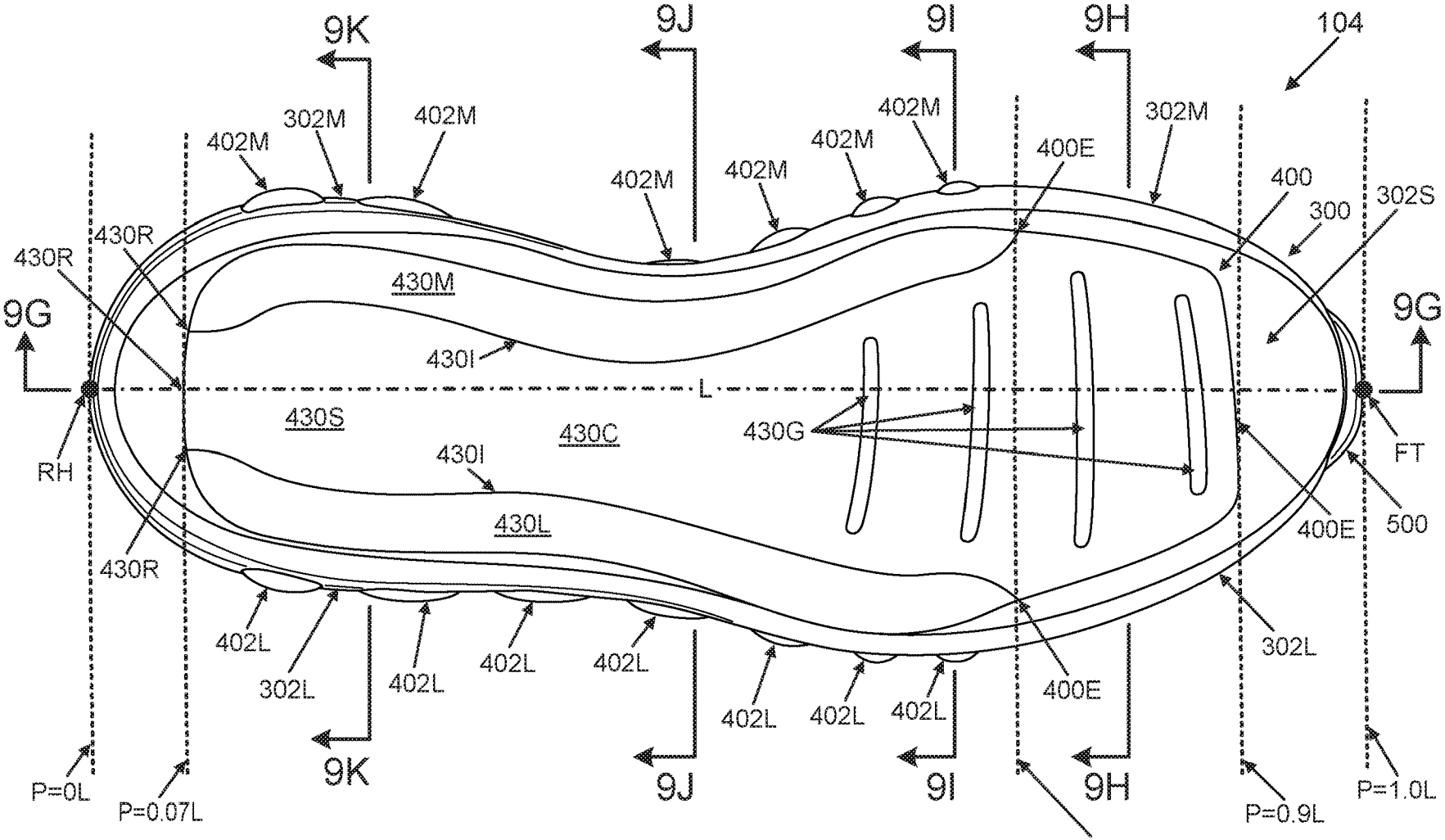
FIGS. 9A-9K illustrate another example sole structure in accordance with at least some examples of this invention.
Figure 9B:
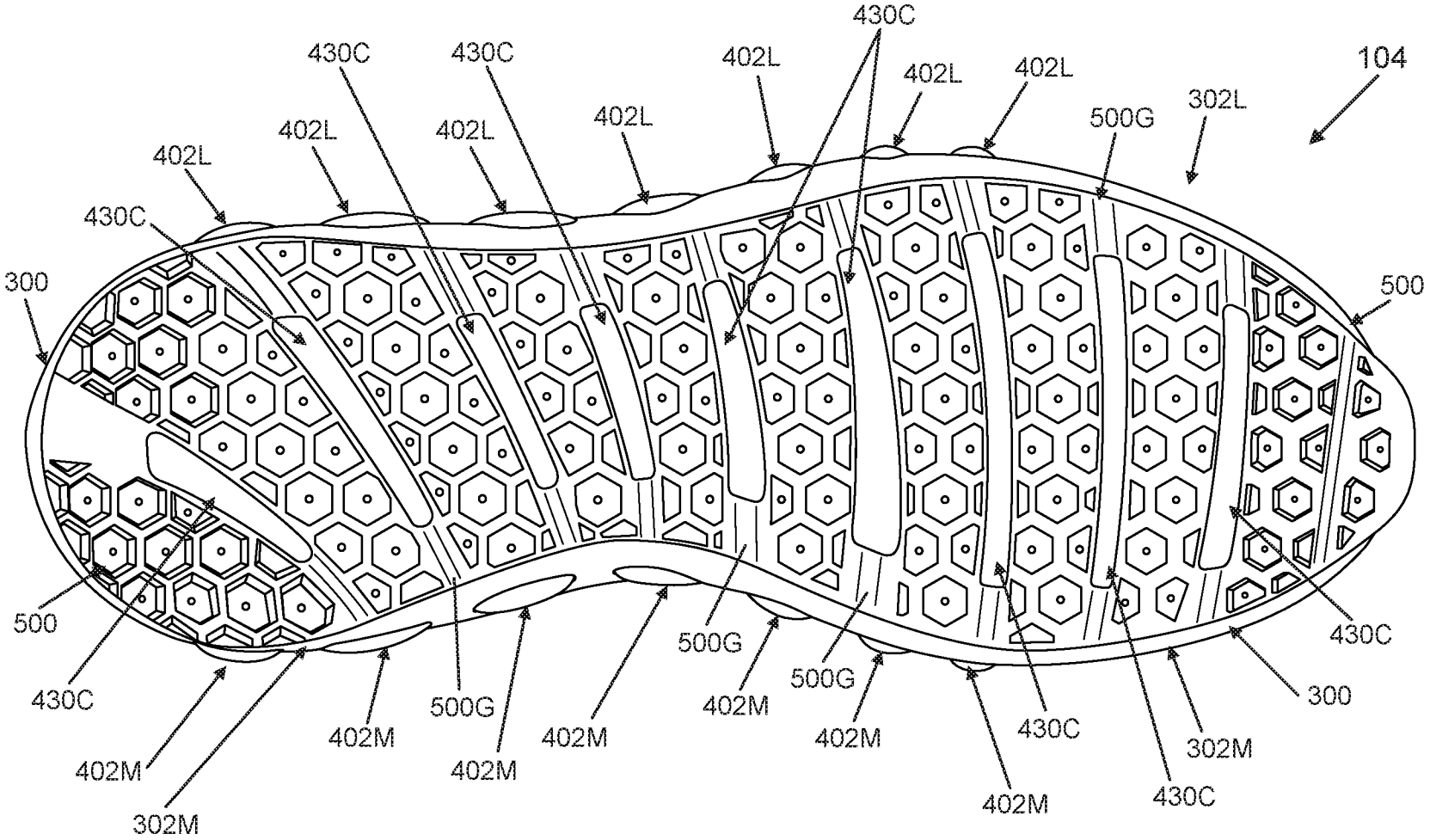
Figure 9C:
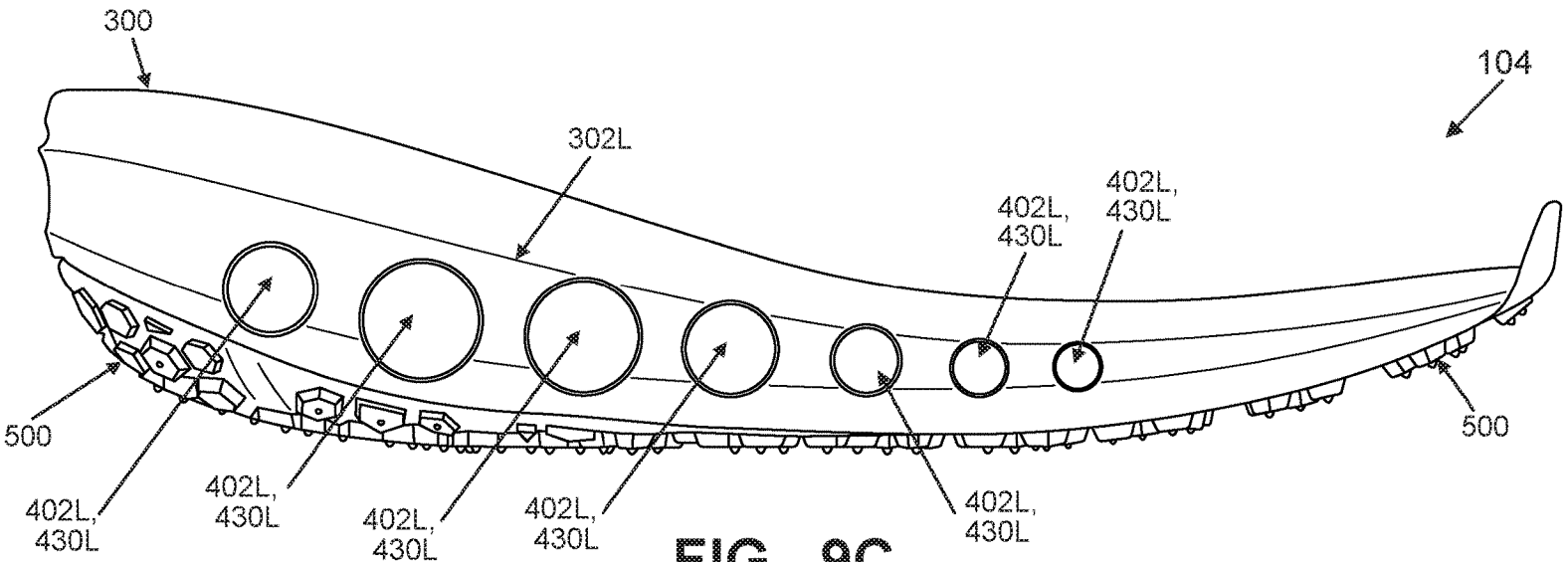
Figure 9D:
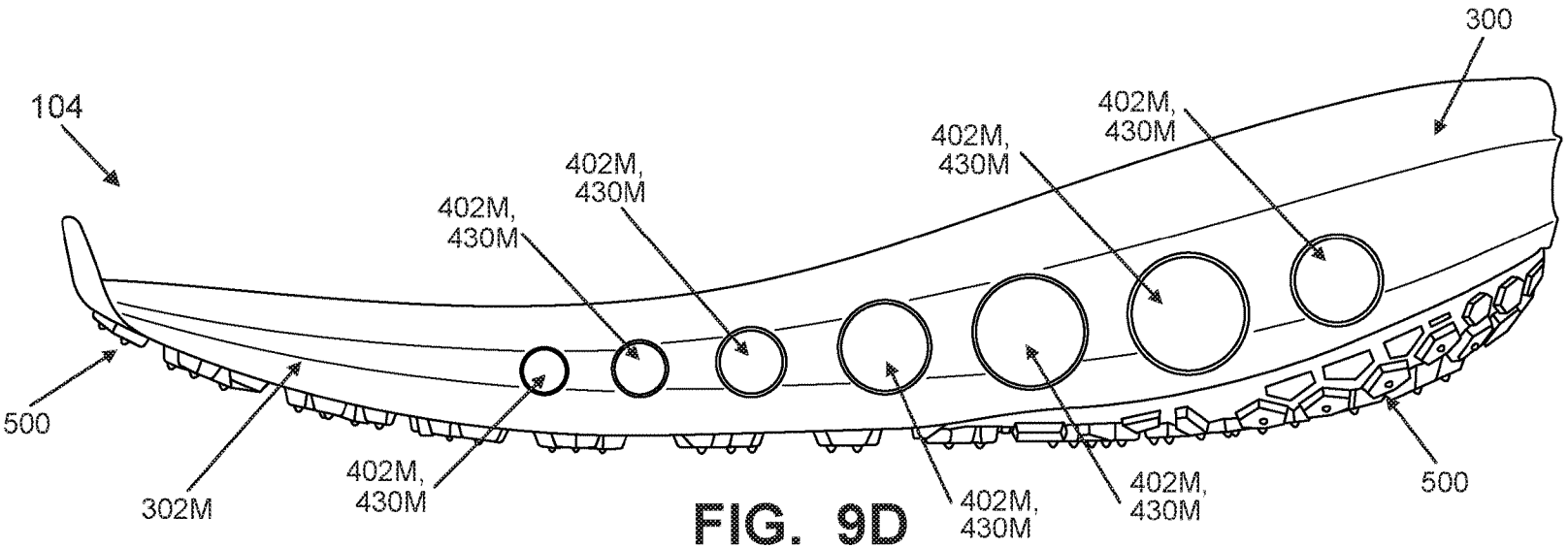
Figure 9F:
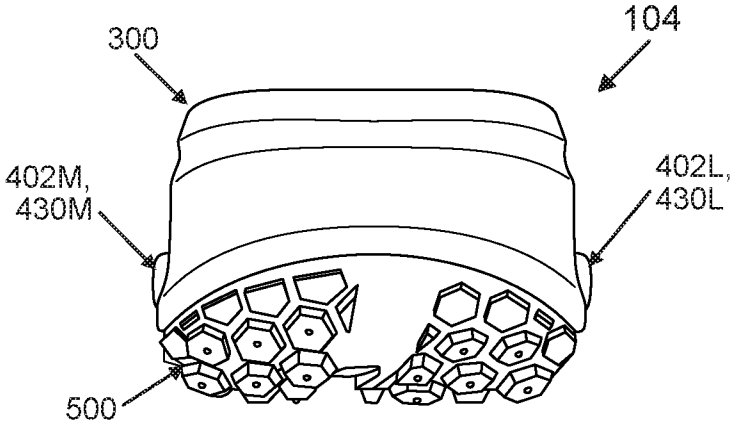
Figure 9E:
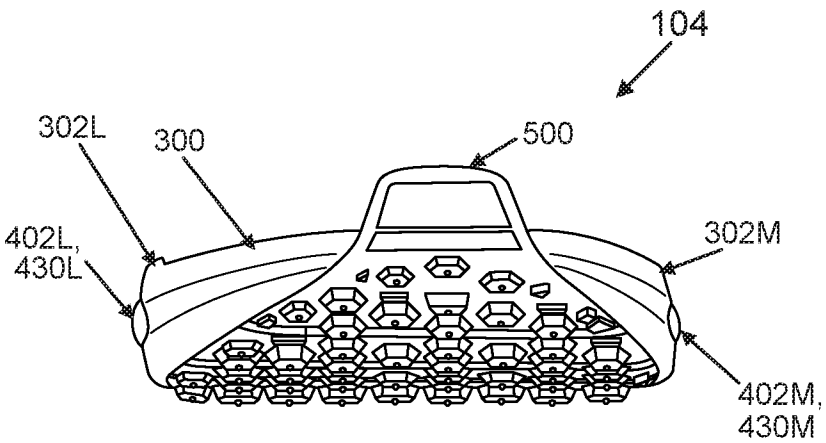

FIGS. 9A-9K provide various views of an alternative footwear sole structure 104 in accordance with at least some examples of this invention. FIG. 9A is a top view of the sole structure 104, FIG. 9B is a bottom view, FIG. 9C is a lateral side view, FIG. 9D is a medial side view, FIG. 9E is a front/toe view, and FIG. 9F is a rear/heel view. FIGS. 9G-9K are sectional views taken along lines 9G-9G, 9H-9H, 9I-9I, 9J-9J, and 9K-9K, respectively, as shown in FIG. 9A. When common reference numbers are used in FIGS. 9A-9K as those used in other figures in this application, the same or similar parts are being referred to, and much of the repetitive description may be omitted.

As shown in these figures, the sole structure 104 of FIGS. 9A-9K includes: (a) a frame 300 (with openings 310 in the medial sidewall 302M and/or the lateral side wall 302L thereof); (b) a multi-part midsole core component 400 (e.g., like that shown in FIG. 4J, including medial side part 430M, (with stems 402M), lateral side part 430L (with stems 402L), and central part 430C); and (c) an outsole component 500. The components 300, 400, 500 shown in FIGS. 9A-9K may be made of any of the same materials and/or may have any of the features, properties, alternatives, and/or options as described above for the same or similar components (e.g., for components 300, 400, and/or 500 described above in conjunction with FIGS. 1A-8D). Also, the sole structure 104 may be engaged with any desired type of upper, in any desired manner, including any of the types of uppers and/or in any of the various manners described above for the footwear, uppers, and/or sole structures of FIGS. 1A-8D.

Like the example shown in FIG. 4J, this example midsole core component 400 is a multi-part structure including medial side part 430M, (with integrally formed stems 402M), lateral side part 430L (with integrally formed stems 402L), and central part 430C. The medial side part 430M and the lateral side part 430L are separate components that form a portion of the plantar support surface for a wearer's foot (see FIG. 9A). The medial side part 430M and lateral side part 430L are separated by the central part 430C, which also forms a portion of the plantar support surface for the wearer's foot. This multi-part midsole core component 400 construction can help make assembly of the sole structure 104 easier, e.g., as generally described above with respect to FIGS. 4I and 4J. Specifically, the sole structure 104 can be built by separately inserting the stems 402M of the medial side part 430M and the stems 402L of the lateral side part 430L through the openings 310 in the frame 300. Once these parts 430M and 430L are placed in the frame 300 (and optionally secured, e.g., by adhesives or cements), a space is left open between their interior edges 4301, and the central part 430C is fit into this space (and optionally secured, e.g., by adhesives or cements). The outsole component(s) 500 is (are) then secured (e.g., by adhesives or cements) to the bottom/sides of the frame 300 and/or the midsole core component 400 (e.g., to one or more of medial side part 430M, central part 430C, and/or lateral side part 430L). Additional features of and/or options for these parts are described in more detail below.

The various midsole core component 400 parts (medial side part 430M, (with integrally formed stems 402M), lateral side part 430L (with integrally formed stems 402L), and central part 430C) may be made from the same or different materials, without departing from this invention. As some more specific examples, these midsole component parts 430M, 430C, and/or 430L may be made from a lightweight and low density foam material, e.g., of the types described above with respect to the example of FIGS. 1A-6D.

FIG. 9A shows a top view of the sole structure 104 supported on a horizontal support surface S in an unloaded condition. The sole structure 104 has a longitudinal length L from a rearmost heel point RH to a forwardmost toe point FT. Vertical planes are shown in FIG. 9A oriented perpendicular to the horizontal support surface S and between a first vertical plane located at the rearmost heel location (P=0 L) and a second vertical plane located at the forwardmost toe location (RH at P=1 L). The locations of other vertical planes in FIG. 9A are identified by their relative location along the longitudinal length L using the rearmost heel location (RH at P=0 L) as the origin for measurement.

Each of the medial side part 430M, the lateral side part 430L, and the central part 430C in this illustrated example sole structure 104 has its rearmost point or edge (430R) located rearward of a vertical plane located at 0.15 L along the longitudinal direction L (measured forward from the rearmost heel point RH located at plane P=0 L). In some examples, each of these rearmost points or edges 430R of parts 430M, 430C, and/or 430L may be rearward of a vertical plane located at 0.12 L or even rearward of a vertical plane located at 0.1 L (the rearmost points or edges 430R are located at a vertical plane located at 0.07 L in this illustrated example). If desired, one or more of the rearmost edges or points 430R of parts 430M, 430C, and/or 430L may be located between vertical planes located at 0 L and 0.15 L, and in some examples, between vertical planes located at 0.02 L and 0.12 L or even between vertical planes located at 0.04 L and 0.1 L. The rearmost points or edges 430R of the various parts (e.g., 430M, 430C, and 430L) need not be located at the same longitudinal positions.

Additionally or alternatively, as also shown in FIG. 9A, the forwardmost edge or point 400E of this example midsole core component 400 (formed by the central midsole part 430C in this illustrated example) is located forward of a vertical plane located at 0.6 L along the longitudinal direction L (measured forward from the rearmost heel point RH located at plane P=0 L). In some examples, this forwardmost point or edge 400E may be located forward of a vertical plane located at 0.7 L or even forward of a vertical plane located at 0.75 L (the forwardmost point or edge 400E of the overall midsole core component 400 in this example is located at a vertical plane located at 0.9 L). If desired, the forwardmost edge or point 400E of the midsole core component 400 may be located between vertical planes located at 0.6 L and 1.0 L, and in some examples, between vertical planes located at 0.7 L and 0.98 L or even between vertical planes located at 0.75 L and 0.95 L. If desired, forwardmost edges or points 400E of the medial side part 430M and/or the lateral side part 430L may extend to the same longitudinal extent or distance as the forwardmost edge or point 400E of the central part 430C.

In the illustrated example of FIGS. 9A-9K, however, the forwardmost edges or points 400E of the medial side part 430M and the lateral side part 430L do not extend as far forward as the central part 430C extends. Rather, as shown in FIG. 9A, the medial side part 430M and the lateral side part 430L in this illustrated example extend to a location rearward of the forwardmost edge or point 400E of the central part 430C. Each of the medial side part 430M and the lateral side part 430L in this illustrated example sole structure 104 has its forwardmost point or edge (400E) located rearward of a vertical plane located at 0.85 L along the longitudinal direction L of the sole structure 104 (measured forward from the rearmost heel point RH located at plane P=0 L). In some examples, either or both of these forwardmost points or edges 400E of the medial side part 430M and/or the lateral side part 430L may be rearward of a vertical plane located at 0.8 L or even rearward of a vertical plane located at 0.75 L (the forwardmost points or edges 400E of the medial side part 430M and the lateral side part 430L are located at a vertical plane located at 0.72 L in this illustrated example). If desired, one or more of the forwardmost edges or points 400E of the medial side part 430M and/or the lateral side part 430L may be located between vertical planes located at 0.55 L and 0.85 L, and in some examples, between vertical planes located at 0.6 L and 0.8 L or even between vertical planes located at 0.65 L and 0.75 L.

Figure 9G:
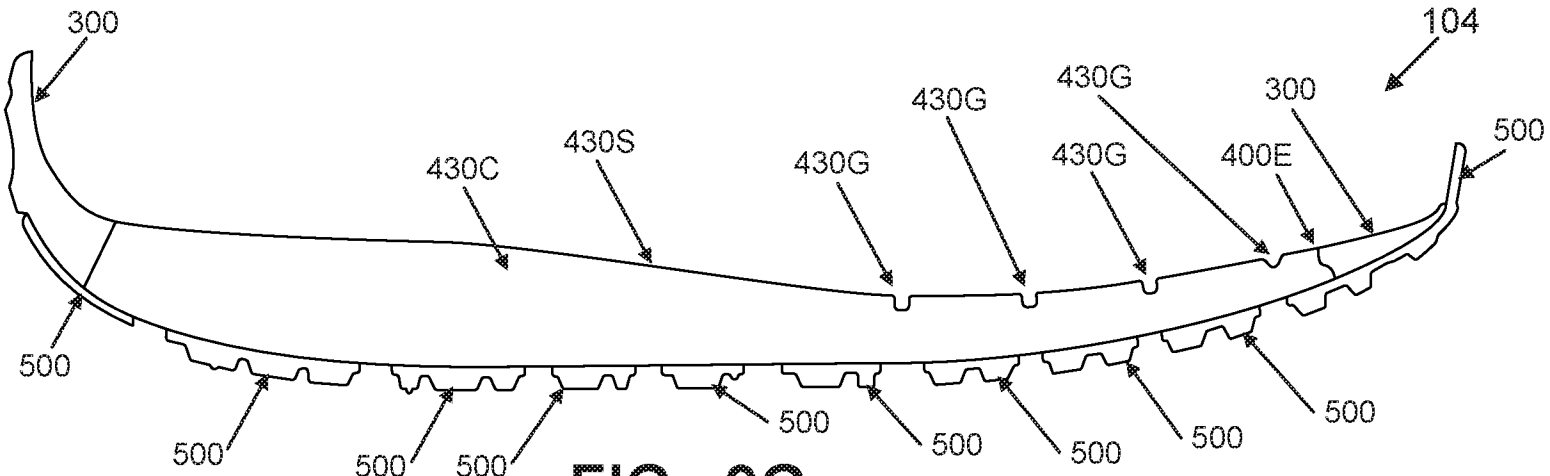
Figure 9I:
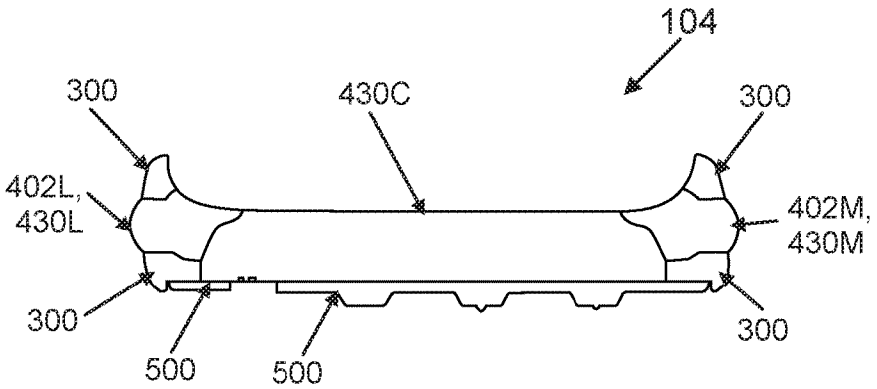
Figure 9H:
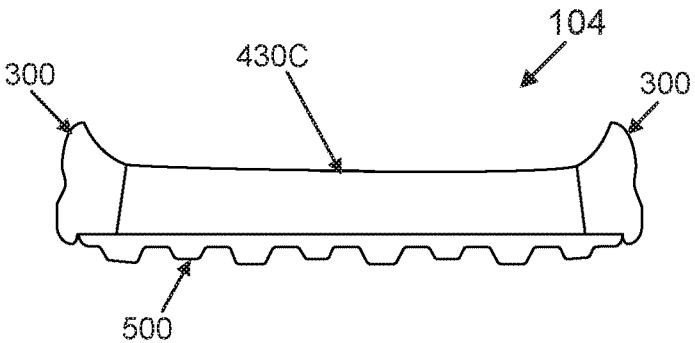
Figure 9K:
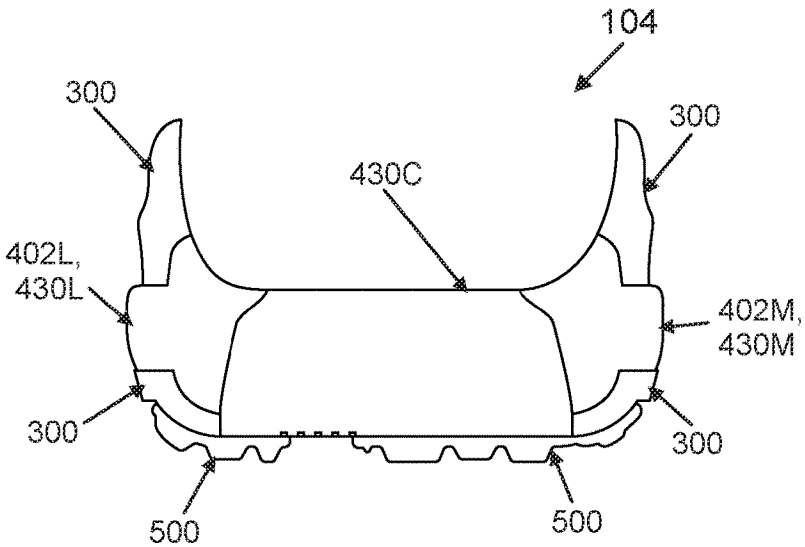
Figure 9J:
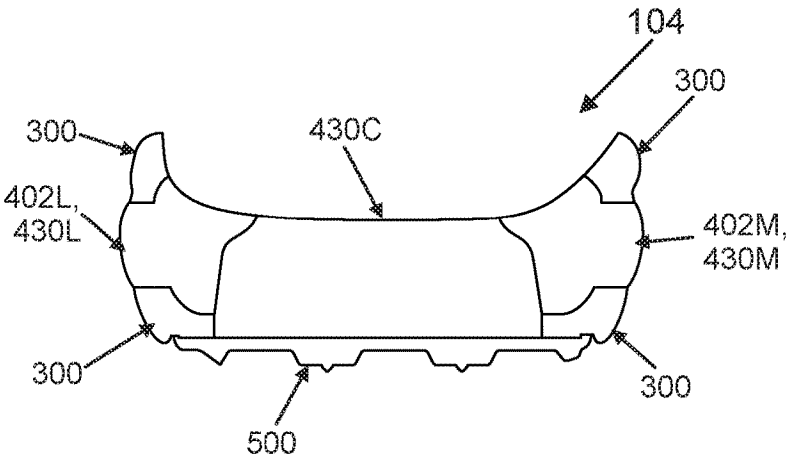

FIGS. 9A and 9G further show that the midsole core component 400 (and particularly central part 430C in this illustrated example) includes flex grooves 430G in its upper surface 430S. Any desired number and/or arrangement of flex grooves 430G may be provided without departing from this invention (e.g., including parallel grooves, curved grooves, intersecting grooves, a matrix of grooves, etc.). In this illustrated example sole structure 104, a plurality of flex grooves 430G are provided in a forefoot area of the central part 430C, and these plurality of flex grooves 430G extend generally in the transverse (e.g., lateral side-to-medial side direction). While four flex grooves 430G are shown in FIGS. 9A and 9G, any desired number could be provided (e.g., from 1 to 10). The plurality of flex grooves 430G in this specific example are arranged between vertical planes located at 0.5 L and 0.9 L (measured forward from the rearmost heel location RH of the sole structure 104 at P=0 L). These illustrated flex grooves 430G support flexion of the wearer's foot as weight transitions from the heel to the toe during a step cycle.

FIGS. 9C-9G further illustrate that this example sole structure 104 includes an upwardly extending heel region and an upwardly extending forefoot region (e.g., having its exterior bottom surface extending upward from a horizontal base surface on which the sole structure 104 is supported). Like the example sole structure shown in FIG. 7, in the example sole structure 104 of FIGS. 9A-9K, when moving rearward, the exterior bottom surface of the heel region begins curving upward toward the rear heel region. The upward and rearward curvature may begin at a location forward of a vertical plane located at 0.2 L, and even forward of a vertical plane located at 0.25 L, e.g., in the same manner as described above with respect to FIG. 7. Additionally or alternatively, as also shown in the example of FIG. 7, when moving forward, the exterior bottom surface of the forefoot region begins curving upward toward the forward toe region at a location rearward of a vertical plane located at 0.75 L, and even rearward of a vertical plane located at 0.65 L, e.g., in the same manner as described above with respect to FIG. 7. The sole structure 104 of FIGS. 9A-9K may have any of the more specific features and/or characteristics with respect to the heel curvature, toe curvature, "heel lift" and/or "heel/forefoot offset" as described above, e.g., with respect to FIG. 7.

FIGS. 9B and 9G-9K further show that the frame 300 of this illustrated example sole structure 104 does not include a complete and full bottom surface like surface 302S and/or 300B described above in conjunction with the frame 300 structure of FIGS. 3A-3D. Rather, the frame 300 of the example sole structure 104 of FIGS. 9A-9K includes a substantially open bottom, and the bottom of the central part 430C (and optionally, at least some of the bottom(s) of the medial side part 430M and/or the lateral side part 430L) forms a portion of the bottom of the sole structure 104 before the outsole component(s) 500 is (are) engaged with the frame 300 and midsole component 400. As shown in FIGS. 9G-9K, the frame 300 does include bottom surface: (a) located at the extreme forefoot area (e.g., forward of a vertical plane at 0.8 L or even forward of a vertical plane at 0.85 L), (b) located at the extreme rearfoot area (e.g., rearward of a vertical plane at 0.2 L or even rearward of a vertical plane at 0.15 L), and (c) located along the medial and/or lateral side edges of the sole structure 104 (e.g., beneath medial side part 430M and/or beneath lateral side part 430L). In at least some examples of this invention, less than 30% of the surface area of the bottom of combined frame 300 and midsole core component 400 will be formed by the bottom surface of the frame 300 (and in some examples, less than 25% or even less than 20% of the surface area of the bottom of the combined frame 300 and midsole core component 400 will constitute the bottom of frame 300). Conversely, at least 70% (or at least 75% or even at least 80%) of the surface area of the bottom of the combined frame 300 and midsole core component 400 will be formed by the bottom of the midsole core component 400 (e.g., by the bottom of the central part 430C or alternatively by the bottom of one or more of the central part 430C, the medial side part 430M, and/or the lateral side part 430L). Optionally, only the bottom of the central part 430C of the midsole core component 400 may be exposed in the opening of the bottom of the frame 300. As shown in FIGS. 9G-9K, in this illustrated example, the outsole component 500 is engaged with the bottom surfaces of the frame 300 and the central midsole core component 430C (and optionally does not directly connect and/or engage with medial side part 430M and/or lateral side part 430L). The absence of a substantial portion of the bottom surface of the frame 300 may help lighten the overall weight of the sole structure 104 (as the frame 300 typically is made from a denser and heavier material than midsole component 400) and/or improve sole flexibility.

FIG. 9B further illustrates that, in contrast to the sole structure 104 of FIGS. 1A-6D, the outsole component 500 of this illustrated example sole structure 104 is formed as a single part. Flex grooves 500G are defined in the outsole component 500 to enhance its flexibility. The flex grooves 500G may extend from the medial side to the lateral side of the sole structure 104. In the example of FIGS. 9B and 9G, complete through holes are defined over some portion of the outsole component 500 (e.g., in at least some of the outsole flex grooves 500G), and the bottom of at least the central part 430C of the midsole core component 400 is exposed in these openings. When such through holes are present in flex grooves 500G, the through holes may extend from 15% to 85% of the overall length of the groove 500G (and in some examples, from 25% to 75% or even from 30% to 70% of the overall groove 500G length).

As described above, various features of some example sole structures 104 and/or articles of footwear 100 in accordance with this invention provide structures that promote weight transfer of the foot and a comfortable feel/ride for the wearer. Some examples of this invention will include one or more features that help promote the desired function and feel. For example, some sole structures/articles of footwear in accordance with aspects of this invention will include one or more of:

(1) a gradual, continuous, rearward curvature (e.g., radiused curved) from: (a) a location forward of the 0.2 L plane (and in some examples from a location forward of the 0.26 L plane) to (b) the rear vertical tangent and/or rear end of the frame 300 and/or sole structure 104 (e.g., at point HR) to promote forward roll of the foot from the heel to the toe during a step cycle (e.g., as shown in FIG. 7);

(2) a gradual, continuous, forward curvature (e.g., radiused curved) from: (a) a location rearward of the 0.65 L plane (and in some examples from a location rearward of the 0.58 L plane) to (b) the forward end and/or vertical tangent of the sole structure 104 (e.g., at point HF) to also promote forward roll of the foot from the heel to the toe during a step cycle (e.g., as shown in FIG. 7);

(3) a deep heel cup formed at least in part by the frame 300 at the rear heel area; (e.g., the high heel sidewalls 302H with respect to the support surface and the heel plantar support surface (dimensions H1 and H2), as shown in FIGS. 2G and 2J);

(4) a forward extension (e.g., rake) of the rear heel area of the upper component 102/102*b* (e.g., as described above in conjunction with FIGS. 1A and 1B);

(5) elasticity/stretchability of the upper 102 in the heel containing region (e.g., to securely hold to the wearer's heel);

(6) "heel-to-toe offset" features of at least 10 mm (e.g., as described above);

(7) a bowed sole structure from medial side to lateral side (e.g., as described in conjunction with FIGS. 8A-8D); and/or (8) relatively thick heel and/or midfoot regions of the midsole core component 400 (e.g., as shown in FIG. 7).

One or more of these features can help securely hold the wearer's heel deep in a supportive heel cup, provide a comfortable ride/feel, and/or promote smooth weight transfer and transition over a wide variety of terrains (e.g., going uphill, downhill, on smooth ground, etc.).

III. Conclusion

Aspects and features of the present invention are disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

As some more specific examples, aspects of this invention relate at least to the subject matter described in the following numbered paragraphs ("Paras."):

[Para. 1.] A sole structure for an article of footwear, comprising:

a frame including a first sidewall having an outer surface and an inner surface opposite the outer surface, wherein a first opening is defined through the first sidewall extending from the outer surface to the inner surface; and an interior midsole component including a plantar support surface and a second sidewall that extends downwardly from the plantar support surface and along the inner surface of the first sidewall, wherein the interior midsole component further includes a first outwardly extending stem projecting sideways away from a base surface of the second sidewall, and wherein the first outwardly extending stem extends into the first opening beyond the inner surface of the first sidewall toward the outer surface of the first sidewall and has at least one feature selected from the group consisting of:

(a) the first outwardly extending stem extends into the first opening beyond the inner surface of the first sidewall at least to a location at or adjacent the outer surface of the first sidewall;

(b) the first outwardly extending stem has an exterior surface that is complementary shaped with respect to an interior surface of the first opening over at least 25% of an axial length of the first opening; or (c) a free end of the first outwardly extending stem extends outward beyond an outermost extent of the first opening.

[Para. 2.] The sole structure according to Para. 1, wherein:

the frame further includes a second opening defined through the first sidewall extending from the outer surface to the inner surface; and the interior midsole component further includes a second outwardly extending stem projecting sideways away from the base surface of the second sidewall, wherein the second outwardly extending stem extends into the second opening beyond the inner surface of the first sidewall toward the outer surface of the first sidewall and has at least one feature selected from the group consisting of:

(a) the second outwardly extending stem extends into the second opening beyond the inner surface of the first sidewall at least to a location at or adjacent the outer surface of the first sidewall;

(b) the second outwardly extending stem has an exterior surface that is complementary shaped with respect to an interior surface of the second opening over at least 25% of an axial length of the second opening; or (c) a free end of the second outwardly extending stem extends outward beyond an outermost extent of the second opening, optionally, wherein the interior midsole component is a multi-part component that includes: (a) a medial side part including the first outwardly extending stem and (b) a lateral side part including the second outwardly extending stem, wherein the lateral side part is an independent part from the medial side part, and further optionally, wherein the interior midsole component further includes a central part formed as an independent part from the lateral side part and the medial side part, wherein the central part extends between the lateral side part and the medial side part.

[Para. 3.] The sole structure according to Para. 2, wherein:

the frame further includes a third opening defined through the first sidewall extending from the outer surface to the inner surface; and the interior midsole component further includes a third outwardly extending stem projecting sideways away from the base surface of the second sidewall, wherein the third outwardly extending stem extends into the third opening beyond the inner surface of the first sidewall and has at least one feature selected from the group consisting of:

(a) the third outwardly extending stem extends into the third opening beyond the inner surface of the first sidewall at least to a location at or adjacent the outer surface of the first sidewall;

(b) the third outwardly extending stem has an exterior surface that is complementary shaped with respect to an interior surface of the third opening over at least 25% of an axial length of the third opening; or (c) a free end of the third outwardly extending stem extends outward beyond an outermost extent of the third opening.

[Para. 4.] The sole structure according to any one of Paras. 1 through 3, wherein the interior midsole component includes a foam midsole core component.

[Para. 5.] The sole structure according to any one of Paras. 1 through 3, wherein the interior midsole component includes a fluid-filled bladder.

[Para. 6.] A sole structure for an article of footwear, comprising:

a frame formed of a first polymer foam material, wherein the frame includes a first sidewall having an outer surface formed of the first polymer foam material and an inner surface formed of the first polymer foam material opposite the outer surface, and wherein a first opening is defined through the first sidewall extending from the outer surface to the inner surface; and an interior midsole component formed of a second polymer foam material, wherein the interior midsole component includes a plantar support surface and a second sidewall that extends downwardly from the plantar support surface and along the inner surface of the first sidewall, wherein the interior midsole component further includes a first outwardly extending stem formed of the second polymer foam material and projecting sideways away from a base surface of the second sidewall, and wherein the first outwardly extending stem extends into the first opening beyond the inner surface of the first sidewall and has at least one feature selected from the group consisting of:

(a) the first outwardly extending stem extends into the first opening beyond the inner surface of the first sidewall at least to a location at or adjacent the outer surface of the first sidewall;

(b) the first outwardly extending stem has an exterior surface that is complementary shaped with respect to an interior surface of the first opening over at least 25% of an axial length of the first opening; or (c) a free end of the first outwardly extending stem extends outward beyond an outermost extent of the first opening.

[Para. 7.] The sole structure according to Para. 6, wherein the first polymer foam material is the same as the second polymer foam material or wherein the first polymer foam material is different from the second polymer foam material.

[Para. 8.] The sole structure according to Para. 6, wherein the first polymer foam material has a first density, wherein the second polymer foam material has a second density, and wherein the first density is greater than the second density.

[Para. 9.] The sole structure according to Para. 6, wherein:

the frame further includes a second opening defined through the first sidewall extending from the outer surface to the inner surface; and the interior midsole component further includes a second outwardly extending stem formed of the second polymer foam material and projecting sideways away from the base surface of the second sidewall, wherein the second outwardly extending stem extends into the second opening beyond the inner surface of the first sidewall and has at least one feature selected from the group consisting of:

(a) the second outwardly extending stem extends into the second opening beyond the inner surface of the first sidewall at least to a location at or adjacent the outer surface of the first sidewall;

(b) the second outwardly extending stem has an exterior surface that is complementary shaped with respect to an interior surface of the second opening over at least 25% of an axial length of the second opening; or (c) a free end of the second outwardly extending stem extends outward beyond an outermost extent of the second opening.

[Para. 10.] The sole structure according to Para. 2 or Para. 9, wherein the first opening and the first outwardly extending stem are located on a medial side of the sole structure, and wherein the second opening and the second outwardly extending stem are located on the medial side of the sole structure forward of the first opening and the first outwardly extending stem.

[Para. 11.] The sole structure according to Para. 2 or Para. 9, wherein the first opening and the first outwardly extending stem are located on a medial side of the sole structure, and wherein the second opening and the second outwardly extending stem are located on a lateral side of the sole structure.

[Para. 12.] The sole structure according to Para. 2 or Para. 9, wherein the first opening and the first outwardly extending stem are located on one of a medial side or a lateral side of the sole structure, and wherein the second opening and the second outwardly extending stem are located on a rear heel side of the sole structure.

[Para. 13.] The sole structure according to Para. 2 or Para. 9, wherein a vertical cross sectional area of the first opening is larger than a vertical cross sectional area of the second opening, wherein a vertical cross sectional area of the first outwardly extending stem is larger than a vertical cross section area of the second outwardly extending stem, and wherein the vertical cross sectional areas of the openings and stems are determined with the sole structure supported on a horizontal base surface in an unloaded condition and with the vertical cross sectional plane extending across an axial direction of the respective opening or stem, and/or wherein a cross sectional area of the first opening is larger than a cross sectional area of the second opening, and wherein a cross sectional area of the first outwardly extending stem is larger than a cross section area of the second outwardly extending stem, wherein the cross sectional areas of the first opening, the second opening, the first outwardly extending stem, and the second outwardly extending stem are determined in a plane perpendicular to an axial direction of the respective opening or stem.

[Para. 14.] The sole structure according to any preceding Para., wherein the frame further includes a base support surface, and wherein the first sidewall extends upward from the base support surface, and wherein the interior midsole component is supported on the base support surface.

[Para. 15.] The sole structure according to Para. 14, wherein the first sidewall includes a medial sidewall region located on a medial side of the sole structure and a lateral sidewall region located on a lateral side of the sole structure, wherein the base support surface extends between and connects the medial sidewall region and the lateral sidewall region, and wherein the interior midsole component fits into a receptacle defined by the medial sidewall region, the lateral sidewall region, and the base support surface of the frame.

[Para. 16.] The sole structure according to Para. 15, wherein the first sidewall extends around at least one of a rear heel region of the sole structure or a forward toe region of the sole structure to connect the medial sidewall region and the lateral sidewall region as an integral, one-piece construction.

[Para. 17.] The sole structure according to any one of Paras. 1 through 14, wherein the first opening and the first outwardly extending stem are located in one of: a medial side edge of the sole structure, a lateral side edge of the sole structure, or a rear heel edge of the sole structure.

[Para. 18.] The sole structure according to any preceding Para., wherein the free end of the first outwardly extending stem extends through the first opening to a location beyond the outer surface of the first sidewall.

[Para. 19.] A sole structure for an article of footwear, comprising:

a medial sidewall region located on a medial side of the sole structure, wherein the medial sidewall region includes a medial outer surface and a medial inner surface, and wherein a first medial opening is defined through the medial sidewall region extending from the medial outer surface to the medial inner surface;

a lateral sidewall region located on a lateral side of the sole structure, wherein the lateral sidewall region includes a lateral outer surface and a lateral inner surface, and wherein a first lateral opening is defined through the lateral sidewall region extending from the lateral outer surface to the lateral inner surface;

a medial interior midsole sidewall that includes an outwardly extending medial stem projecting sideways away from a base surface of the medial interior midsole sidewall, wherein the outwardly extending medial stem extends into the first medial opening beyond the medial inner surface of the medial sidewall region and has at least one feature selected from the group consisting of:

(a) the outwardly extending medial stem extends into the first medial opening beyond the medial inner surface of the medial sidewall region at least to a location at or adjacent the medial outer surface of the medial sidewall region;

(b) the outwardly extending medial stem has an exterior surface that is complementary shaped with respect to an interior surface of the first medial opening over at least 25% of an axial length of the first medial opening; or (c) a free end of the outwardly extending medial stem extends outward beyond an outermost extent of the first medial opening; and a lateral interior midsole sidewall that includes an outwardly extending lateral stem projecting sideways away from a base surface of the lateral interior midsole sidewall, wherein the outwardly extending lateral stem extends into the first lateral opening beyond the lateral inner surface of the lateral sidewall region and has at least one feature selected from the group consisting of:

(a) the outwardly extending lateral stem extends into the lateral opening beyond the lateral inner surface of the lateral sidewall region at least to a location at or adjacent the lateral outer surface of the lateral sidewall region;

(b) the outwardly extending lateral stem has an exterior surface that is complementary shaped with respect to an interior surface of the first lateral opening over at least 25% of an axial length of the first lateral opening; or (c) a free end of the outwardly extending lateral stem extends outward beyond an outermost extent of the first lateral opening.

[Para. 20.] The sole structure according to Para. 19, wherein the medial sidewall region and the lateral sidewall region are integrally formed as parts of a unitary, one-piece frame.

[Para. 21.] The sole structure according to Para. 19 or Para. 20, wherein a base support surface connects the medial sidewall region and the lateral sidewall region.

[Para. 22.] The sole structure according to Para. 19, wherein the medial sidewall region is formed as a portion of a first frame component and the lateral sidewall region is formed as a portion of a second frame component that is a separate part from the first frame component.

[Para. 23.] The sole structure according to any one of Paras. 19 through 22, wherein the medial interior midsole sidewall and the lateral interior midsole sidewall are integrally formed as parts of a unitary, one-piece foam midsole component construction.

[Para. 24.] The sole structure according to Para. 23, wherein a plantar support surface connects the medial interior midsole sidewall and the lateral interior midsole sidewall.

[Para. 25.] The sole structure according to any one of Paras. 19 through 22, wherein the medial interior midsole sidewall is formed as a portion of a first interior midsole component and the lateral interior midsole sidewall is formed as a portion of a second interior midsole component that is a separate part from the first interior midsole component, and optionally, wherein a central midsole part extends between (and optionally directly engages and/or connects with either or both of) the first interior midsole component and the second interior midsole component.

[Para. 26.] A sole structure for an article of footwear, comprising:

a medial sidewall region located on a medial side of the sole structure, wherein the medial sidewall region includes a medial outer surface and a medial inner surface, and wherein a first medial opening, a second medial opening, and a third medial opening are defined through the medial sidewall region extending from the medial outer surface to the medial inner surface;

a lateral sidewall region located on a lateral side of the sole structure, wherein the lateral sidewall region includes a lateral outer surface and a lateral inner surface, and wherein a first lateral opening, a second lateral opening, and a third lateral opening are defined through the lateral sidewall region extending from the lateral outer surface to the lateral inner surface;

a medial interior midsole sidewall that includes a first outwardly extending medial stem, a second outwardly extending medial stem, and a third outwardly extending medial stem projecting sideways away from a base surface of the medial interior midsole sidewall, wherein the first outwardly extending medial stem extends into the first medial opening beyond the medial inner surface of the medial sidewall region and has at least one feature selected from the group consisting of:

(a) the first outwardly extending medial stem extends into the first medial opening beyond the medial inner surface of the medial sidewall region at least to a location at or adjacent the medial outer surface of the medial sidewall region, (b) the first outwardly extending medial stem has an exterior surface that is complementary shaped with respect to an interior surface of the first medial opening over at least 25% of an axial length of the first medial opening, or (c) a free end of the first outwardly extending medial stem extends outward beyond an outermost extent of the first medial opening, wherein the second outwardly extending medial stem extends into the second medial opening beyond the medial inner surface of the medial sidewall region and has at least one feature selected from the group consisting of:

(a) the second outwardly extending medial stem extends into the second medial opening beyond the medial inner surface of the medial sidewall region at least to a location at or adjacent the medial outer surface of the medial sidewall region, (b) the second outwardly extending medial stem has an exterior surface that is complementary shaped with respect to an interior surface of the second medial opening over at least 25% of an axial length of the second medial opening, or (c) a free end of the second outwardly extending medial stem extends outward beyond an outermost extent of the second medial opening, wherein the third outwardly extending medial stem extends into the third medial opening beyond the medial inner surface of the medial sidewall region and has at least one feature selected from the group consisting of:

(a) the third outwardly extending medial stem extends into the third medial opening beyond the medial inner surface of the medial sidewall region at least to a location at or adjacent the medial outer surface of the medial sidewall region, (b) the third outwardly extending medial stem has an exterior surface that is complementary shaped with respect to an interior surface of the third medial opening over at least 25% of an axial length of the third medial opening, or (c) a free end of the third outwardly extending medial stem extends outward beyond an outermost extent of the third medial opening; and a lateral interior midsole sidewall that includes a first outwardly extending lateral stem, a second outwardly extending lateral stem, and a third outwardly extending lateral stem projecting sideways away from a base surface of the lateral interior midsole sidewall, wherein the first outwardly extending lateral stem extends into the first lateral opening beyond the lateral inner surface of the lateral sidewall region and has at least one feature selected from the group consisting of:

(a) the first outwardly extending lateral stem extends into the first lateral opening beyond the lateral inner surface of the lateral sidewall region at least to a location at or adjacent the lateral outer surface of the lateral sidewall region, (b) the first outwardly extending lateral stem has an exterior surface that is complementary shaped with respect to an interior surface of the first lateral opening over at least 25% of an axial length of the first lateral opening, or (c) a free end of the first outwardly extending lateral stem extends outward beyond an outermost extent of the first lateral opening, wherein the second outwardly extending lateral stem extends into the second lateral opening beyond the lateral inner surface of the lateral sidewall region and has at least one feature selected from the group consisting of:

(a) the second outwardly extending lateral stem extends into the second lateral opening beyond the lateral inner surface of the lateral sidewall region at least to a location at or adjacent the lateral outer surface of the lateral sidewall region, (b) the second outwardly extending lateral stem has an exterior surface that is complementary shaped with respect to an interior surface of the second lateral opening over at least 25% of an axial length of the second lateral opening, or (c) a free end of the second outwardly extending lateral stem extends outward beyond an outermost extent of the second lateral opening, and wherein the third outwardly extending lateral stem extends into the third lateral opening beyond the lateral inner surface of the lateral sidewall region and has at least one feature selected from the group consisting of:

(a) the third outwardly extending lateral stem extends into the third lateral opening beyond the lateral inner surface of the lateral sidewall region at least to a location at or adjacent the lateral outer surface of the lateral sidewall region, (b) the third outwardly extending lateral stem has an exterior surface that is complementary shaped with respect to an interior surface of the third lateral opening over at least 25% of an axial length of the third lateral opening, or (c) a free end of the third outwardly extending lateral stem extends outward beyond an outermost extent of the third lateral opening.

[Para. 27.] The sole structure according to Para. 26, wherein the third medial opening is located forward of the second medial opening in the sole structure, wherein the second medial opening is located forward of the first medial opening in the sole structure, wherein the third lateral opening is located forward of the second lateral opening in the sole structure, and wherein the second lateral opening is located forward of the first lateral opening in the sole structure.

[Para. 28.] The sole structure according to Para. 27, wherein a vertical cross sectional area of the first medial opening is larger than a vertical cross sectional area of the second medial opening, wherein the vertical cross sectional area of the second medial opening is larger than a vertical cross sectional area of the third medial opening, wherein a vertical cross sectional area of the first outwardly extending medial stem is larger than a vertical cross sectional area of the second outwardly extending medial stem, wherein the vertical cross sectional area of the second outwardly extending medial stem is larger than a vertical cross sectional area of the third outwardly extending medial stem, and wherein the vertical cross sectional areas of the openings and stems are determined with the sole structure supported on a horizontal base surface in an unloaded condition and with the vertical cross sectional plane extending across an axial direction of the respective opening or stem, and/or wherein a cross sectional area of the first medial opening is larger than a cross sectional area of the second medial opening, wherein the cross sectional area of the second medial opening is larger than a cross sectional area of the third medial opening, wherein a cross sectional area of the first outwardly extending medial stem is larger than a cross sectional area of the second outwardly extending medial stem, wherein the cross sectional area of the second outwardly extending medial stem is larger than a cross sectional area of the third outwardly extending medial stem, and wherein the cross sectional areas of the openings and stems are determined in a plane perpendicular to an axial direction of the respective opening or stem.

[Para. 29.] The sole structure according to Para. 27 or 28, wherein a vertical cross sectional area of the first lateral opening is larger than a vertical cross sectional area of the second lateral opening, wherein the vertical cross sectional area of the second lateral opening is larger than a vertical cross sectional area of the third lateral opening, wherein a vertical cross sectional area of the first outwardly extending lateral stem is larger than a vertical cross sectional area of the second outwardly extending lateral stem, wherein the vertical cross sectional area of the second outwardly extending lateral stem is larger than a vertical cross sectional area of the third outwardly extending lateral stem, and wherein the vertical cross sectional areas of the openings and stems are determined with the sole structure supported on a horizontal base surface in an unloaded condition and with the vertical cross sectional plane extending across an axial direction of the respective opening or stem, and/or wherein a cross sectional area of the first lateral opening is larger than a cross sectional area of the second lateral opening, wherein the cross sectional area of the second lateral opening is larger than a cross sectional area of the third lateral opening, wherein a cross sectional area of the first outwardly extending lateral stem is larger than a cross sectional area of the second outwardly extending lateral stem, wherein the cross sectional area of the second outwardly extending lateral stem is larger than a cross sectional area of the third outwardly extending lateral stem, and wherein the cross sectional areas of the openings and stems are determined in a plane perpendicular to an axial direction of the respective opening or stem.

[Para. 30.] The sole structure according to Para. 27, wherein a vertical cross sectional area of the first medial opening is smaller than a vertical cross sectional area of the second medial opening, wherein the vertical cross sectional area of the second medial opening is larger than a vertical cross sectional area of the third medial opening, wherein a vertical cross sectional area of the first outwardly extending medial stem is smaller than a vertical cross sectional area of the second outwardly extending medial stem, wherein the vertical cross sectional area of the second outwardly extending medial stem is larger than a vertical cross sectional area of the third outwardly extending medial stem, and wherein the vertical cross sectional areas of the openings and stems are determined with the sole structure supported on a horizontal base surface in an unloaded condition and with the vertical cross sectional plane extending across an axial direction of the respective opening or stem, and/or wherein a cross sectional area of the first medial opening is smaller than a cross sectional area of the second medial opening, wherein the cross sectional area of the second medial opening is larger than a cross sectional area of the third medial opening, wherein a cross sectional area of the first outwardly extending medial stem is smaller than a cross sectional area of the second outwardly extending medial stem, wherein the cross sectional area of the second outwardly extending medial stem is larger than a cross sectional area of the third outwardly extending medial stem, and wherein the cross sectional areas of the openings and stems are determined in a plane perpendicular to an axial direction of the respective opening or stem.

[Para. 31.] The sole structure according to Para. 27 or 30, wherein a vertical cross sectional area of the first lateral opening is smaller than a vertical cross sectional area of the second lateral opening, wherein the vertical cross sectional area of the second lateral opening is larger than a vertical cross sectional area of the third lateral opening, wherein a vertical cross sectional area of the first outwardly extending lateral stem is smaller than a vertical cross sectional area of the second outwardly extending lateral stem, wherein the vertical cross sectional area of the second outwardly extending lateral stem is larger than a vertical cross sectional area of the third outwardly extending lateral stem, and wherein the vertical cross sectional areas of the openings and stems are determined with the sole structure supported on a horizontal base surface in an unloaded condition and with the vertical cross sectional plane extending across an axial direction of the respective opening or stem, and/or wherein a cross sectional area of the first lateral opening is smaller than a cross sectional area of the second lateral opening, wherein the cross sectional area of the second lateral opening is larger than a cross sectional area of the third lateral opening, wherein a cross sectional area of the first outwardly extending lateral stem is smaller than a cross sectional area of the second outwardly extending lateral stem, wherein the cross sectional area of the second outwardly extending lateral stem is larger than a cross sectional area of the third outwardly extending lateral stem, and wherein the cross sectional areas of the openings and stems are determined in a plane perpendicular to an axial direction of the respective opening or stem.

[Para. 32.] The sole structure according to Para. 27, wherein a fourth medial opening is defined through the medial sidewall region extending from the medial outer surface to the medial inner surface, wherein the fourth medial opening is located forward of the third medial opening, and wherein the medial interior midsole sidewall includes a fourth outwardly extending medial stem that extends into the fourth medial opening beyond the medial inner surface of the medial sidewall region and has at least one feature selected from the group consisting of:

(a) the fourth outwardly extending medial stem extends into the fourth medial opening beyond the medial inner surface of the medial sidewall region at least to a location at or adjacent the medial outer surface of the medial sidewall region, (b) the fourth outwardly extending medial stem has an exterior surface that is complementary shaped with respect to an interior surface of the fourth medial opening over at least 25% of an axial length of the fourth medial opening, or (c) a free end of the fourth outwardly extending medial stem extends outward beyond an outermost extent of the fourth medial opening.

[Para. 33.] The sole structure according to Para.32, wherein a fifth medial opening is defined through the medial sidewall region extending from the medial outer surface to the medial inner surface, wherein the fifth medial opening is located forward of the fourth medial opening, and wherein the medial interior midsole sidewall includes a fifth outwardly extending medial stem that extends into the fifth medial opening beyond the medial inner surface of the medial sidewall region and has at least one feature selected from the group consisting of:

(a) the fifth outwardly extending medial stem extends into the fifth medial opening beyond the medial inner surface of the medial sidewall region at least to a location at or adjacent the medial outer surface of the medial sidewall region, (b) the fifth outwardly extending medial stem has an exterior surface that is complementary shaped with respect to an interior surface of the fifth medial opening over at least 25% of an axial length of the fifth medial opening, or (c) a free end of the fifth outwardly extending medial stem extends outward beyond an outermost extent of the fifth medial opening.

[Para. 34.] The sole structure according to Para. 33, wherein a sixth medial opening is defined through the medial sidewall region extending from the medial outer surface to the medial inner surface, wherein the sixth medial opening is located forward of the fifth medial opening, and wherein the medial interior midsole sidewall includes a sixth outwardly extending medial stem that extends into the sixth medial opening beyond the medial inner surface of the medial sidewall region and has at least one feature selected from the group consisting of:

(a) the sixth outwardly extending medial stem extends into the sixth medial opening beyond the medial inner surface of the medial sidewall region at least to a location at or adjacent the medial outer surface of the medial sidewall region, (b) the sixth outwardly extending medial stem has an exterior surface that is complementary shaped with respect to an interior surface of the sixth medial opening over at least 25% of an axial length of the sixth medial opening, or (c) a free end of the sixth outwardly extending medial stem extends outward beyond an outermost extent of the sixth medial opening.

[Para. 35.] The sole structure according to Para. 34, wherein a seventh medial opening is defined through the medial sidewall region extending from the medial outer surface to the medial inner surface, wherein the seventh medial opening is located forward of the sixth medial opening, and wherein the medial interior midsole sidewall includes a seventh outwardly extending medial stem that extends into the seventh medial opening beyond the medial inner surface of the medial sidewall region and has at least one feature selected from the group consisting of:

(a) the seventh outwardly extending medial stem extends into the seventh medial opening beyond the medial inner surface of the medial sidewall region at least to a location at or adjacent the medial outer surface of the medial sidewall region, (b) the seventh outwardly extending medial stem has an exterior surface that is complementary shaped with respect to an interior surface of the seventh medial opening over at least 25% of an axial length of the seventh medial opening, or (c) a free end of the seventh outwardly extending medial stem extends outward beyond an outermost extent of the seventh medial opening.

[Para. 36.] The sole structure according to Para. 35, wherein an eighth medial opening is defined through the medial sidewall region extending from the medial outer surface to the medial inner surface, wherein the eighth medial opening is located forward of the seventh medial opening, and wherein the medial interior midsole sidewall includes an eighth outwardly extending medial stem that extends into the eighth medial opening beyond the medial inner surface of the medial sidewall region and has at least one feature selected from the group consisting of:

(a) the eighth outwardly extending medial stem extends into the eighth medial opening beyond the medial inner surface of the medial sidewall region at least to a location at or adjacent the medial outer surface of the medial sidewall region, (b) the eighth outwardly extending medial stem has an exterior surface that is complementary shaped with respect to an interior surface of the eighth medial opening over at least 25% of an axial length of the eighth medial opening, or (c) a free end of the eighth outwardly extending medial stem extends outward beyond an outermost extent of the eighth medial opening.

[Para. 37.] The sole structure according to Para. 36, wherein a ninth medial opening is defined through the medial sidewall region extending from the medial outer surface to the medial inner surface, wherein the ninth medial opening is located forward of the eighth medial opening, and wherein the medial interior midsole sidewall includes a ninth outwardly extending medial stem that extends into the ninth medial opening beyond the medial inner surface of the medial sidewall region and has at least one feature selected from the group consisting of:

(a) the ninth outwardly extending medial stem extends into the ninth medial opening beyond the medial inner surface of the medial sidewall region at least to a location at or adjacent the medial outer surface of the medial sidewall region, (b) the ninth outwardly extending medial stem has an exterior surface that is complementary shaped with respect to an interior surface of the ninth medial opening over at least 25% of an axial length of the ninth medial opening, or (c) a free end of the ninth outwardly extending medial stem extends outward beyond an outermost extent of the ninth medial opening.

[Para. 38.] The sole structure according to any one of Paras. 26 through 37, wherein a fourth lateral opening is defined through the lateral sidewall region extending from the lateral outer surface to the lateral inner surface, wherein the fourth lateral opening is located forward of the third lateral opening, and wherein the lateral interior midsole sidewall includes a fourth outwardly extending lateral stem that extends into the fourth lateral opening beyond the lateral inner surface of the lateral sidewall region and has at least one feature selected from the group consisting of:

(a) the fourth outwardly extending lateral stem extends into the fourth lateral opening beyond the lateral inner surface of the lateral sidewall region at least to a location at or adjacent the lateral outer surface of the lateral sidewall region, (b) the fourth outwardly extending lateral stem has an exterior surface that is complementary shaped with respect to an interior surface of the fourth lateral opening over at least 25% of an axial length of the fourth lateral opening, or (c) a free end of the fourth outwardly extending lateral stem extends outward beyond an outermost extent of the fourth lateral opening.

[Para. 39.] The sole structure according to Para. 38, wherein a fifth lateral opening is defined through the lateral sidewall region extending from the lateral outer surface to the lateral inner surface, wherein the fifth lateral opening is located forward of the fourth lateral opening, and wherein the lateral interior midsole sidewall includes a fifth outwardly extending lateral stem that extends into the fifth lateral opening beyond the lateral inner surface of the lateral sidewall region and has at least one feature selected from the group consisting of:

(a) the fifth outwardly extending lateral stem extends into the fifth lateral opening beyond the lateral inner surface of the lateral sidewall region at least to a location at or adjacent the lateral outer surface of the lateral sidewall region, (b) the fifth outwardly extending lateral stem has an exterior surface that is complementary shaped with respect to an interior surface of the fifth lateral opening over at least 25% of an axial length of the fifth lateral opening, or (c) a free end of the fifth outwardly extending lateral stem extends outward beyond an outermost extent of the fifth lateral opening.

[Para. 40.] The sole structure according to Para. 39, wherein a sixth lateral opening is defined through the lateral sidewall region extending from the lateral outer surface to the lateral inner surface, wherein the sixth lateral opening is located forward of the fifth lateral opening, and wherein the lateral interior midsole sidewall includes a sixth outwardly extending lateral stem that extends into the sixth lateral opening beyond the lateral inner surface of the lateral sidewall region and has at least one feature selected from the group consisting of:

(a) the sixth outwardly extending lateral stem extends into the sixth lateral opening beyond the lateral inner surface of the lateral sidewall region at least to a location at or adjacent the lateral outer surface of the lateral sidewall region, (b) the sixth outwardly extending lateral stem has an exterior surface that is complementary shaped with respect to an interior surface of the sixth lateral opening over at least 25% of an axial length of the sixth lateral opening, or (c) a free end of the sixth outwardly extending lateral stem extends outward beyond an outermost extent of the sixth lateral opening.

[Para. 41.] The sole structure according to Para. 40, wherein a seventh lateral opening is defined through the lateral sidewall region extending from the lateral outer surface to the lateral inner surface, wherein the seventh lateral opening is located forward of the sixth lateral opening, and wherein the lateral interior midsole sidewall includes a seventh outwardly extending lateral stem that extends into the seventh lateral opening beyond the lateral inner surface of the lateral sidewall region and has at least one feature selected from the group consisting of:

(a) the seventh outwardly extending lateral stem extends into the seventh lateral opening beyond the lateral inner surface of the lateral sidewall region at least to a location at or adjacent the lateral outer surface of the lateral sidewall region, (b) the seventh outwardly extending lateral stem has an exterior surface that is complementary shaped with respect to an interior surface of the seventh lateral opening over at least 25% of an axial length of the seventh lateral opening, or (c) a free end of the seventh outwardly extending lateral stem extends outward beyond an outermost extent of the seventh lateral opening.

[Para. 42.] The sole structure according to Para. 41, wherein an eighth lateral opening is defined through the lateral sidewall region extending from the lateral outer surface to the lateral inner surface, wherein the eighth lateral opening is located forward of the seventh lateral opening, and wherein the lateral interior midsole sidewall includes an eighth outwardly extending lateral stem that extends into the eighth lateral opening beyond the lateral inner surface of the lateral sidewall region and has at least one feature selected from the group consisting of:

(a) the eighth outwardly extending lateral stem extends into the eighth lateral opening beyond the lateral inner surface of the lateral sidewall region at least to a location at or adjacent the lateral outer surface of the lateral sidewall region, (b) the eighth outwardly extending lateral stem has an exterior surface that is complementary shaped with respect to an interior surface of the eighth lateral opening over at least 25% of an axial length of the eighth lateral opening, or (c) a free end of the eighth outwardly extending lateral stem extends outward beyond an outermost extent of the eighth lateral opening.

[Para. 43.] The sole structure according to Para. 42, wherein a ninth lateral opening is defined through the lateral sidewall region extending from the lateral outer surface to the lateral inner surface, wherein the ninth lateral opening is located forward of the eighth lateral opening, and wherein the lateral interior midsole sidewall includes a ninth outwardly extending lateral stem that extends into the ninth lateral opening beyond the lateral inner surface of the lateral sidewall region and has at least one feature selected from the group consisting of:

(a) the ninth outwardly extending lateral stem extends into the ninth lateral opening beyond the lateral inner surface of the lateral sidewall region at least to a location at or adjacent the lateral outer surface of the lateral sidewall region, (b) the ninth outwardly extending lateral stem has an exterior surface that is complementary shaped with respect to an interior surface of the ninth lateral opening over at least 25% of an axial length of the ninth lateral opening, or (c) a free end of the ninth outwardly extending lateral stem extends outward beyond an outermost extent of the ninth lateral opening.

[Para. 44] The sole structure according to one of Paras. 19 to 43, wherein the medial interior midsole sidewall is formed on a medial midsole side part, wherein the lateral interior midsole sidewall is formed on a lateral midsole side part, and wherein the medial midsole side part is an independent and separate part from the lateral midsole side part.

[Para. 45] The sole structure according to Para. 44, wherein a central midsole part extends between the medial midsole side part and the lateral midsole side part, and wherein the central midsole part is an independent and separate part from the medial midsole side part and the lateral midsole side part.

[Para. 46.] An article of footwear, comprising:

an upper; and a sole structure according to any preceding Para. engaged with the upper.

[Para. 47.] The article of footwear according to Para. 46, wherein a rear heel region of the upper extends forward from a rearmost heel region of the frame toward a forefoot region of the article of footwear.

[Para. 48.] The article of footwear according to Para. 47, wherein a rearmost heel surface of the rear heel region of the upper has a concave curvature moving in a direction from the frame toward a top edge of the rear heel region.

[Para. 49.] The article of footwear according to Para. 46 or 47, wherein, with the article of footwear supported on its sole structure on a horizontal support surface, the rear heel region of the upper extends forward from the rearmost heel region of the frame toward the forefoot region of the article of footwear at an angle of at least 20° from a vertical plane.

What is claimed is:

1. A sole structure for an article of footwear, comprising:

a frame including a first sidewall having an outer surface and an inner surface opposite the outer surface, wherein a first opening is defined through the first sidewall, and wherein the first opening includes a first interior surface extending from the outer surface to the inner surface; and an interior midsole component directly attached to the frame by an adhesive or cement, wherein the interior midsole component includes a plantar support surface and a second sidewall that extends downwardly from the plantar support surface and along the inner surface of the first sidewall, wherein the interior midsole component further includes a first outwardly extending stem projecting sideways away from a base surface of the second sidewall, wherein the first outwardly extending stem extends into the first opening beyond the inner surface of the first sidewall toward the outer surface of the first sidewall, wherein the first outwardly extending stem includes a first exterior surface, wherein at least a portion of an axial length of the first exterior surface of the first outwardly extending stem extends along, is unfixed to, and is movable with respect to the first interior surface of the first opening, and wherein the first outwardly extending stem has at least one feature selected from the group consisting of:

(a) the first outwardly extending stem extends into the first opening beyond the inner surface of the first sidewall at least to a location at or adjacent the outer surface of the first sidewall;

(b) the first exterior surface of the first outwardly extending stem is complementary shaped with respect to the first interior surface of the first opening over at least 25% of an axial length of the first opening; or (c) a free end of the first outwardly extending stem extends outward beyond an outermost extent of the first opening.

2. The sole structure according to claim 1, wherein:

the frame further includes a second opening defined through the first sidewall, wherein the second opening includes a second interior surface extending from the outer surface to the inner surface; and the interior midsole component further includes a second outwardly extending stem projecting sideways away from the base surface of the second sidewall, wherein the second outwardly extending stem extends into the second opening beyond the inner surface of the first sidewall toward the outer surface of the first sidewall, wherein the second outwardly extending stem includes a second exterior surface, wherein at least a portion of an axial length of the second exterior surface of the second outwardly extending stem extends along, is unfixed to, and is movable with respect to the second interior surface of the second opening, and wherein the second outwardly extending stem has at least one feature selected from the group consisting of:

(a) the second outwardly extending stem extends into the second opening beyond the inner surface of the first sidewall at least to a location at or adjacent the outer surface of the first sidewall;

(b) the second exterior surface of the second outwardly extending stem is complementary shaped with respect to the second interior surface of the second opening over at least 25% of an axial length of the second opening; or (c) a free end of the second outwardly extending stem extends outward beyond an outermost extent of the second opening.

3. The sole structure according to claim 2, wherein:

the frame further includes a third opening defined through the first sidewall, wherein the third opening includes a third interior surface extending from the outer surface to the inner surface; and the interior midsole component further includes a third outwardly extending stem projecting sideways away from the base surface of the second sidewall, wherein the third outwardly extending stem extends into the third opening beyond the inner surface of the first sidewall, wherein the third outwardly extending stem includes a third exterior surface, wherein at least a portion of an axial length of the third exterior surface of the third outwardly extending stem extends along, is unfixed to, and is movable with respect to the third interior surface of the third opening, and wherein the third outwardly extending stem has at least one feature selected from the group consisting of:

(a) the third outwardly extending stem extends into the third opening beyond the inner surface of the first sidewall at least to a location at or adjacent the outer surface of the first sidewall;

(b) the third exterior surface of the third outwardly extending stem is complementary shaped with respect to the third interior surface of the third opening over at least 25% of an axial length of the third opening; or (c) a free end of the third outwardly extending stem extends outward beyond an outermost extent of the third opening.

4. The sole structure according to claim 2, wherein the interior midsole component is a multi-part component that includes: (a) a medial side part including the first outwardly extending stem and (b) a lateral side part including the second outwardly extending stem, wherein the lateral side part is an independent part from the medial side part.

5. The sole structure according to claim 4, wherein the interior midsole component further includes a central part formed as an independent part from the lateral side part and the medial side part, wherein the central part extends between the lateral side part and the medial side part.

6. The sole structure according to claim 1:

wherein the frame, including the outer surface and the inner surface thereof, is formed of a first polymer foam material;

wherein the interior midsole component, including the first outwardly extending stem thereof, is formed of a second polymer foam material; and wherein the first polymer foam material has a first density, wherein the second polymer foam material has a second density, and wherein the first density is greater than the second density.

7. The sole structure according to claim 6, wherein:

the frame further includes a second opening defined through the first sidewall, wherein the second opening includes a second interior surface extending from the outer surface to the inner surface; and the interior midsole component further includes a second outwardly extending stem formed of the second polymer foam material and projecting sideways away from the base surface of the second sidewall, wherein the second outwardly extending stem extends into the second opening beyond the inner surface of the first sidewall, wherein the second outwardly extending stem includes a second exterior surface, wherein at least a portion of an axial length of the second exterior surface of the second outwardly extending stem extends along, is unfixed to, and is movable with respect to the second interior surface of the second opening, and wherein the second outwardly extending stem has at least one feature selected from the group consisting of:

(a) the second outwardly extending stem extends into the second opening beyond the inner surface of the first sidewall at least to a location at or adjacent the outer surface of the first sidewall;

(b) the second exterior surface of the second outwardly extending stem is complementary shaped with respect to the second interior surface of the second opening over at least 25% of an axial length of the second opening; or (c) a free end of the second outwardly extending stem extends outward beyond an outermost extent of the second opening.

8. The sole structure according to claim 7, wherein the first opening and the first outwardly extending stem are located on a medial side of the sole structure, and wherein the second opening and the second outwardly extending stem are located on the medial side of the sole structure forward of the first opening and the first outwardly extending stem.

9. The sole structure according to claim 7, wherein the first opening and the first outwardly extending stem are located on a medial side of the sole structure, and wherein the second opening and the second outwardly extending stem are located on a lateral side of the sole structure.

10. The sole structure according to claim 7, wherein a cross sectional area of the first opening is larger than a cross sectional area of the second opening, and wherein a cross sectional area of the first outwardly extending stem is larger than a cross section area of the second outwardly extending stem, wherein the cross sectional areas of the first opening, the second opening, the first outwardly extending stem, and the second outwardly extending stem are determined in a plane perpendicular to an axial direction of the respective opening or stem.

11. The sole structure according to claim 1, wherein the frame further includes a base support surface, wherein the first sidewall extends upward from the base support surface, and wherein the interior midsole component is supported on the base support surface.

12. The sole structure according to claim 11, wherein the first sidewall includes a medial sidewall region located on a medial side of the sole structure and a lateral sidewall region located on a lateral side of the sole structure, wherein the base support surface extends between and connects the medial sidewall region and the lateral sidewall region, and wherein the interior midsole component fits into a receptacle defined by the medial sidewall region, the lateral sidewall region, and the base support surface of the frame.

13. The sole structure according to claim 1, wherein the free end of the first outwardly extending stem extends through the first opening to a location beyond the outer surface of the first sidewall.

14. The sole structure according to claim 1, wherein the frame, including the outer surface and the inner surface thereof, is formed of a first polymer foam material, wherein the interior midsole component, including the first outwardly extending stem thereof, is formed of a second polymer foam material, and wherein the first polymer foam material is different from the second polymer foam material.

15. A sole structure for an article of footwear, comprising:

a frame including:

(a) a medial sidewall region located on a medial side of the sole structure, wherein the medial sidewall region includes a medial outer surface and a medial inner surface, wherein a first medial opening is defined through the medial sidewall region, and wherein the first medial opening includes an interior medial surface extending from the medial outer surface to the medial inner surface, and (b) a lateral sidewall region located on a lateral side of the sole structure, wherein the lateral sidewall region includes a lateral outer surface and a lateral inner surface, wherein a first lateral opening is defined through the lateral sidewall region, and wherein the first lateral opening includes an interior lateral surface extending from the lateral outer surface to the lateral inner surface;

a medial interior midsole sidewall directly attached to the frame by an adhesive or cement, wherein the medial interior midsole sidewall includes an outwardly extending medial stem projecting sideways away from a base surface of the medial interior midsole sidewall, wherein the outwardly extending medial stem extends into the first medial opening beyond the medial inner surface of the medial sidewall region, wherein the outwardly extending medial stem includes an exterior medial stem surface, wherein at least a portion of an axial length of the exterior medial stem surface of the outwardly extending medial stem extends along, is unfixed to, and is movable with respect to the interior medial surface of the first medial opening, and wherein the outwardly extending medial stem has at least one feature selected from the group consisting of:

(a) the outwardly extending medial stem extends into the first medial opening beyond the medial inner surface of the medial sidewall region at least to a location at or adjacent the medial outer surface of the medial sidewall region;

(b) the exterior medial stem surface of the outwardly extending medial stem is complementary shaped with respect to the interior medial surface of the first medial opening over at least 25% of an axial length of the first medial opening; or (c) a free end of the outwardly extending medial stem extends outward beyond an outermost extent of the first medial opening;

a lateral interior midsole sidewall directly attached to the frame by an adhesive or cement, wherein the lateral interior midsole sidewall includes an outwardly extending lateral stem projecting sideways away from a base surface of the lateral interior midsole sidewall, wherein the outwardly extending lateral stem extends into the first lateral opening beyond the lateral inner surface of the lateral sidewall region, wherein the outwardly extending lateral stem includes an exterior lateral stem surface, wherein at least a portion of an axial length of the exterior lateral stem surface of the outwardly extending lateral stem extends along, is unfixed to, and is movable with respect to the interior lateral surface of the first lateral opening, and wherein the outwardly extending lateral stem has at least one feature selected from the group consisting of:

(a) the outwardly extending lateral stem extends into the lateral opening beyond the lateral inner surface of the lateral sidewall region at least to a location at or adjacent the lateral outer surface of the lateral sidewall region;

(b) the exterior lateral stem surface of the outwardly extending lateral stem is complementary shaped with respect to the interior lateral surface of the first lateral opening over at least 25% of an axial length of the first lateral opening; or (c) a free end of the outwardly extending lateral stem extends outward beyond an outermost extent of the first lateral opening.

16. The sole structure according to claim 15, wherein the medial sidewall region and the lateral sidewall region of the frame are integrally formed as parts of a unitary, one-piece frame component.

17. The sole structure according to claim 15, wherein a base support surface connects the medial sidewall region and the lateral sidewall region.

18. The sole structure according to claim 15, wherein the medial interior midsole sidewall is formed as a portion of a first interior midsole component and the lateral interior midsole sidewall is formed as a portion of a second interior midsole component that is a separate part from the first interior midsole component.

19. The sole structure according to claim 18, wherein a central midsole part extends between the first interior midsole component and the second interior midsole component.

20. A sole structure for an article of footwear, comprising:

a frame including:

(a) a medial sidewall region located on a medial side of the sole structure, wherein the medial sidewall region includes a medial outer surface and a medial inner surface, wherein a first medial opening, a second medial opening, and a third medial opening are defined through the medial sidewall region extending from the medial outer surface to the medial inner surface, wherein the first medial opening includes a first interior medial surface extending from the medial outer surface to the medial inner surface, wherein the second medial opening includes a second interior medial surface extending from the medial outer surface to the medial inner surface, and wherein the third medial opening includes a third interior medial surface extending from the medial outer surface to the medial inner surface, and (b) a lateral sidewall region located on a lateral side of the sole structure, wherein the lateral sidewall region includes a lateral outer surface and a lateral inner surface, wherein a first lateral opening, a second lateral opening, and a third lateral opening are defined through the lateral sidewall region extending from the lateral outer surface to the lateral inner surface, wherein the first lateral opening includes a first interior lateral surface extending from the lateral outer surface to the lateral inner surface, wherein the second lateral opening includes a second interior lateral surface extending from the lateral outer surface to the lateral inner surface, and wherein the third lateral opening includes a third interior lateral surface extending from the lateral outer surface to the lateral inner surface;

a medial interior midsole sidewall directly attached to the frame by an adhesive or cement, wherein the medial interior midsole sidewall includes a first outwardly extending medial stem, a second outwardly extending medial stem, and a third outwardly extending medial stem projecting sideways away from a base surface of the medial interior midsole sidewall, wherein the first outwardly extending medial stem extends into the first medial opening beyond the medial inner surface of the medial sidewall region, wherein the first outwardly extending medial stem includes a first exterior medial stem surface, wherein at least a portion of an axial length of the first exterior medial stem surface of the first outwardly extending medial stem extends along, is unfixed to, and is movable with respect to the first interior medial surface of the first medial opening, and wherein the first outwardly extending medial stem has at least one feature selected from the group consisting of:

(a) the first outwardly extending medial stem extends into the first medial opening beyond the medial inner surface of the medial sidewall region at least to a location at or adjacent the medial outer surface of the medial sidewall region, (b) the first exterior medial stem surface of the first outwardly extending medial stem is complementary shaped with respect to the first interior medial surface of the first medial opening over at least 25% of an axial length of the first medial opening, or (c) a free end of the first outwardly extending medial stem extends outward beyond an outermost extent of the first medial opening, wherein the second outwardly extending medial stem extends into the second medial opening beyond the medial inner surface of the medial sidewall region, wherein the second outwardly extending medial stem includes a second exterior medial stem surface, wherein at least a portion of an axial length of the second exterior medial stem surface of the second outwardly extending medial stem extends along, is unfixed to, and is movable with respect to the second interior medial surface of the second medial opening, and wherein the second outwardly extending medial stem has at least one feature selected from the group consisting of:

(a) the second outwardly extending medial stem extends into the second medial opening beyond the medial inner surface of the medial sidewall region at least to a location at or adjacent the medial outer surface of the medial sidewall region, (b) the second exterior medial stem surface of the second outwardly extending medial stem is complementary shaped with respect to the second interior medial surface of the second medial opening over at least 25% of an axial length of the second medial opening, or (c) a free end of the second outwardly extending medial stem extends outward beyond an outermost extent of the second medial opening, wherein the third outwardly extending medial stem extends into the third medial opening beyond the medial inner surface of the medial sidewall region, wherein the third outwardly extending medial stem includes a third exterior medial stem surface, wherein at least a portion of an axial length of the third exterior medial stem surface of the third outwardly extending medial stem extends along, is unfixed to, and is movable with respect to the third interior medial surface of the third medial opening, and wherein the third outwardly extending medial stem has at least one feature selected from the group consisting of:

(a) the third outwardly extending medial stem extends into the third medial opening beyond the medial inner surface of the medial sidewall region at least to a location at or adjacent the medial outer surface of the medial sidewall region, (b) the third exterior medial stem surface of the third outwardly extending medial stem is complementary shaped with respect to the third interior medial surface of the third medial opening over at least 25% of an axial length of the third medial opening, or (c) a free end of the third outwardly extending medial stem extends outward beyond an outermost extent of the third medial opening; and a lateral interior midsole sidewall directly attached to the frame by an adhesive or cement, wherein the lateral interior midsole sidewall includes a first outwardly extending lateral stem, a second outwardly extending lateral stem, and a third outwardly extending lateral stem projecting sideways away from a base surface of the lateral interior midsole sidewall, wherein the first outwardly extending lateral stem extends into the first lateral opening beyond the lateral inner surface of the lateral sidewall region, wherein the first outwardly extending lateral stem includes a first exterior lateral stem surface, wherein at least a portion of an axial length of the first exterior lateral stem surface of the first outwardly extending lateral stem extends along, is unfixed to, and is movable with respect to the first interior lateral surface of the first lateral opening, and wherein the first outwardly extending lateral stem has at least one feature selected from the group consisting of:

(a) the first outwardly extending lateral stem extends into the first lateral opening beyond the lateral inner surface of the lateral sidewall region at least to a location at or adjacent the lateral outer surface of the lateral sidewall region, (b) the first exterior lateral stem surface of the first outwardly extending lateral stem is complementary shaped with respect to the first interior lateral surface of the first lateral opening over at least 25% of an axial length of the first lateral opening, or (c) a free end of the first outwardly extending lateral stem extends outward beyond an outermost extent of the first lateral opening, wherein the second outwardly extending lateral stem extends into the second lateral opening beyond the lateral inner surface of the lateral sidewall region, wherein the second outwardly extending lateral stem includes a second exterior lateral stem surface, wherein at least a portion of an axial length of the second exterior lateral stem surface of the second outwardly extending lateral stem extends along, is unfixed to, and is movable with respect to the second interior lateral surface of the second lateral opening, and wherein the second outwardly extending lateral stem has at least one feature selected from the group consisting of:

(a) the second outwardly extending lateral stem extends into the second lateral opening beyond the lateral inner surface of the lateral sidewall region at least to a location at or adjacent the lateral outer surface of the lateral sidewall region, (b) the second exterior lateral stem surface of the second outwardly extending lateral stem is complementary shaped with respect to the second interior lateral surface of the second lateral opening over at least 25% of an axial length of the second lateral opening, or (c) a free end of the second outwardly extending lateral stem extends outward beyond an outermost extent of the second lateral opening, and wherein the third outwardly extending lateral stem extends into the third lateral opening beyond the lateral inner surface of the lateral sidewall region, wherein the third outwardly extending lateral stem includes a third exterior lateral stem surface, wherein at least a portion of an axial length of the third exterior lateral stem surface of the third outwardly extending lateral stem extends along, is unfixed to, and is movable with respect to the third interior lateral surface of the third lateral opening, and wherein the third outwardly extending lateral stem has at least one feature selected from the group consisting of:

(a) the third outwardly extending lateral stem extends into the third lateral opening beyond the lateral inner surface of the lateral sidewall region at least to a location at or adjacent the lateral outer surface of the lateral sidewall region, (b) the third exterior lateral stem surface of the third outwardly extending lateral stem is complementary shaped with respect to the third interior lateral surface of the third lateral opening over at least 25% of an axial length of the third lateral opening, or (c) a free end of the third outwardly extending lateral stem extends outward beyond an outermost extent of the third lateral opening.

* * * * *